US010577791B2

(12) United States Patent
Hakuta et al.

(10) Patent No.: US 10,577,791 B2
(45) Date of Patent: Mar. 3, 2020

(54) SOUNDPROOF STRUCTURE AND SOUNDPROOF SYSTEM

(71) Applicant: FUJIFILM Corporation, Tokyo (JP)

(72) Inventors: Shinya Hakuta, Ashigara-kami-gun (JP); Shogo Yamazoe, Ashigara-kami-gun (JP); Akihiko Ohtsu, Ashigara-kami-gun (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 0 days.

(21) Appl. No.: 16/279,300

(22) Filed: Feb. 19, 2019

(65) Prior Publication Data

US 2019/0186127 A1 Jun. 20, 2019

Related U.S. Application Data

(63) Continuation of application No. PCT/JP2017/030947, filed on Aug. 29, 2017.

(30) Foreign Application Priority Data

Aug. 31, 2016 (JP) ..... 2016-170244

(51) Int. Cl.
*E04B 1/84* (2006.01)
*E04B 1/86* (2006.01)
(Continued)

(52) U.S. Cl.
CPC ..... *E04B 1/8409* (2013.01); *E04B 1/8404* (2013.01); *E04B 1/86* (2013.01);
(Continued)

(58) Field of Classification Search
CPC .. E04B 1/8409; E04B 1/86; E04B 2001/8485; G10K 11/16; G10K 11/172; F24F 13/24
(Continued)

(56) References Cited

U.S. PATENT DOCUMENTS 5,869,792 A * 2/1999 Allen ..... F01D 25/30 181/224
5,912,442 A 6/1999 Nye et al.
(Continued)

FOREIGN PATENT DOCUMENTS

CA 2164370 A1 6/1997
CN 202093817 U 12/2011
(Continued)

OTHER PUBLICATIONS

International Preliminary Report on Patentability dated Mar. 5, 2019 from the International Bureau in counterpart International Application No. PCT/JP2017/030947.
(Continued)

*Primary Examiner* — Jeremy A Luks
(74) *Attorney, Agent, or Firm* — Sughrue Mion, PLLC

(57) ABSTRACT

There is provided a soundproof structure having two or more soundproof units. Each soundproof unit has a frame having an opening portion and a sound absorbing member attached to the opening portion of the frame. Two adjacent soundproof units are disposed such that at least parts of the sound absorbing members face each other. The sound absorbing members at least parts of which face each other are spaced apart from each other. An average distance between the sound absorbing members at least parts of which face each other is less than 20 mm. Therefore, it is possible to provide a soundproof structure and a soundproof system that can soundproof low frequency side sound with a simple configuration, is small and lightweight, and can easily change its frequency characteristics.

22 Claims, 27 Drawing Sheets

(51) Int. Cl.
*G10K 11/172* (2006.01)
*F24F 13/24* (2006.01)

(52) U.S. Cl.
CPC ..... *F24F 13/24* (2013.01); *G10K 11/172* (2013.01); *E04B 2001/8485* (2013.01); *F24F 2013/242* (2013.01)

(58) Field of Classification Search
USPC ..... 181/284, 286, 291, 293
See application file for complete search history.

(56) References Cited

U.S. PATENT DOCUMENTS

| | | | | |
|---|---|---|---|---|
| 6,601,673 | B2 * | 8/2003 | Murakami | F02B 77/13 181/204 |
| 7,891,464 | B2 * | 2/2011 | Tang | F04D 25/08 181/224 |
| 10,062,369 | B2 * | 8/2018 | Mekid | G10K 11/002 |
| 2005/0098379 | A1 * | 5/2005 | Sato | B60R 13/0815 181/293 |
| 2005/0161280 | A1 * | 7/2005 | Furuya | F01N 1/003 181/225 |
| 2008/0128200 | A1 * | 6/2008 | Tsugihashi | B60J 5/0418 181/284 |
| 2009/0084627 | A1 * | 4/2009 | Tsugihashi | B60J 5/00 181/290 |
| 2010/0065369 | A1 | 3/2010 | Honji | |
| 2011/0100748 | A1 | 5/2011 | Nonogi et al. | |
| 2013/0126268 | A1 | 5/2013 | Honji et al. | |
| 2015/0176269 | A1 | 6/2015 | Kang et al. | |
| 2016/0230778 | A1 | 8/2016 | Mekid et al. | |
| 2017/0263235 | A1 * | 9/2017 | Elford | G10K 11/172 |

FOREIGN PATENT DOCUMENTS

| | | | |
|---|---|---|---|
| EP | 0552400 | A1 | 7/1993 |
| JP | 59-150808 | U | 10/1984 |
| JP | 11-91017 | A | 4/1999 |
| JP | 2000-234315 | A | 8/2000 |
| JP | 2005-273273 | A | 10/2005 |
| JP | 2008-215064 | A | 9/2008 |
| JP | 2010-097149 | A | 4/2010 |
| JP | 2010084509 | A | 4/2010 |
| JP | 2011-241583 | A | 12/2011 |
| JP | 4832245 | B2 | 12/2011 |
| JP | 2013-125186 | A | 6/2013 |
| JP | 2013109189 | A | 6/2013 |
| JP | 2015-184524 | A | 10/2015 |
| JP | 2016-069132 | A | 5/2016 |
| WO | 2016/038326 | A1 | 3/2016 |

OTHER PUBLICATIONS

Written Opinion for PCT/JP2017/030947 dated Nov. 7, 2017 [PCT/ISA/237].
International Search Report for PCT/JP2017/030947 dated Nov. 7, 2017 [PCT/ISA/210].
Communication dated Sep. 11, 2019, from the European Patent Office in counterpart European Application No. 17846494.7.
Mitsuhiro Yoda et al., "Estimation of an open-loop compact adaptive passive noise control system with microstructures", The Journal of the Acoustical Society of America, Jul. 2001, vol. 110, No. 1, pp. 638-641 (4 pages total).
Communication dated Sep. 10, 2019, from the Japanese Patent Office in counterpart Application No. 2018-537297.
Notice of Reasons for Refusal, dated Oct. 15, 2019, issued in corresponding JP Application No. 2018-537297, 6 pages in English and Japanese.
Communication dated Sep. 9, 2019, from the State Intellectual Property Office of the P.R.C in application No. 201780053376.0.

* cited by examiner

SOUNDPROOF STRUCTURE AND SOUNDPROOF SYSTEM

CROSS-REFERENCE TO RELATED APPLICATIONS

This application is a Continuation of PCT International Application No. PCT/JP2017/030947 filed on Aug. 29, 2017, which claims priority under 35 U.S.C. § 119(a) to Japanese Patent Application No. 2016-170244 filed on Aug. 31, 2016. The above application is hereby expressly incorporated by reference, in its entirety, into the present application.

BACKGROUND OF THE INVENTION

1. Field of the Invention

The present invention relates to a soundproof structure and a soundproof system. Specifically, the present invention relates to a small soundproof structure that can insulate sound on the low frequency side with a simple configuration by arranging two soundproof units, each of which has a frame and a sound absorbing member attached to an opening portion of the frame, close to each other so that the sound absorbing members face each other. That is, the present invention relates to a small soundproof structure for selectively strongly shielding sound with a lower frequency as a target. In addition, the present invention relates to a soundproof system capable of easily adjusting the center frequency of soundproofing using such a soundproof structure.

2. Description of the Related Art

In conventional soundproof materials, a sound insulation material follows the mass law. In addition, with regard to sound absorbing materials, the absorbance of a common sound absorbing material, such as urethane, is determined by the ratio between the size of the sound absorbing material and the sound wavelength. Also in film type sound absorbing materials or sound absorbing materials that absorb sound using resonance, such as Helmholtz resonance, the soundproofing frequency is determined by the size of the rear volume. According to these laws, the high frequency side can be soundproofed even with relatively small size and light weight, but a heavy weight and a large size are required for the low frequency side (refer to JP4832245B).

JP4832245B discloses a sound absorbing body that has a frame body, which has a through-hole formed therein, and a sound absorbing material, which covers one opening of the through-hole and whose first storage modulus E1 is $9.7\times10^6$ or more and second storage modulus E2 is 346 or less (refer to abstract, claim 1, paragraphs [0005] to [0007] and [0034], and the like). The storage modulus of the sound absorbing material means a component, which is internally stored, of the energy generated in the sound absorbing material by sound absorption.

In JP4832245B, in the embodiment, by using a sound absorbing material containing a resin or a mixture of a resin and a filler as a mixing material, it is possible to achieve a high sound absorption effect in a low frequency region of 500 Hz or less without causing an increase in the size of the sound absorbing body. Here, in the present embodiment, the peak value of the sound absorption rate is in the range of 0.5 to 1.0, and the peak frequency is in the range of 290 to 500 Hz.

On the other hand, an acoustic panel that enables sound insulation in the entire low frequency region to enable better soundproofing from the low frequency region to the high frequency region has also been proposed (refer to JP2005-273273A).

JP2005-273273A discloses an acoustic panel in which a microporous plate, in which a number of micropores passing through the microporous plate in a plate thickness direction are provided, and a nonporous plate without micropores are laminated in close contact with each other or are disposed relative to each other with a predetermined distance therebetween. JP2005-273273A discloses a sound absorbing and sound insulating apparatus in which a plurality of acoustic panels are arranged at predetermined distances therebetween so as to face a sound source (refer to abstract, claim 1, paragraph [0059], FIG. 15, and the like).

JP2005-273273A states that the peak of the sound absorption rate shifts to the low frequency region by providing a nonporous plate with respect to the microporous plate and increasing the area density of the nonporous plate. JP2005-273273A enables soundproofing in the entire low frequency region without causing resonance even in the low frequency region. In addition, since the apparatus disclosed in JP2005-273273A has a larger transmission loss than the conventional acoustic panel and the sound absorbing and sound insulating apparatus from the low frequency region to the high frequency region, the entire apparatus can be configured more compactly. Therefore, there are few restrictions on the installation place, and costs can be reduced.

SUMMARY OF THE INVENTION

Incidentally, it is well known that it is difficult to absorb low-frequency sound with a common broadband soundproof material, such as urethane or glass wool. As a device for absorbing a specific sound, there is a film type sound absorbing material, such as that disclosed in JP4832245B, or a Helmholtz sound absorbing material. In cases of these sound absorbing materials, however, it is necessary to increase the rear surface volume as the frequency becomes low. For this reason, there has been a problem that the structure size increases.

There are various kinds of noise. For example, even in the case of noise from motors or fans of the same standard, a difference in noise frequency appears due to individual differences of respective apparatuses. In order to cope with this, it is necessary to change the sound absorption frequency. However, since the film thickness and the film tension are dominant parameters of the sound absorption frequency in the film type sound absorbing material such as that disclosed in JP4832245B and the size of a through-hole or the like is a dominant parameter of the sound absorption frequency in the Helmholtz sound absorbing material, there has been a problem that it is difficult to continuously change the sound absorption frequency.

In JP2005-273273A, by arranging two acoustic panels with a predetermined distance therebetween so as to face a sound source using an acoustic panel in which a nonporous plate is provided with respect to a microporous plate, it is possible to realize soundproofing in the entire low frequency region without causing resonance even in the low frequency region. In JP2005-273273A, however, there has been a problem that it is not possible to strongly insulate a specific frequency different for each apparatus on the low frequency side although it is possible to eliminate the resonance at which the transmission loss occurring only in the nonporous plate becomes 0 dB and the noise in the low frequency region different for each apparatus as described above can be evenly soundproofed to some extent.

Space and weight reduction are important issues in soundproofing inside apparatuses (automobiles, office equipment, and the like), building materials, and the like. As a result, there has been a problem that soundproofing on the low frequency side is difficult. Therefore, a technique that enables soundproofing on the lower frequency side with the same size as in the related art has been demanded.

In apparatus soundproofing, there are noise variations due to individual differences of apparatuses or frequency changes of noise due to aged deterioration, and various, frequencies are also present in general noise. In contrast, in conventional soundproof materials, there has been a problem that it is necessary to change an amount that cannot be easily adjusted, such as the size, tension, and/or hole diameter, for the soundproofing frequency. Therefore, a mechanism for easily adjusting the soundproofing frequency has been demanded.

It is an object of the present invention to provide a soundproof structure which can insulate sounds on the low frequency side with a simple configuration, that is, selectively strongly shield sounds with lower frequencies as a target, which is small and lightweight, and which can easily change its frequency characteristics by solving the problems the above-described conventional technique.

In addition to the object described above, it is another object of the present invention to provide a soundproof system capable of easily adjusting the center frequency of sound insulation according to the external noise environment by using such a soundproof structure.

In the present invention, "soundproof" includes the meaning of both "sound insulation" and "sound absorption" as acoustic characteristics, but in particular, refers to "sound insulation". "Sound insulation" refers to "shielding sound", that is, "not allowing sound to pass through". Therefore, "sound insulation" includes "reflecting" sound (reflection of sound) and "absorbing" sound (absorption of sound) (refer to Sanseido Daijibin (Third Edition) and http://www.onzai.or.jp/question/soundproof.html and http://www.onzai.or.jp/pdf/new/gijutsu201312_3.pdf on the web page of the Japan Acoustological Materials Society).

Hereinafter, basically, "sound insulation" and "shielding" are referred to in a case where "reflection" and "absorption" are not distinguished from each other, and "reflection" and "absorption" are referred to in a case where "reflection" and "absorption" are distinguished from each other.

In order to achieve the aforementioned object, a soundproof structure according to a first aspect of the present invention is a soundproof structure comprising two or more soundproof units. Each soundproof unit has a frame having an opening portion and a sound absorbing member attached to the opening portion of the frame. Two adjacent soundproof units are disposed such that at least parts of the sound absorbing members face each other. The sound absorbing members at least parts of which face each other are spaced apart from each other. An average distance between the sound absorbing members at least parts of which face each other is less than 20 mm.

Here, it is preferable that the sound absorbing member is a film that vibrates with respect to sound and the film covers the opening portion of the frame and is fixed to the frame.

It is preferable that the sound absorbing member is a ventilation sheet structure.

It is preferable that the sound absorbing member is a plate or a film in which at least first one or more through-holes are provided, the first through-hole is a through-hole having a diameter greater than 0.25 mm, and the plate or the film covers the opening portion of the frame and is fixed to the frame.

It is preferable that the sound absorbing member is a plate-shaped member comprising a plurality of micro second through-holes each having a diameter of 0.1 μm to 250 μm.

It is preferable that the sound absorbing member is a fiber sheet.

It is preferable that at least one of the two or more soundproof units is closed except for a surface having the sound absorbing member.

It is preferable that, in at least one of the two or more soundproof units, at least a part of a surface facing a surface having the sound absorbing member is opened.

It is preferable that at least one of the two or more soundproof units has the sound absorbing member on each of two surfaces facing each other.

It is preferable that, in at least one of the two or more soundproof units, at least parts of side surfaces of surfaces of the sound absorbing members of the two adjacent soundproof units facing each other are blocked.

It is preferable that, in at least one of the two or more soundproof units, a porous sound absorbing body or a fibrous sound absorbing body is included in the frame.

It is preferable that at least one of the two or more soundproof units is disposed on a wall of a structure.

It is preferable that, with the two adjacent soundproof units as a set of soundproof units, a plurality of sets of soundproof units are combined to function as a soundproof wall.

It is preferable that the two or more soundproof units are disposed in a cylindrical member and a part of a hole portion inside the cylindrical member is opened.

It is preferable that at least one of the two or more soundproof units is disposed on an inner wall of the cylindrical member.

It is preferable that the two or more soundproof units are periodically arranged.

It is preferable that, with the two or more soundproof units including the two adjacent soundproof units as a unit, a plurality of the units are disposed.

It is preferable to further comprise a moving mechanism that moves the sound absorbing member of one of the two adjacent soundproof units relative to the other sound absorbing member. It is preferable that the moving mechanism changes a distance between the sound absorbing members of the two adjacent soundproof units.

It is preferable that the moving mechanism is a rail traveling mechanism comprising a rail and a wheel on which at least one of the two adjacent soundproof units is mounted and which travels on the rail.

It is preferable that the moving mechanism is a screw moving mechanism, which comprises a ball screw and a nut to which at least one of the two adjacent soundproof units is attached and which is screwed to the ball screw, or a rack and pinion mechanism which comprises a rack, to which at least one of the two adjacent soundproof units is attached, and a pinion engaged with the rack.

In addition, in order to achieve the aforementioned object, a soundproof system according to a second aspect of the present invention comprises: the soundproof structure described above; a measurement unit that measures noise in a surrounding environment of the soundproof structure; and an analysis unit that analyzes a frequency of noise measured by the measurement unit. A distance between the sound absorbing members of the two adjacent soundproof units is changed according to an analysis result of the analysis unit.

Here, it is preferable that the soundproof mechanism is the soundproof structure comprising the moving mechanism. It is preferable that the moving mechanism is an automatic moving mechanism further comprising a driving source and a control unit that controls driving of the driving source. It is preferable that the analysis unit determines a movement amount of at least one of the two adjacent soundproof units according to the analysis result. It is preferable that the control unit controls the driving of the driving source according to the determined movement amount to automatically move at least one of the two adjacent soundproof units such that a distance between the sound absorbing members of the two adjacent soundproof units is changed.

It is preferable to further comprise a plurality of the measurement units. It is preferable that the analysis unit analyzes the frequency of noise measured by each of the plurality of measurement units and determines the movement amount of at least one of the two adjacent soundproof units according to the analysis result.

According to the present invention, it is possible to insulate sound on the low frequency side with a simple configuration. That is, according to the present invention, it is possible to selectively strongly shield target sounds having lower frequencies, realize reductions in size and weight, and easily change its frequency characteristics.

In addition, according to the present invention, it is possible to easily adjust the center frequency of soundproofing according to the external noise environment.

DESCRIPTION OF THE PREFERRED EMBODIMENTS

Hereinafter, a soundproof structure and a soundproof system according to the embodiment of the present invention will be described in detail with reference to preferred embodiments shown in the accompanying diagrams.

The soundproof structure according to the embodiment of the present invention is characterized in that the resonance frequency is shifted to the low frequency side by arranging the surfaces of sound absorbing members, such as film surfaces or plate surfaces of soundproof units configured to include sound absorbing members such as films or plates attached to a frame such as a vibration film type sound absorbing body, a Helmholtz sound absorbing body, a fiber sheet type sound absorbing body, or a micro through-hole sound absorbing body, close to each other, so that it is possible to insulate sounds on the low frequency side with the same volume.

Here, the vibration film type sound absorbing body is a resonance type sound absorbing body (hereinafter, referred to as a vibration film type soundproof cell in this specification) having a closed space volume on the rear surface of the film and using film vibration. The Helmholtz sound absorbing body is a resonance type sound absorbing body (hereinafter, referred to as a Helmholtz soundproof cell in this specification) having a closed space volume on the rear surface of a plate or a film with a through-hole and using Helmholtz resonance. The fiber sheet type sound absorbing body is a sound absorbing body (hereinafter, referred to as a fiber sheet type soundproof cell in this specification) having a closed space volume on the rear surface of the fiber sheet. The micro through-hole sound absorbing body is a sound absorbing body (hereinafter, referred to as a micro through-hole soundproof cell in this specification) having a closed space volume on the rear surface of a film or a plate with a plurality of micro through-holes of 0.1 to 250 μm.

In the present invention, the frequency amount shifted to the low frequency side depends on the distance between the two sound absorbing members, and shifting to the low frequency side increases as the distance decreases. Accordingly, there is also a feature that a soundproofing frequency can be adjusted simply by adjusting the distance between the two sound absorbing members. Therefore, by combining a distance adjusting mechanism, such as a rail, as a soundproof unit moving mechanism, it is possible to easily change the frequency to be soundproofed. In addition, by measuring the noise with a microphone or the like and analyzing the frequency with an analyzer or the like, appropriate sound insulation can be achieved by adjusting the distance between the two sound absorbing members according to the analysis result.

Figure 1:
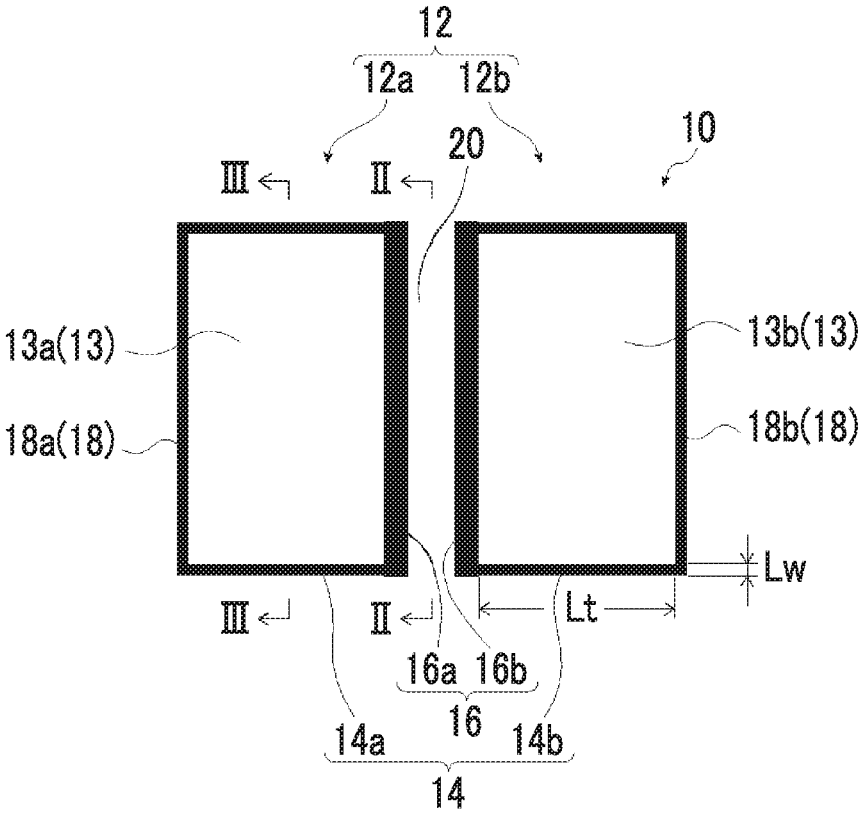
FIG. 1 is a cross-sectional view schematically showing an example of a soundproof structure according to an embodiment of the present invention.
Figure 2:
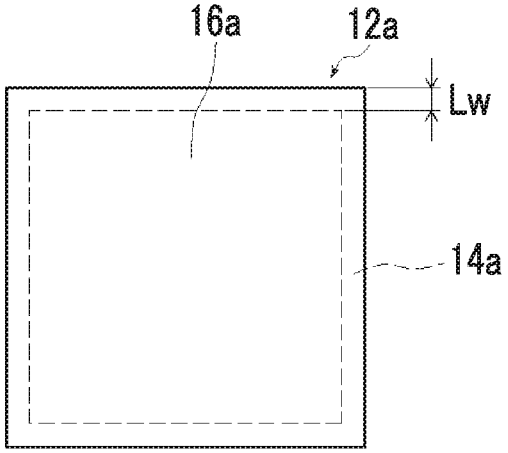
FIG. 2 is a diagram of the soundproof structure shown in FIG. 1 taken along the line II-II.
Figure 3:
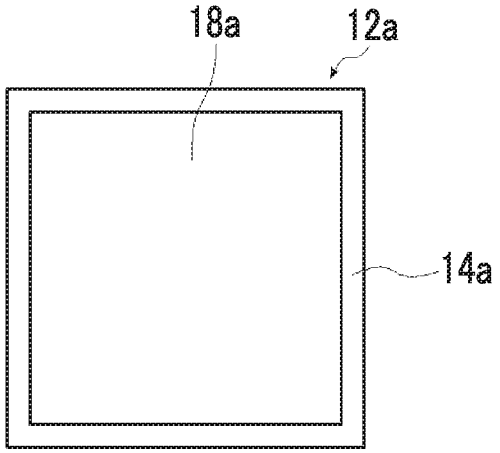
FIG. 3 is a schematic cross-sectional view of the soundproof structure shown in FIG. 1 taken along the line III-III.

FIG. 1 is a cross-sectional view schematically showing an example of a soundproof structure according to an embodiment of the present invention. FIG. 2 is a diagram of the soundproof structure shown in FIG. 1 taken along the line II-II. FIG. 3 is a schematic cross-sectional view of the soundproof structure shown in FIG. 1 taken along the line III-III.

A soundproof structure 10 according to the embodiment of the present invention shown in FIGS. 1, 2, and 3 has two soundproof units 12 (12*a*, 12*b*).

Each soundproof unit 12 (12*a*, 12*b*) has a frame 14 (14*a*, 14*b*) having an opening portion 13 (13*a*, 13*b*), a sound absorbing member 16 (16*a*, 16*b*) fixed to the frame 14 so as to cover one side of the opening portion 13 of the frame 14, and a rear plate 18 (18*a*, 18*b*) fixed to the frame 14 so as to cover the other side of the opening portion 13 of the frame 14.

In the soundproof structure 10 of the illustrated example, the two soundproof units 12*a* and 12*b* are disposed such that the sound absorbing members 16*a* and 16*b* face each other so as to be close to each other, and a rectangular parallelepiped slit 20 is formed between the sound absorbing members 16*a* and 16*b*. In the present invention, the fact that the two sound absorbing members 16*a* and 16*b* are close to each other means that the average distance between the two sound absorbing members 16*a* and 16*b* is as short as less than 20 mm, but the two sound absorbing members 16*a* and 16*b* are spaced apart from each other.

Incidentally, in the present invention, the distance between the sound absorbing members, for example, the distance between the two sound absorbing members 16*a* and 16*b* means a distance or an interval between the two sound absorbing members 16*a* and 16*b*. However, as will be described later, both end surfaces of the two sound absorbing members 16*a* and 16*b* may not completely face each other. For example, one of the two sound absorbing members 16*a* and 16*b* may be translated (shifted in parallel), rotated, or shifted and rotated with respect to the other one. Therefore, in the present invention, the distance between the sound absorbing members is expressed by the average distance between the sound absorbing members. The details of the average distance between the sound absorbing members will be described later.

The present invention has been made by finding out that the sound absorption frequency is shifted to a low frequency by bringing the surfaces (sound absorbing surfaces) of sound absorbing members close to each other, which was not known in the related art, as a result of intensive studies of the present inventors on sound insulation in a low frequency region that has been difficult. That is, the present invention has been made by finding out that the effect of the low frequency shift occurs less than 20 mm and the effect becomes more noticeable as the average distance between the sound absorbing members decreases. It can be thought that these findings were not made in the related art because the wavelength of the sound was extremely larger than the gap size. In addition, it can be thought that it was not easy to imagine the findings because, generally, the sound absorbing body was disposed so as to mainly face the sound or was disposed so as to face at least a surface through which sound passed (a structure in which a sound absorbing member was disposed in a horizontal direction with respect to the wall in a tube, or the like) and it was not common to arrange sound absorbing members close to each other so that sound was hidden from the surface through which the sound passed.

Therefore, in the present invention, it is necessary to limit the average distance between the sound absorbing members of the sound absorbing members 16*a* and 16*b* to less than 20 mm.

The reason is that, in a case where the average distance between the two sound absorbing members 16*a* and 16*b* is 20 mm or more, the effect of low frequency shift of the sound absorption frequency cannot be seen.

In the present invention, the average distance between the sound absorbing members 16*a* and 16*b* is preferably 15 mm or less, more preferably 10 mm or less, even more preferably 5 mm or less, and most preferably 2 mm or less.

In the following description, in a case where components of the soundproof structure 10, such as the two soundproof units 12*a* and 12*b*, the opening portions 13*a* and 13*b*, the frames 14*a* and 14*b*, the sound absorbing members 16*a* and 16*b*, and the rear plates 18*a* and 18*b*, have the same configuration and it is not necessary to distinguish therebetween, the two soundproof units 12*a* and 12*b*, the opening portions 13*a* and 13*b*, the frames 14*a* and 14*b*, the sound absorbing members 16*a* and 16*b*, and the rear plates 18*a* and 18*b* will be collectively described without distinction as the soundproof unit 12, the opening portion 13, the frame 14, the sound absorbing member 16, and the rear plate 18, respectively.

The soundproof unit 12 used in the present invention has the frame 14 having the opening portion 13 and the sound absorbing member 16, such as a film or a plate attached to the opening portion 13 of the frame 14. A soundproof cell is not particularly limited, and any soundproof cell capable of absorbing sound by the sound absorbing member 16 and a space formed on the rear surface by the frame 14, preferably, a closed space. As the soundproof unit 12, for example, a vibration film type soundproof cell that absorbs sound by film vibration, a Helmholtz soundproof cell that absorbs sound by Helmholtz resonance using a through-hole, and a micro through-hole soundproof cell that absorbs sound using a micro through-hole can be mentioned. The details of the configuration of these soundproof cells will be described later.

In the soundproof structure 10 shown in FIG. 1, the two soundproof units 12*a* and 12*b* are disposed in parallel without positional shift such that the sound absorbing members 16*a* and 16*b* face each other. However, the present invention is not limited thereto.

Figure 4:
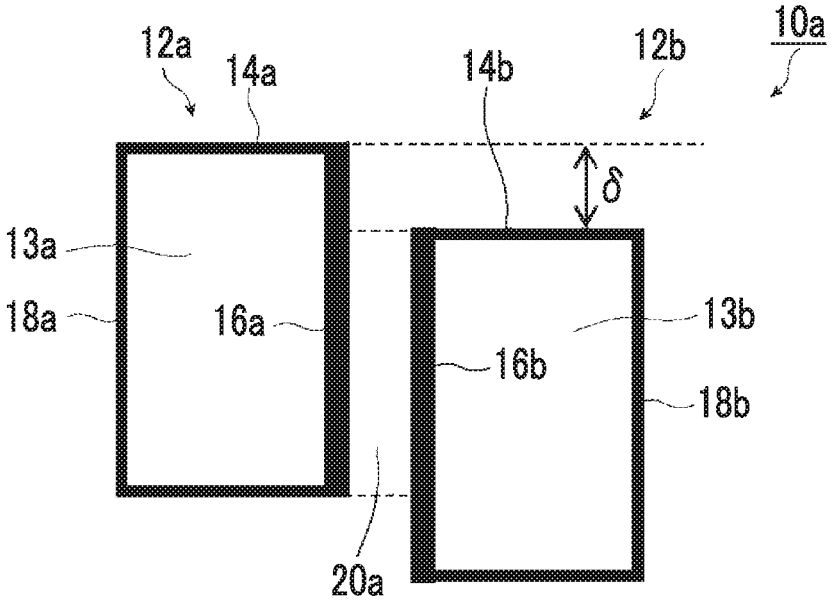
FIG. 4 is a schematic cross-sectional view of an example of a soundproof structure according to another embodiment of the present invention.

For example, as in the case of a soundproof structure 10*a* shown in FIG. 4, in a case where at least parts of the sound absorbing members 16*a* and 16*b* face each other and there is a facing portion therebetween, the two soundproof units 12*a* and 12*b* may be shifted by a predetermined shift amount δ. A rectangular parallelepiped slit 20*a* is formed in a portion where the sound absorbing members 16*a* and 16*b* face each other. However, the length (opposite length) of the slit 20*a* is smaller than the length of the slit 20 shown in FIG. 1 by the position shift amount δ.

In this manner, by shifting the other sound absorbing member 16*b* with respect to the one sound absorbing member 16*a*, it is possible to change the absorption peak frequency at which the sound absorption is the peak. However, in order to reduce the absorption peak frequency to a lower frequency, it is preferable that the shift amount δ is small, and it is more preferable that there is no positional shift.

Figure 5:
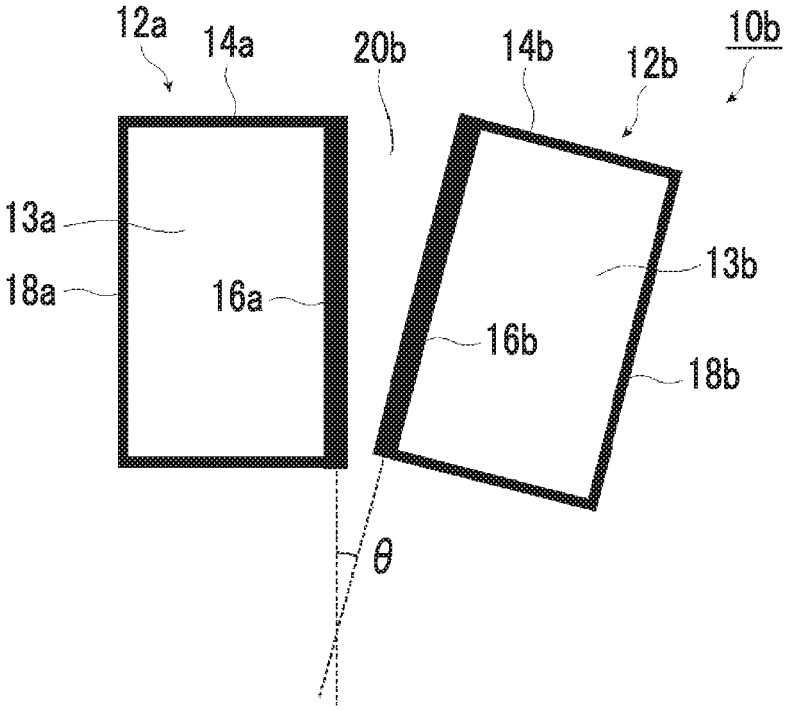
FIG. 5 is a schematic cross-sectional view of an example of a soundproof structure according to another embodiment of the present invention.

As in a soundproof structure 10*b* shown in FIG. 5, the other sound absorbing member 16*b* may be inclined by a predetermined angle θ with respect to one sound absorbing member 16*a*. Needless to say, as long as at least parts of the sound absorbing members 16*a* and 16*b* face each other, the other sound absorbing member may be shifted (translated) and inclined by a predetermined angle θ by a predetermined shift amount δ with respect to one sound absorbing member. Also in this case, an approximately trapezoidal slit 20*b* is formed in a portion where the sound absorbing members 16*a* and 16*b* face each other.

In a case where there is no positional shift (shift amount δ=0) and there is an inclination of a predetermined angle θ, the sound absorbing member 16*a* is rotated about the central portion of the sound absorbing member 16*b*. Therefore, the average distance between the sound absorbing members 16*a* and 16*b* is the same as that in a case where the sound absorbing members 16*a* and 16*b* are not shifted (translated) and not rotated, and there is no change. For this reason, the absorption peak frequency does not change. This shows that, even in a case where the sound absorbing members 16*a* and 16*b* are not completely parallel to each other, frequency lowering can be realized, and that the manufacturing of the soundproof structure according to the embodiment of the present invention is easy and the manufacturability is high.

In the present invention, there is a case where the other sound absorbing member is shifted (translated) by a predetermined shift amount δ and inclined by a predetermined angle θ with respect to one sound absorbing member. Even in such a case, the fact that the other sound absorbing member faces one sound absorbing member means that, in a case where a center line is drawn between the sound absorbing members, a line perpendicular to the center line from the end portion of the one sound absorbing member is in contact with the other sound absorbing member and a line perpendicular to the center line from the end portion of the other sound absorbing member is in contact with the one sound absorbing member.

Therefore, in the present invention, the average distance between the sound absorbing members is defined as follows.

In the present invention, first, a mirror image plane relevant to sound absorbing members of two soundproof units completely facing each other after the translating operation for making the two soundproof units face each other is determined. Assuming that the lengths of perpendiculars from the two sound absorbing members in the case of drawing a line perpendicular to the mirror image plane from each sound absorbing member are defined as da and db, the average value of the distance (the sum of the lengths of the perpendiculars da+db) between the two sound absorbing members on the entire surface of the sound absorbing member is defined as "average distance between the sound absorbing members".

Figure 5A:
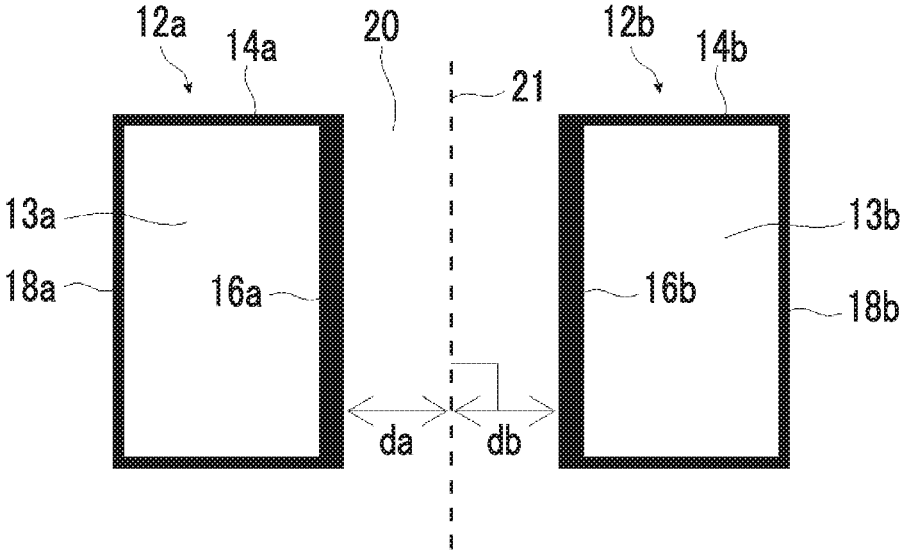
FIG. 5A is a schematic cross-sectional view of an example of a soundproof structure according to another embodiment of the present invention.

Therefore, first, as shown in FIG. 5A, in a case where the two soundproof units 12*a* and 12*b* are neither rotated nor translated, the average distance between the sound absorbing members match the distance between the sound absorbing members 16*a* and 16*b* of the two soundproof units 12*a* and 12*b* (the sum of the lengths da and db of the perpendiculars from the surfaces of the sound absorbing members 16*a* and 16*b* to a mirror image plane 21=da+db=2da=2db).

Figure 5B:
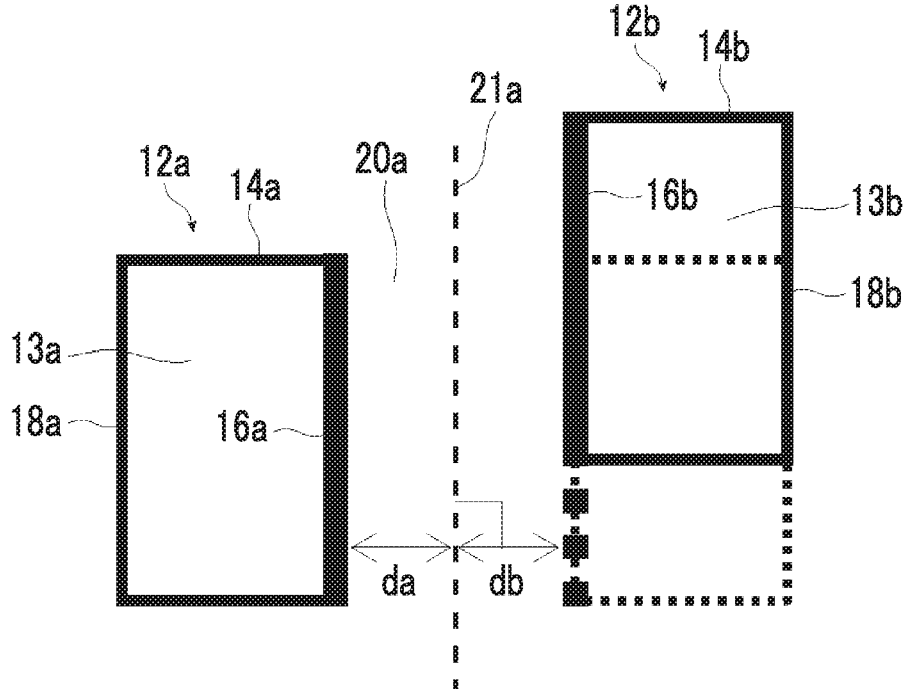
FIG. 5B is a schematic cross-sectional view of an example of a soundproof structure according to another embodiment of the present invention.

Then, as shown in FIG. 5B, in a case where one of the two soundproof units 12*a* and 12*b* is translating, an arrangement in which the translated portion is returned to the original position is assumed as indicated by a dotted line in the diagram, and the average distance between the sound absorbing members is defined by the lengths da and db of the perpendiculars to a mirror image plane 21*a* in that case.

Figure 5C:
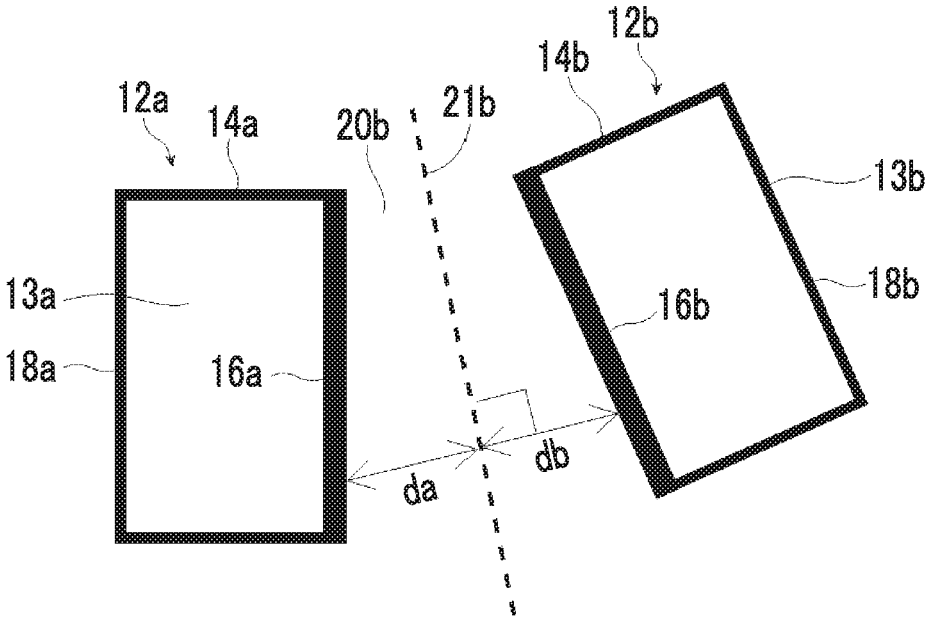
FIG. 5C is a schematic cross-sectional view of an example of a soundproof structure according to another embodiment of the present invention.

Then, as shown in FIG. 5C, in a case where one of the two soundproof units 12*a* and 12*b* is rotating, a mirror image plane 21*b* relevant to the sound absorbing members 16*a* and 16*b* is not parallel to the sound absorbing member surfaces, but the average distance between the sound absorbing members is defined by the lengths da and db of the perpendiculars to a mirror image plane 21*b*.

In any of the above cases, by taking the average distance on the entire surface of the sound absorbing member, the "average distance between sound absorbing members" can be defined, for example, even in a case where the sound absorbing members 16*a* and 16*b* of the two soundproof units 12*a* and 12*b* have different sizes.

That is, assuming that the average distance of a perpendicular from the sound absorbing member 16*a* of the soundproof unit 12*a* to the mirror image plane (21, 21*a*, 21*b*) is D_A and the average distance of a perpendicular from the sound absorbing member 16*b* of the soundproof unit 12*b* to the mirror image plane (21, 21*a*, 21*b*) is D_B, the "average distance between sound absorbing members" can be defined as the sum (=D_A+D_B) of D_A and D_B.

Even in a case where one of the two soundproof units is rotating and translating, it is possible to define "average distance between sound absorbing members" by returning the translation component and then determining the mirror image plane of the rotation.

In the soundproof units 12*a* and 12*b* of the soundproof structures 10, 10*a*, and 10*b* shown in FIGS. 1, 4, and 5, each of the thicknesses of the frames 14*a* and 14*b* is fixed on all sides, and the sound absorbing members 16*a* and 16*b* are attached to the frames 14*a* and 14*b* so as to be perpendicular to the thickness direction thereof. However, the present invention is not limited thereto. For example, as in a soundproof structure 10 *c* shown in FIG. 6, one opening portion 13*c*1 of a frame 14*c* and one opening portion 13*d*1 of a frame 14*d* may be inclined by a predetermined angle θ 1 with respect to a direction perpendicular to the thickness direction of each frame, sound absorbing members 16*c* and 16*d* may be attached to the inclined opening portion 13*c*1 and 13*d*1, respectively, and trapezoidal soundproof units 12*c* and 12*d* may be disposed such that the sound absorbing members 16*c* and 16*d* face each other in parallel. In the soundproof units 12*c* and 12*d*, a slit 20*c* is formed between the sound absorbing members 16*c* and 16*d*. Similarly to the soundproof structure 10 shown in FIG. 1, the other opening portions 13*c*2 and 13*d*2 of the frames 14*c* and 14*d* are formed perpendicular to the thickness direction of the frame, and rear plates 18*c* and 18*d* are fixed to the frame 14 so as to cover the opening portions 13*c*2 and 13*d*2, respectively.

By arranging the sound absorbing members 16*c* and 16*d* so as to be inclined in this manner, it is possible to increase the sizes (areas) of the sound absorbing members 16*c* and 16*d*. As a result, since the absorption peak frequency can be lowered, it is possible to lower the absorption peak frequency with a small and compact soundproof structure without increasing the size of the soundproof structure.

Also in this case, the other sound absorbing member 16*d* may be shifted by a predetermined shift amount with respect to one sound absorbing member 16*c*, and may be inclined by a predetermined angle from parallel.

In the soundproof structure 10 shown in FIG. 1, the slit 20 between the sound absorbing members 16*a* and 16*b* of the soundproof units 12*a* and 12*b* are opened in all directions except for the surfaces of the sound absorbing members 16*a* and 16*b*. However, the present invention is not limited thereto.

Figure 7:
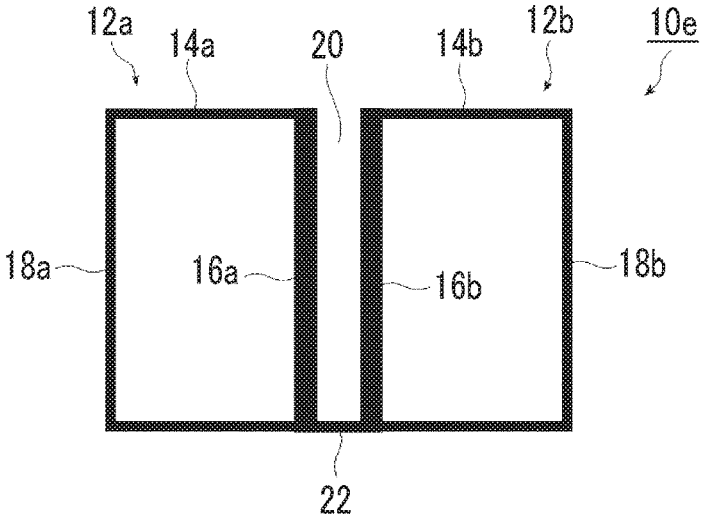
FIG. 7 is a schematic cross-sectional view of an example of a soundproof structure according to another embodiment of the present invention.

As in a soundproof structure 10*e* shown in FIG. 7, it is also preferable that at least parts of side surfaces of surfaces of the sound absorbing members 16*a* and 16*b* facing each other, for example, a side surface on the lower side in the diagram of the slit 20 formed between the sound absorbing members 16*a* and 16*b* is blocked by a plate 22.

Figure 8:
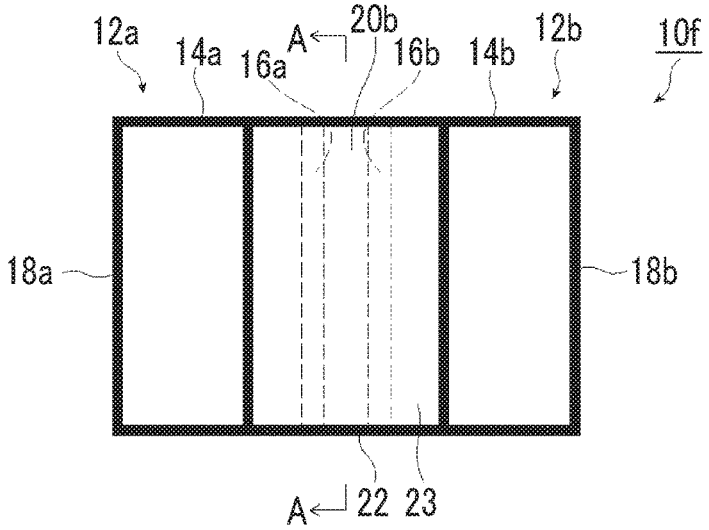
FIG. 8 is a schematic cross-sectional view of an example of a soundproof structure according to another embodiment of the present invention.
Figure 8A:
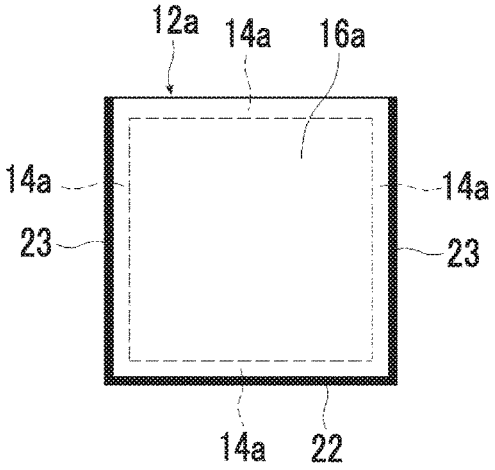
FIG. 8A is a schematic cross-sectional view of an example of a soundproof structure according to another embodiment of the present invention.

As in a soundproof structure 10*f* shown in FIGS. 8 and 8A, it is preferable that a side surface in the incidence direction (for example, a lower side in the diagram except for the upper side in the diagram) of sound to the slit 20 formed between the sound absorbing members 16*a* and 16*b* is blocked by the plate 22 and both the side surfaces in the front and rear direction in the diagram are blocked by the plate 23 (that is, by surfaces in three directions). The plates 22 and 23 can be manufactured using the same material as the rear plate 18.

By blocking the surfaces of the slit 20 except in the sound incidence direction, the sound pressure increases in the slit 20. Therefore, since the state changes, a low frequency shift can be caused.

In the present invention, as in the soundproof structures 10 and 10*a* to 10*f* of the illustrated example, it is preferable that the soundproof unit 12 (12*a* and 12*b*) is closed by the frame 14 (14*a* and 14*b*) and the rear plate 18 (18*a* and 18*b*) except for a surface to which the sound absorbing member 16 (16*a* and 16*b*) is attached. The present invention is not limited thereto.

Figure 9:
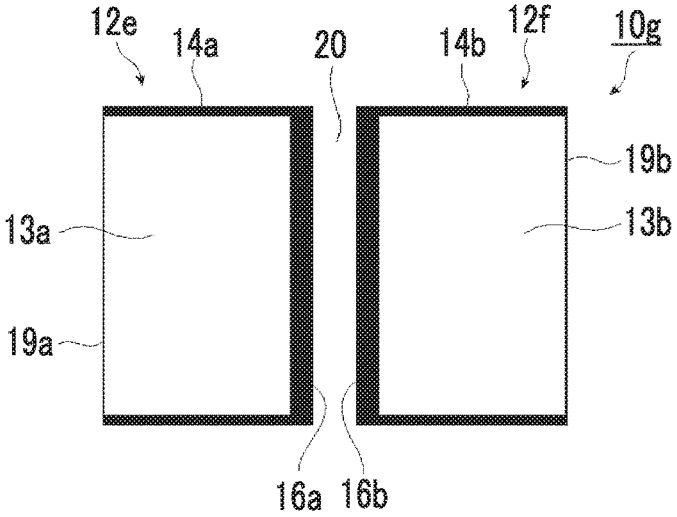
FIG. 9 is a schematic cross-sectional view of an example of a soundproof structure according to another embodiment of the present invention.

As shown in a soundproof structure 10*g* shown in FIG. 9, in soundproof units 12*e* and 12*f*, it is preferable that at least parts of facing surfaces (the other end surfaces of opening portions 13*a* and 13*b*) 19*a* and 19*b* facing surfaces (one end surface of the opening portion 13*a* and one end surface of the opening portion 13*b*) to which the sound absorbing members 16*a* and 16*b* are attached, in the illustrated example, the entire parts are opened. In the soundproof structure 10*g*, the entire facing surfaces 19*a* and 19*b* are opened. Accordingly, the structure can be simplified.

Figure 10:
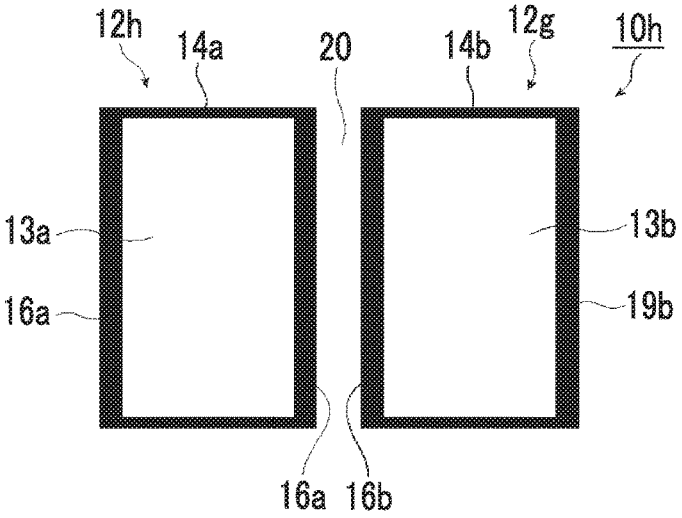
FIG. 10 is a schematic cross-sectional view of an example of a soundproof structure according to another embodiment of the present invention.

As shown in a soundproof structure 10*h* shown in FIG. 10, in soundproof units 12*g* and 12*h*, it is preferable that the sound absorbing members 16*a* and 16*b* are attached to surfaces facing the surfaces to which the sound absorbing members 16*a* and 16*b* are attached. Even with the soundproof structure 10*h*, the same effect as in the soundproof structure 10 shown in FIG. 1 can be obtained.

In the soundproof structures 10 and 10*a* to 10*h* of the illustrated example, the two soundproof units 12 (12*a* and 12*b*, 12*c* and 12*d*, 12*e* and 12*f*, and 12*g* and 12*h*) are the same. However, the present invention is not limited thereto, and one soundproof unit 12 and the other soundproof unit 12 may be different soundproof units.

Here, the case where the two adjacent soundproof units 12 are different may be a case where the shapes or structures of the two soundproof units 12 are different, or may be a case where soundproof cells used as the two soundproof units 12 are different. Here, the case where the shapes or structures of the two soundproof units 12 are different is, for example, a case where the frames 14 of the two soundproof units 12 are different or a case where the two sound absorbing members 16 disposed so as to face each other are different. Here, the case where soundproof cells used as the two soundproof units 12 are different is, for example, a case where the frames 14 of the two soundproof units 12 are different or a case where the two sound absorbing members 16 disposed so as to face each other are different. The case where the soundproof cells are different will be described later.

In the soundproof structures 10 and 10*a* to 10*h* of the illustrated example, the two soundproof units 12 facing each other, that is, adjacent to each other so as to face each other are provided. However, the present invention is not limited thereto. In the present invention, as long as the two adjacent soundproof units 12 are included, three or more soundproof units 12 may be included.

Figure 11:
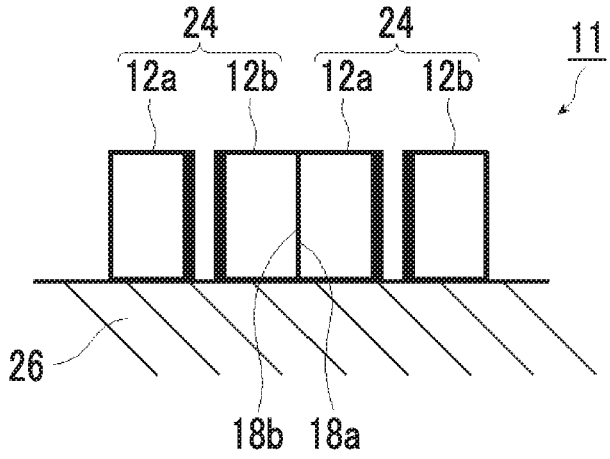
FIG. 11 is a schematic cross-sectional view of an example of a soundproof structure according to another embodiment of the present invention.

For example, as in a soundproof structure 11 shown in FIG. 11, the two soundproof units 12*a* and 12*b* of the soundproof structure 10 shown in FIG. 1 may be disposed as one soundproof unit set 24 on a wall 26 of the structure. In the example shown in FIG. 11, with a soundproof unit pair of the two soundproof units 12*a* and 12*b* as one soundproof unit set 24, two soundproof unit sets 24 are disposed on the wall 26 so that a rear plate 18*b* of the soundproof unit 12*b* of the first soundproof unit set 24 and a rear plate 18*a* of the soundproof unit 12*a* of the second soundproof unit set 24 are brought into contact with each other to be integrated. However, the present invention is not limited thereto. For example, two or more soundproof units may be set as one soundproof unit set, or three or more soundproof unit sets may be disposed on the wall. In addition, the rear plates of adjacent soundproof unit sets may be spaced apart from each other, or may be completely integrated to form one rear plate.

Figure 12:
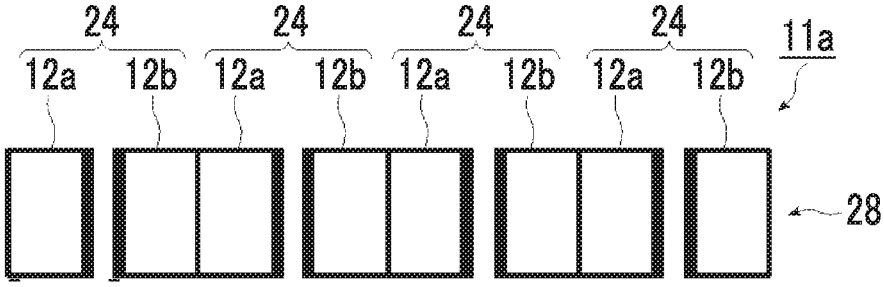
FIG. 12 is a schematic cross-sectional view of an example of a soundproof structure according to another embodiment of the present invention.

In addition, as in a soundproof structure 11*a* shown in FIG. 12, it is preferable that, with the two soundproof units 12*a* and 12*b* of the soundproof structure 10 shown in FIG. 1 as one soundproof unit set 24, a plurality of soundproof unit sets 24 (in the illustrated example, four soundproof unit sets 24) are combined to function as a soundproof wall 28.

Figure 13:
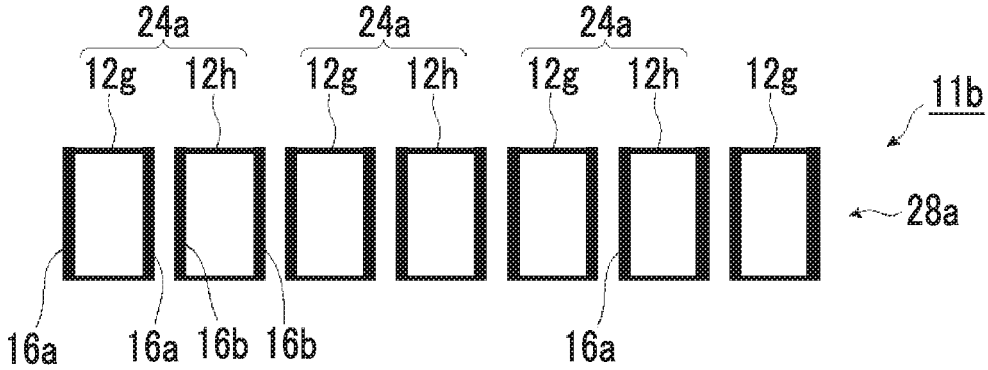
FIG. 13 is a schematic cross-sectional view of an example of a soundproof structure according to another embodiment of the present invention.

In addition, as in a soundproof structure 11*b* shown in FIG. 13, it is preferable that, with the two soundproof units 12*g* and 12*h* of the soundproof structure 10 shown in FIG. 10 as one soundproof unit set 24*a*, a plurality of soundproof unit sets 24*a* (in the illustrated example, three soundproof unit sets 24*a*) are combined to function as a soundproof wall 28*a*. In this case, since each of the two soundproof units 12*g* and 12*h* comprises the sound absorbing member 16 in the opening portions 13 on both surfaces of the frame 14, it is preferable that the soundproof units 12*h* and 12*g* of adjacent soundproof unit sets are disposed spaced apart from each other. All of the soundproof units 12 functioning as the soundproof walls 28*a* do not need to be used as the soundproof unit set 24*a*, and one soundproof unit 12*g* or 12*h* may be used.

Here, in the soundproof structures 11, 11*a*, and 11*b* shown in FIGS. 11 to 13, it is preferable to arrange the soundproof unit sets 24 and 24*a* periodically. In addition, it is preferable to form a soundproof structure by arranging a plurality of units with the soundproof unit sets 24 and 24*a* as a unit.

In the soundproof structures 11 and 11*a* shown in FIGS. 11 and 12, one soundproof unit set 24 is not limited to the two soundproof units 12*a* and 12*b* of the soundproof structure 10 shown in FIG. 1, and may be the two soundproof units 12*a* and 12*b*, 12*c* and 12*d*, 12*e* and 12*f*, or 12*g* and 12*h* of the soundproof structures 10*a* to 10*f* shown in FIGS. 4 to 10. In the case of using the two soundproof units 12*e* and 12*f* shown in FIG. 9, the opening portions on the back surfaces may be connected to each other. In the case of using the two soundproof units 12*g* and 12*h* shown in FIG. 10, it is preferable that the soundproof units 12*h* and 12*g* of adjacent soundproof unit sets are disposed spaced apart from each other as in the soundproof structure 11*b* shown in FIG. 13.

In the following description, the two soundproof units 12*a* and 12*b* of the soundproof structure 10 shown in FIG. 1 will be described as representative examples. However, it is needless to say that the two soundproof units 12*a* and 12*b*, 12*c* and 12*d*, 12*e* and 12*f*, or 12*g* and 12*h* of the soundproof structures 10*a* to 10*f* shown in FIGS. 4 to 10 may be used in the same manner as described above.

Figure 14:
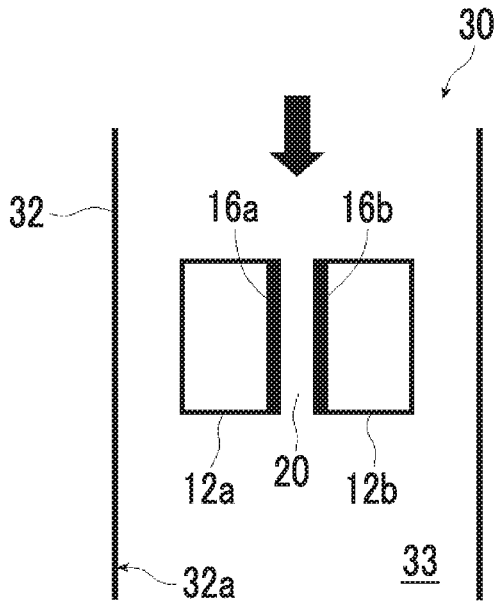
FIG. 14 is a schematic cross-sectional view of an example of a soundproof structure according to another embodiment of the present invention.

In addition, as in a soundproof structure 30 shown in FIG. 14, the two soundproof units 12*a* and 12*b* of the soundproof structure 10 shown in FIG. 1 may be disposed in a tubular member 32. The arrow indicates the incidence direction of sound. In this case, in the two soundproof units 12*a* and 12*b*, it is preferable that the slit 20 between the sound absorbing members 16*a* and 16*b* is disposed along the longitudinal direction of the tubular member 32 (that is, sound incidence direction) (preferably, in parallel to the incidence direction of sound).

Figure 15:
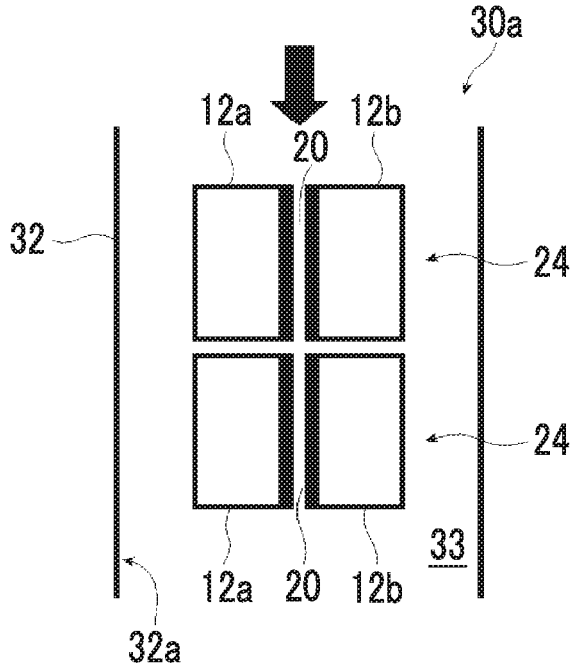
FIG. 15 is a schematic cross-sectional view of an example of a soundproof structure according to another embodiment of the present invention.

In addition, as in a soundproof structure 30*a* shown in FIG. 15, it is preferable that a plurality of soundproof unit sets 24 (in the illustrated example, two soundproof unit sets 24), each of which is configured to include the two soundproof units 12*a* and 12*b* of the soundproof structure 10 shown in FIG. 1, are disposed in the tubular member 32 along the longitudinal direction. Also in this case, in the soundproof unit set 24, it is preferable that the slit 20 is disposed along the longitudinal direction of the tubular member 32 (that is, sound incidence direction indicated by the arrow) (preferably, in parallel to the incidence direction of sound). By increasing the number of soundproof unit sets 24, it is possible to increase the peak value of the absorbance at the absorption peak frequency.

Figure 16:
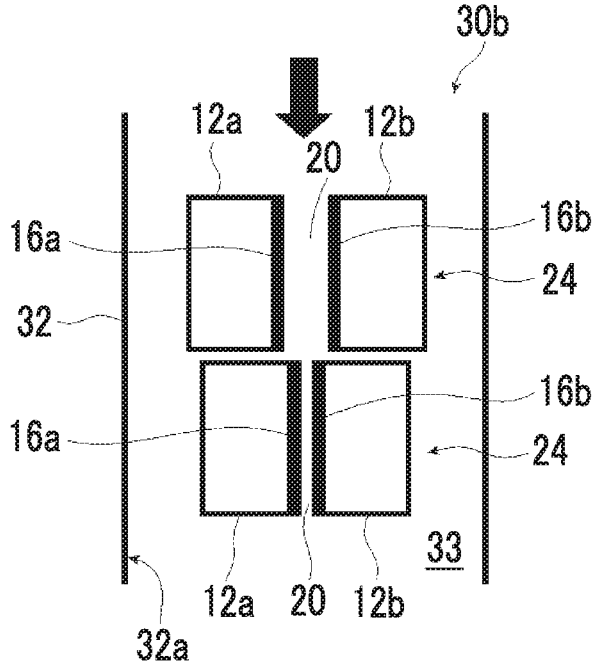
FIG. 16 is a schematic cross-sectional view of an example of a soundproof structure according to another embodiment of the present invention.

As in a soundproof structure 30*b* shown in FIG. 16, a plurality of soundproof unit sets 24 (in the illustrated example, two soundproof unit sets 24), each of which is configured to include the two soundproof units 12*a* and 12*b* of the soundproof structure 10 shown in FIG. 1, may be disposed in the tubular member 32 along the longitudinal direction, and the distance (that is, the width of the slit 20) between the sound absorbing members 16*a* and 16*b* of the two soundproof units 12*a* and 12*b* of one of the soundproof unit sets 24 may be different from that of the other soundproof unit set 24. Also in this case, the slits 20 of the two soundproof unit sets 24 have different widths, but extend along the longitudinal direction of the tubular member 32 (sound incidence direction indicated by the arrow), preferably, in parallel to the incidence direction of sound. Since the widths of the slits 20 of the soundproof unit sets 24 are different, the absorption peak frequencies of the soundproof unit sets 24 are slightly different. As a result, there are a plurality of (for example, two) absorption peak frequencies, and the absorption band can be widened at the low frequency side.

Figure 17:
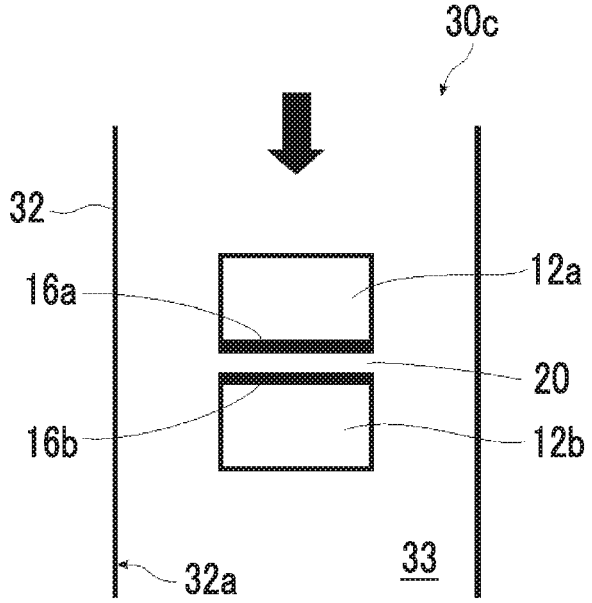
FIG. 17 is a schematic cross-sectional view of an example of a soundproof structure according to another embodiment of the present invention.

In addition, as in a soundproof structure 30*c* shown in FIG. 17, the two soundproof units 12*a* and 12*b* of the soundproof structure 10 shown in FIG. 1 may be disposed in the tubular member 32 such that the slit 20 between the sound absorbing members 16*a* and 16*b* is in a direction (that is, a radial direction) perpendicular to the longitudinal direction (sound incidence direction indicated by the arrow) of the tubular member 32.

As in the soundproof structure 30*c* shown in FIG. 17, even in a case where the arrangement of the two soundproof units 12*a* and 12*b* is changed by 90° with respect to the soundproof structure 30 shown in FIG. 14, the absorption peak frequency hardly changes regardless of the arrangement method. Therefore, there is robustness with regard to the direction of the soundproof unit.

Figure 18:
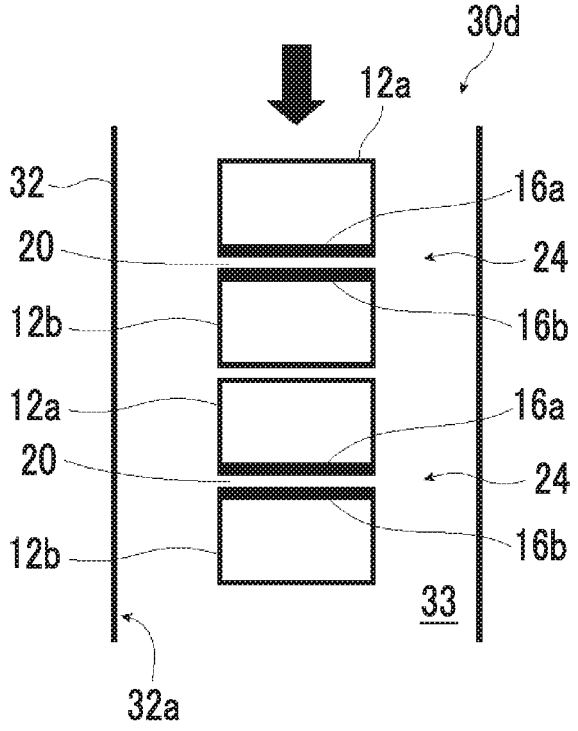
FIG. 18 is a schematic cross-sectional view of an example of a soundproof structure according to another embodiment of the present invention.

In addition, as in a soundproof structure 30*d* shown in FIG. 18, a plurality of soundproof unit sets 24 (in the illustrated example, two soundproof unit sets 24), each of which is configured to include the two soundproof units 12*a* and 12*b* of the soundproof structure 10 shown in FIG. 1, may be disposed in the tubular member 32 side by side along the longitudinal direction such that the slit 20 between the sound absorbing members 16*a* and 16*b* is in a direction (that is, a radial direction) perpendicular to the longitudinal direction (sound incidence direction indicated by the arrow) of the tubular member 32.

Also in this case, by increasing the number of soundproof unit sets 24, it is possible to increase the peak value of the absorbance at the absorption peak frequency.

In the soundproof structures 30 and 30*a* to 30*d* shown in FIGS. 14 to 18, it is preferable that the soundproof unit set 24 configured to include the two soundproof units 12*a* and 12*b* is disposed approximately at the center of an inner hole portion 33 of the tubular member 32 and a space between the inner wall surface (that is, an inner wall surface 32*a*) of the tubular member 32 and the soundproof units 12*a* and 12*b* is opened along the longitudinal direction (sound incidence direction indicated by the arrow).

Figure 19:
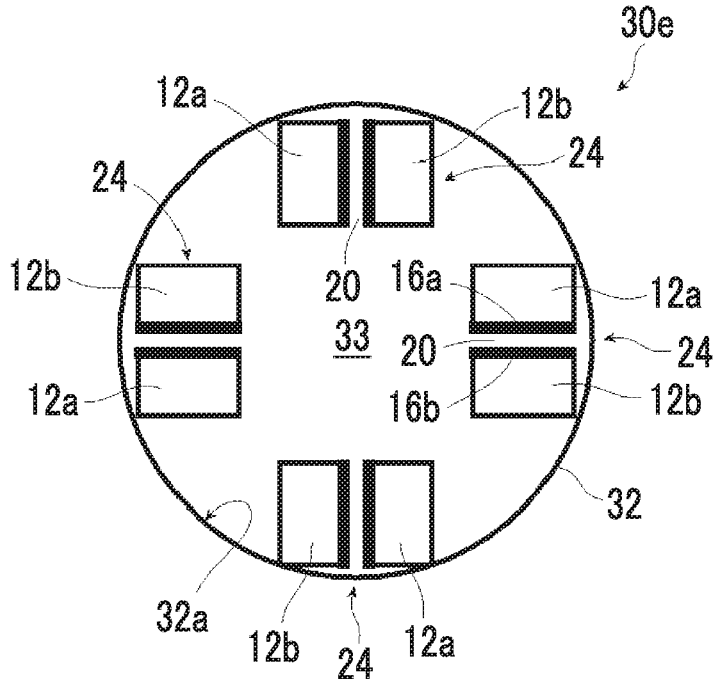
FIG. 19 is a schematic cross-sectional view of an example of a soundproof structure according to another embodiment of the present invention.

In addition, as in a soundproof structure 30*e* shown in FIG. 19, a plurality of soundproof unit sets 24 (in the illustrated example, four soundproof unit sets 24), each of which is configured to include the two soundproof units 12*a* and 12*b* of the soundproof structure 10 shown in FIG. 1, may be disposed in the tubular member 32 along the inner wall surface 32*a*. In this case, all of the two soundproof units 12*a* and 12*b* of each soundproof unit set 24 are disposed along the wall, and the slit 20 between the sound absorbing members 16*a* and 16*b* is disposed along the longitudinal direction of the tubular member 32 (that is, sound incidence direction) (preferably, in parallel to the incidence direction of sound) so as to be directed toward the center of the hole portion 33 of the tubular member 32.

Figure 20:
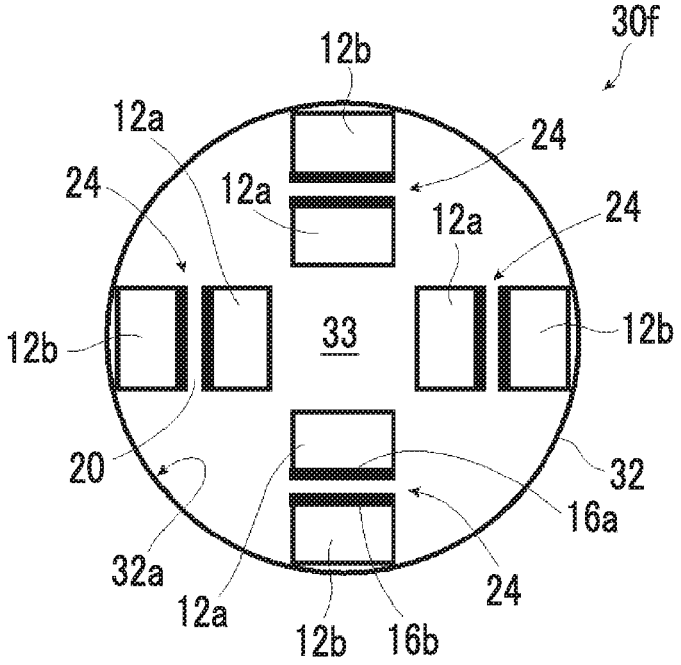
FIG. 20 is a schematic cross-sectional view of an example of a soundproof structure according to another embodiment of the present invention.

In addition, as in a soundproof structure 30*f* shown in FIG. 20, a plurality of soundproof unit sets 24 (in the illustrated example, four soundproof unit sets 24), each of which is configured to include the two soundproof units 12*a* and 12*b* of the soundproof structure 10 shown in FIG. 1, may be disposed in the tubular member 32 along the inner wall surface 32*a*. In this case, one (in the illustrated example, the soundproof unit 12*b*) of the two soundproof units 12*a* and 12*b* of each soundproof unit set 24 is disposed along the wall, and the slit 20 between the sound absorbing members 16*a* and 16*b* is disposed along the longitudinal direction of the tubular member 32 (that is, sound incidence direction) (preferably, in parallel to the incidence direction of sound) so as to be directed in the circumferential direction of the hole portion 33 of the tubular member 32.

In the soundproof structures 30*e* and 30*f* shown in FIGS. 19 and 20, a central portion of the hole portion 33 of the tubular member 32 and a space between the adjacent soundproof unit sets 24 are opened along the longitudinal direction (sound incidence direction indicated by the arrow).

Next, the configuration of a soundproof cell used as the soundproof unit 12 in the present invention will be described.

(Vibration Film Type Soundproof Cell)

First, a vibration film type soundproof cell that is a resonance type soundproof cell having a closed space volume on the rear surface of the film will be described.

Figure 21:
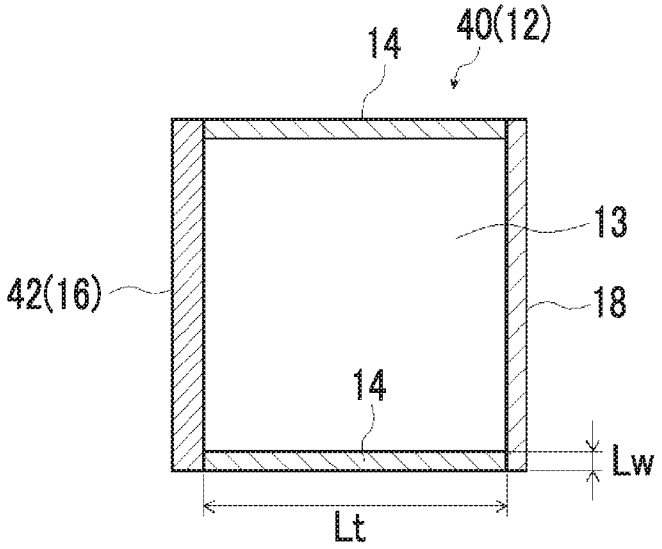
FIG. 21 is a schematic cross-sectional view of an example of a vibration film type sound absorbing body used as a soundproof unit of the soundproof structure shown in FIG. 1.

A soundproof cell 40 shown in FIG. 21 is a vibration film type soundproof cell that absorbs sound by causing a sound absorbing action by film vibration with the closed space volume (cavity) on the rear surface of the film as a rear air layer, and is used as the soundproof unit 12 (12*a* and 12*b*) of the soundproof structure 10 shown in FIG. 1.

The soundproof cell 40 has the frame 14 having the opening portion 13, the film 42 that is attached to one side of the opening portion 13 of the frame 14 and functions as the sound absorbing member 16, and the rear plate 18 attached to the other side of the opening portion 13 of the frame 14.

Since the frame 14 is formed so as to annularly surround a frame member that is a thick plate-shaped member, has the opening portion 13 thereinside, and fixes the film 42 so as to cover the opening portion 13 on at least one side, the frame 14 serves as a node of film vibration of the film 42 fixed to the frame 14. Therefore, the frame 14 has higher stiffness than the film 42. Specifically, both the mass and the stiffness of the frame 14 per unit area need to be high.

It is preferable that the shape of the frame 14 has a closed continuous shape capable of fixing the film 42 so as to restrain the entire outer periphery of the film 42. However, the present invention is not limited thereto. The frame 14 may be made to have a discontinuous shape by cutting a part thereof as long as the frame 14 serves as a node of film vibration of the film 42 fixed to the frame 14. That is, since the role of the frame 14 is to fix the film 42 to control the film vibration, it is sufficient that the film 42 can vibrate. Therefore, even in a case where there is a cut in the frame 14 or there is an unbonded part, the effect is achieved.

The shape of the opening portion 13 formed by the frame 14 is a planar shape. In the example shown in FIGS. 2 and 3, the shape of the opening portion 13 formed by the frame 14 is a square. In the present invention, however, the shape of the opening portion 13 formed by the frame 14 is not particularly limited. For example, the shape of the opening portion 13 formed by the frame 14 may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. End portions of the frame 14 on both sides of the opening portion 13 are not closed and but are open to the outside as they are. The film 42 is fixed to the frame 14 so as to cover the opening portion 13 in at least one opened end portion of the opening portion 13.

The size of the frame 14 is a size in plan view, and can be defined as the size of the opening portion 13. However, in the case of a regular polygon such as a square shown in FIGS. 2 and 3 or a circle, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

In the soundproof cell 40 according to the embodiment of the present invention, the size of the frame 14 may be fixed for all frames 14. However, frames having different sizes (including a case where shapes are different) may be included. In this case, the average size of the frames 14 may be used as the size of the frame 14.

The size of such the frame 14 is not particularly limited. The size of the frame 14 may be set according to a soundproofing target to which the soundproof structures 10, 10*a* to 10*h*, 11, 11*a*, 11*b*, and 30*a* to 30*f* (hereinafter, represented by the soundproof structure 10) according to the embodiment of the present invention are applied for soundproofing, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier.

The soundproof structure 10 itself can also be used like a partition in order to shield sound from a plurality of noise sources. Also in this case, the size of the frame 14 can be selected from the frequency of the target noise.

In addition, in order to prevent sound leakage due to diffraction at the absorption peak of the soundproof unit 12 (soundproof cell 40), it is preferable that the average size of the frame 14 is equal to or less than the wavelength size corresponding to the absorption peak frequency.

For example, the size of the frame 14 is preferably 0.5 mm to 200 mm, more preferably 1 mm to 100 mm, and most preferably 2 mm to 30 mm.

In addition, the width (frame width) and the thickness of the frame 14 are not particularly limited as long as the film 42 can be fixed so as to be reliably restrained and accordingly the film 42 can be reliably supported. For example, the width (frame width) and the thickness of the frame 14 can be set according to the size of the frame 14. The thickness of the frame 14 can also be referred to as a frame thickness. As shown in FIGS. 1 and 21, in the soundproof unit 12 (for example, the soundproof cell 40), the thickness of the frame 14 can be defined as a length Lt of a constituent member of the frame 14 interposed between a sound absorbing member 16 (for example, the film 42) and the rear plate 18. In addition, the width of the frame 14 can also be referred to as a frame width. As shown in FIGS. 1 to 3 and 21, the soundproof unit 12 (for example, the soundproof cell 40) can be defined as a plate thickness Lw of a constituent member of the frame 14.

For example, in a case where the size of the frame 14 is 0.5 mm to 50 mm, the width of the frame 14 is preferably 0.5 mm to 20 mm, more preferably 0.7 mm to 10 mm, and most preferably 1 mm to 5 mm.

In a case where the ratio of the width of the frame 14 to the size of the frame 14 is too large, the area ratio of the portion of the frame 14 with respect to the entire structure increases. Accordingly, there is a concern that the soundproof structure 10 as a device will become heavy. On the other hand, in a case where the ratio is too small, it is difficult to strongly fix the film with an adhesive or the like in the frame 14 portion.

In a case where the size of the frame 14 exceeds 50 mm and is equal to or less than 200 mm, the width of the frame 14 is preferably 1 mm to 100 mm, more preferably 3 mm to 50 mm, and most preferably 5 mm to 20 mm.

In addition, the thickness of the frame 14 is preferably 0.5 mm to 200 mm, more preferably 0.7 mm to 100 mm, and most preferably 1 mm to 50 mm.

It is preferable that the width and the thickness of the frame 14 are expressed by an average width and an average thickness, respectively, for example, in a case where different widths and thicknesses are included in each frame 14.

The material of the frame 14 is not particularly limited as long as the material can support the film 42, has a suitable strength in the case of being applied to the above soundproofing target, and is resistant to the soundproof environment of the soundproofing target, and can be selected according to the soundproofing target and the soundproof environment. Examples of the material of the frame 14 include a metal material, a resin material, a reinforced plastic material, and a carbon fiber. Examples of the metal material include aluminum, titanium, magnesium, tungsten, iron, steel, chromium, chromium molybdenum, nichrome molybdenum, and alloys thereof. Examples of the resin material include acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose. Examples of the reinforced plastic material include carbon fiber reinforced plastics (CFRP) and glass fiber reinforced plastics (GFRP).

A plurality of materials of the frame 14 may be used in combination.

The film 42 is used as the sound absorbing member 16 of the soundproof unit 12 of the soundproof structure 10 shown in FIG. 1 in the soundproof cell 40. The film 42 is fixed so as to be restrained by the frame 14 so that the opening portion 13 inside the frame 14 is covered, and the film 42 absorbs or reflects the energy of sound waves to insulate sound by performing vibration corresponding to the sound waves from the outside. For this reason, it is preferable that the film 42 is impermeable to air.

Incidentally, since the film 42 needs to vibrate with the frame 14 as a node, it is necessary that the film 42 is fixed to the frame 14 so as to be reliably restrained by the frame 14 and accordingly becomes an antinode of film vibration, thereby absorbing or reflecting the energy of sound waves to insulate sound. Therefore, it is preferable that the film 42 is formed of a flexible elastic material.

Therefore, the shape of the film 42 is the shape of the opening portion 13 of the frame 14. In addition, the size of the film 42 is the size of the frame 14. More specifically, the size of the film 42 can be said to be the size of the opening portion 13 of the frame 14.

Here, the thickness of the film 42 is not particularly limited as long as the film 42 can vibrate by absorbing or reflecting the energy of sound waves to insulate sound. However, it is preferable to make the film 42 thin in order to obtain sound absorption on the low frequency side. In the present invention, for example, the thickness of the film 42 can be set according to the size of the frame 14, that is, the size of the film.

For example, in a case where the size of the frame 14 is 0.5 mm to 50 mm, the thickness of the film 42 is preferably 0.005 mm (5 μm) to 5 mm, more preferably 0.007 mm (7 μm) to 2 mm, and most preferably 0.01 mm (10 μm) to 1 mm.

In a case where the size of the frame 14 exceeds 50 mm and is equal to or less than 200 mm, the thickness of the film 42 is preferably 0.01 mm (10 μm) to 20 mm, more preferably 0.02 mm (20 μm) to 10 mm, and most preferably 0.05 mm (50 μm) to 5 mm.

It is preferable that the thickness of the film 42 is expressed by an average thickness, for example, in a case where there are different thicknesses in one film 42.

The Young's modulus of the film 42 is not particularly limited as long as the film has elasticity capable of vibrating in order to insulate sound by absorbing or reflecting the energy of sound waves. However, it is preferable to set the Young's modulus of the film 42 to be small in order to obtain sound absorption on the low frequency side. For example, the Young's modulus of the film 42 can be set according to the size of the frame 14, that is, the size of the film 42 in the present invention.

For example, the Young's modulus of the film 42 is preferably 1000 Pa to 3000 GPa, more preferably 10000 Pa to 2000 GPa, and most preferably 1 MPa to 1000 GPa.

The density of the film 42 is not particularly limited as long as the film 42 can vibrate by absorbing or reflecting the energy of sound waves to insulate sound. For example, the density of the film 42 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In a case where a film-shaped material or a foil-shaped material is used as a material of the film 42, the material of the film 42 is not particularly limited as long as the material has a strength in the case of being applied to the above soundproofing target and is resistant to the soundproof environment of the soundproofing target so that the film 42 can vibrate by absorbing or reflecting the energy of sound waves to insulate sound, and can be selected according to the soundproofing target, the soundproof environment, and the like. For example, as materials of the film 42, materials or structures that can form a thin structure, such as resin materials that can be made into a film shape, rubber materials that can be made into a film shape, metal materials that can be made into a foil shape, materials that become fibrous films, nonwoven fabrics, films containing nano-sized fibers, thinly processed porous materials, and carbon materials processed into a thin film structure, can be mentioned. As resin material that can be made into a film shape, for example, polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene can be mentioned. Examples of the rubber material that can be made into a film shape include silicone rubber and natural rubber. As metal materials that can be made into a foil shape, for example, aluminum, chromium, titanium, stainless steel, nickel, tin, niobium, tantalum, molybdenum, zirconium, gold, silver, platinum, palladium, iron, copper, and permalloy can be mentioned. Examples of the material that becomes a fibrous film include paper and cellulose. Examples of the thinly processed porous material include thinly processed urethane and synthrate.

The film 42 may not be a single layer, and a plurality of layers may be laminated. In the film of a plurality of layers, a single type of film may be laminated, or a plurality of types of film may be laminated. In both the case, the film function as the film 42. As the film 42 of a plurality of layers in which a plurality of types of layers are laminated, for example, "Alpet" in which metal aluminum and a PET film are laminated or "Panabur" in which stainless steel (SUS), copper, and a PET film are laminated (both manufactured by Panak Co., Ltd.) can be used.

In the film 42, a weight and/or a metal mesh, and the like may be attached to the film 42 itself. In these cases, the resonance frequency changes from the resonance of the single film to the resonance of the film and the weight and the film and the metal mesh by changing the film vibration.

In addition, the film 42 is fixed to the frame 14 so as to cover an opening end on at least one side of the opening portion 13 of the frame 14. That is, the film 42 may be fixed to the frame 14 so as to cover opening ends on one side, the other side, or both sides of the opening portion 13 of the frame 14.

The method of fixing the film 42 to the frame 14 is not particularly limited. Any method may be used as long as the film 42 can be fixed to the frame 14 so as to serve as a node of film vibration. For example, a method using an adhesive, a method using a physical fixture, and the like can be mentioned.

In the method of using an adhesive, an adhesive is applied onto the surface of the frame 14 surrounding the opening portion 13 and the film 42 is placed thereon, so that the film 42 is fixed to the frame 14 with the adhesive. Examples of the adhesive include epoxy based adhesives (Araldite (registered trademark) (manufactured by Nichiban Co., Ltd.) and the like), cyanoacrylate based adhesives (Aron Alpha (registered trademark) (manufactured by Toagosei Co., Ltd.) and the like), and acrylic based adhesives.

As a method using a physical fixture, a method can be mentioned in which the film 42 disposed so as to cover the opening portion 13 of the frame 14 is interposed between the frame 14 and a fixing member, such as a rod, and the fixing member is fixed to the frame 14 by using a fixture, such as a screw.

The rear plate 18 is a plate-shaped member, which faces the film 42 and is attached to the other end portion of the opening portion 13 of the frame 14, in order to make the space formed on the rear surface of the film 42 by the frame 14 be a closed space. Such a plate-shaped member is not particularly limited as long as a closed space can be formed on the rear surface of the film 42, but it is preferable to use a plate-shaped member formed of a material having higher stiffness than the film 42. For example, as a material of the rear plate 18, it is possible to use the same material as the material of the frame 14 described above. The method of fixing the rear plate 18 to the frame 14 is not particularly limited as long as a closed space can be formed on the rear surface of the film 42, and a method similar to the above-described method of fixing the film 42 to the frame 14 may be used.

Since the rear plate 18 is a plate-shaped member for making the space formed on the rear surface of the film 42 by the frame 14 be a closed space, the rear plate 18 may be integrated with the frame 14 or may be integrally formed with the same material.

In addition, since the present embodiment is a soundproof cell based on film vibration and Helmholtz resonance having a closed space volume on the rear surface of the film 42, it is preferable to provide the rear plate 18. However, even in a case where there is no closed space volume on the rear surface of the film 42, the rear plate 18 may not be provided as long as it is possible to absorb sound by film vibration.

Although the space behind the film 42 of the soundproof cell 40 shown in FIG. 21 is a completely closed space, the present invention is not limited thereto. As long as it is possible to absorb sound by film vibration, the film 42 may have a through-hole, and at least a part of the film may be opened.

Figure 22:
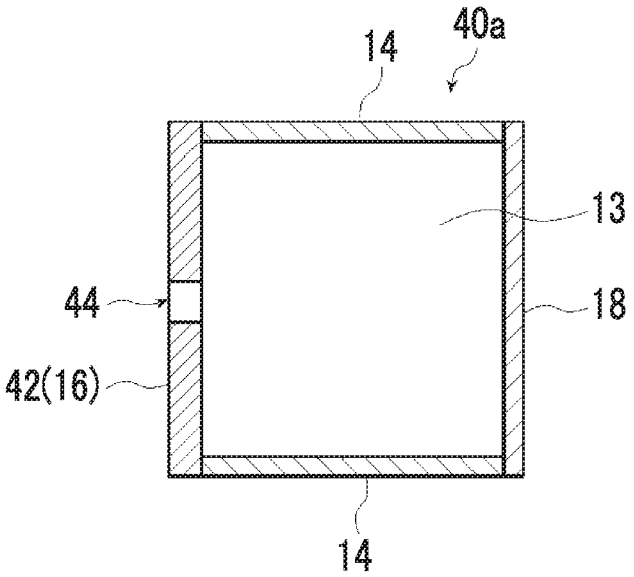
FIG. 22 is a schematic cross-sectional view of another example of a vibration film type sound absorbing body used in the soundproof structure of the present invention.
Figure 23:
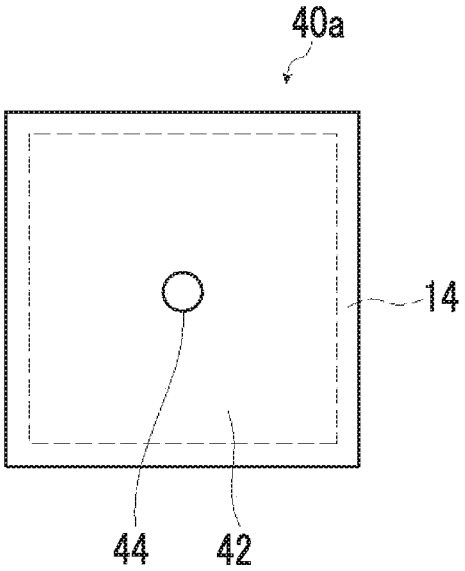
FIG. 23 is a schematic plan view of the vibration film type sound absorbing body shown in FIG. 22.

That is, as in a soundproof cell 40*a* shown in FIGS. 22 and 23, a through-hole (first through-hole) 44 may be provided in the film 42 of the soundproof cell 40*a*. Such a soundproof cell 40*a* performs a sound absorbing action by film vibration and a sound absorbing action by Helmholtz resonance to be described later.

Here, as shown in FIG. 23, one or two or more through-holes 44 may be perforated in the film 42 that covers the opening portion 13 of the frame 14. As shown in FIG. 22, the perforation position of the through-hole 44 may be the middle of the film 42. However, the present invention is not limited thereto, and the perforation position of the through-hole 44 does not need to be the middle of the film 42, and the through-hole 44 may be perforated at any position.

That is, the sound absorbing characteristics of the soundproof cell 40*a* are not changed simply by changing the perforation position of the through-hole 44.

However, in a case where the soundproof cell 40*a* absorbs sound using film vibration, it is preferable that the through-hole 44 is perforated in a region within a range away from the fixed end of the peripheral portion of the opening portion 13 of the frame 14 more than 20% of the size of the surface of the film 42. Most preferably, the through-hole 44 is provided at the center of the film 42.

The number of through-holes 44 in the film 42 may be one. However, the present invention is not limited thereto, and two or more (that is, a plurality of) through-holes 44 may be provided.

Here, in the soundproof cell 40*a*, in a case where the other end portion of the opening portion 13 of the frame 14 is opened without providing a rear plate, it is preferable that the through-hole 44 is configured by one through-hole 44 from the viewpoint of air permeability. The reason is that, in the case of a fixed opening ratio, the easiness of passage of air as wind is large in a case where one hole is large and the viscosity at the boundary does not work greatly.

On the other hand, in a case where a plurality of through-holes 44 are present in the film 42, the sound absorbing characteristics of the soundproof cell 40*a* show sound absorbing characteristics corresponding to the total area of the plurality of through-holes 44. Therefore, in a case where the total area of a plurality of through-holes 44 in the film 42 is equal to the area of the through-hole 44 that is solely provided in the film 42 (that is, in a case where the opening ratio of the through-hole 44 in the film 42 (the total area ratio of all the through-holes 44 with respect to the area of the film 42 covering the opening portion 13 (the ratio of the total area of all the through-holes 44)) is the same), the same sound absorption effect is obtained with the single through-hole 44 and the plurality of through-holes 44. Therefore, even in a case where the size of the through-hole 44 is fixed to any size, it is possible to manufacture various soundproof cells.

In the present embodiment, the opening ratio (area ratio) of the through-hole 44 in the film 42 is not particularly limited, and may be appropriately set according to the sound absorbing characteristics. The opening ratio (area ratio) of the through-hole 44 in the film 42 is preferably 0.000001% to 70%, more preferably 0.000005% to 50%, and even more preferably 0.00001% to 30%. By setting the opening ratio of the through-hole 44 within the above range, it is possible to appropriately adjust the sound absorption peak frequency, which is the center of the soundproofing frequency band to be selectively soundproofed.

In the present invention, it is preferable that the through-hole 44 is perforated using a processing method for absorbing energy, for example, laser processing, or it is preferable that the through-hole 44 is perforated using a mechanical processing method based on physical contact, for example, punching or needle processing.

Therefore, in a case where a plurality of through-holes 44 in the film 42 or one through-hole 44 is made to have the same size, in the case of perforating holes by laser processing, punching, or needle processing, it is possible to continuously perforate holes without changing the setting of a processing apparatus or the processing strength.

The size of the through-hole 44 may be any size as long as the through-hole 44 can be appropriately perforated by the above-described processing method, and is not particularly limited.

However, from the viewpoint of processing accuracy of laser processing such as accuracy of laser diaphragm, processing accuracy of punching or needle processing, manufacturability such as easiness of processing, and the like, the size of the through-hole 44 on the lower limit side thereof may be 2 μm or more. However, in a case where the size of the through-hole 44 is too small, the transmittance of the through-hole 44 is too small, so that the sound is not incident before the friction occurs and the sound absorption effect cannot be sufficiently obtained. For this reason, it is preferable that the size (that is, diameter) of the through-hole 44 is 0.25 mm or more.

On the other hand, since the upper limit of the size (diameter) of the through-hole 44 needs to be smaller than the size of the frame 14, the upper limit of the size of the through-hole 44 may be set to be less than the size of the frame 14.

In the present invention, since the size of the frame 14 is preferably 0.5 mm to 200 mm, the upper limit of the size (diameter) of the through-hole 44 is also less than 200 mm. However, in a case where the through-hole 44 is too large, the size (diameter) of the through-hole 44 is too large and the effect of the friction occurring at the end portion of the through-hole 44 is reduced. Therefore, even in a case where the size of the frame 14 is large, it is preferable that the upper limit of the size (diameter) of the through-hole 44 is mm order. Since the size of the frame 14 is usually mm order, the upper limit of the size (diameter) of the through-hole 44 is also mm order in many cases.

From the above, the size of the through-hole 44 is more preferably 0.3 mm to 10 mm in diameter, and even more preferably 0.5 mm to 5 mm.

In a case where the through-hole 44 also functions as a resonance hole for generating a suction action by the Helmholtz resonance, since it is necessary to generate a suction action by the Helmholtz resonance, the size of the through-hole 44 is preferably equal to or greater than the diameter of 0.5 mm at which the Helmholtz resonance occurs. The upper limit needs to be less than the size of the frame 14, but is more preferably 10 mm or less, even more preferably 5 mm or less.

(Helmholtz Soundproof Cell)

Next, a Helmholtz soundproof cell that is a resonance type soundproof cell having a closed space volume on the rear surface of a plate or a film with a through-hole will be described.

Figure 24:
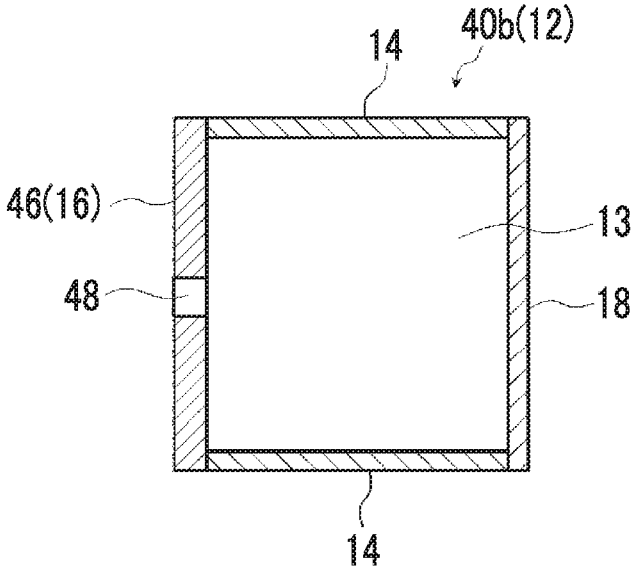
FIG. 24 is a schematic cross-sectional view of an example of a Helmholtz sound absorbing body used in the soundproof structure of the present invention.
Figure 25:
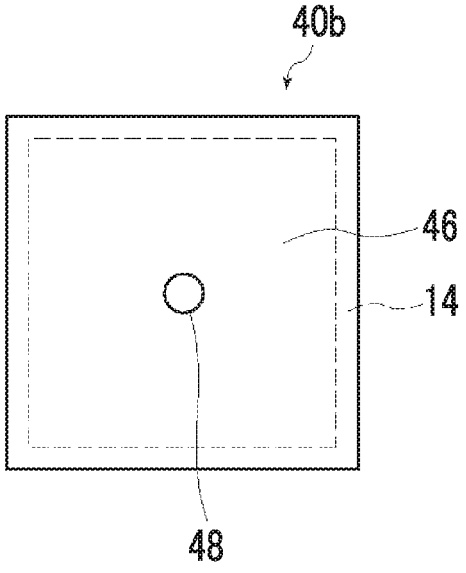
FIG. 25 is a schematic plan view of the Helmholtz sound absorbing body shown in FIG. 24.

A soundproof cell 40*b* shown in FIGS. 24 and 25 is a Helmholtz soundproof cell that has a closed space volume (cavity) on the rear surface of a plate or a film with a through-hole serving as a resonance hole and that absorbs sound by making the cavity communicate with the outside air through the resonance hole to cause a sound absorbing action by the Helmholtz resonance, and can be used as the soundproof unit 12 (12*a* and 12*b*) of the soundproof structure 10 shown in FIG. 1.

The soundproof cell 40*b* has the frame 14 having the opening portion 13, the perforated plate 46 that is attached to one side of the opening portion 13 of the frame 14 and functions as the sound absorbing member 16, a through-hole (first through-hole) 48 perforated in the perforated plate 46, and the rear plate 18 attached to the other side of the opening portion 13 of the frame 14.

Here, since the frame 14 and the rear plate 18 are the same components as in the soundproof cell 40 shown in FIG. 21, the description thereof will be omitted.

The perforated plate 46 is a ventilation sheet used as the sound absorbing member 16 of the soundproof unit 12 of the soundproof structure 10 shown in FIG. 1 in the soundproof cell 40*b*. In the illustrated example, the through-hole 48 serving as a resonance hole for Helmholtz resonance is perforated in the approximately central portion of the perforated plate 46.

Here, the perforated plate 46 has the through-hole 48, and is for making the space formed on its own rear surface by the frame 14 and the rear plate 18 be a closed space except for the through-hole 48. Since such a perforated plate 46 should be able to make the through-hole 48 communicate with the closed space of the rear surface as a resonance hole to cause a sound absorbing action by the Helmholtz resonance, there is no need for film vibration as the film 42 of the soundproof cell 40 shown in FIG. 21. Therefore, the perforated plate 46 may be a member having a higher stiffness than the film 42 of the soundproof cell 40 shown in FIG. 21, or may be a member thicker than the film 42 of the soundproof cell 40 shown in FIG. 21.

For this reason, as a material of the perforated plate 46, the same plate materials as the material of the frame 14 and the rear plate 18 described above, such as a metal material or a resin material.

Here, examples of the metal material include aluminum, aluminum alloy, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium, and alloys of these metals. As resin material, for example, plastics, polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polybutylene terephthalate, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene can be mentioned.

However, as long as sound absorption due to film vibration is not caused, the material of the perforated plate 46 is not limited to the metal material or the resin material described above, and a member having a lower stiffness than the materials of the frame 14 and the rear plate 18 may be used, or a thinner member than the frame 14 and the rear plate 18 may be used.

In the illustrated example, the perforated plate 46 is used as the sound absorbing member 16, but the present invention is not limited thereto. As long as the sound absorption effect by the Helmholtz resonance can be caused, a film with a through-hole formed of a film material may be used. As a film used for the soundproof cell 40*b* used as a Helmholtz soundproof cell, the same film material as the film material of the film 42 of the soundproof cell 40 shown in FIG. 21, which is the vibration film type soundproof cell described above, can be used as long as the sound absorption due to film vibration is smaller than the sound absorption by the Helmholtz resonance at the Helmholtz resonance frequency or as long as it is not possible to cause sound absorption due to film vibration. However, the film used for the soundproof cell 40*b* needs to be a film having a higher stiffness than the material of the film 42 of the soundproof cell 40, and needs to have a larger thickness than the material of the film 42 of the soundproof cell 40.

In a case where a film with a through-hole is used as the sound absorbing member 16 of the soundproof cell 40*b* that is a Helmholtz soundproof cell, the Helmholtz resonance frequency shifts to the high frequency side and interferes with the film vibration in a case where the thickness of the film is small. For this reason, it is preferable to use the perforated plate 46 formed of a plate material.

The method of fixing the perforated plate 46 or the film with a through-hole to the frame 14 is not particularly limited as long as a closed space can be formed on the rear surface of the perforated plate 46 or the film with a through-hole, and a method similar to the above-described method of fixing the film 42 and the rear plate 18 to the frame 14 may be used.

Since the through-hole 48 perforated in the perforated plate 46 can also cause a suction action by the same Helmholtz resonance, the through-hole 48 perforated in the perforated plate 46 may be made to have the above-described configuration similar to the through-hole 44 perforated in film 42 of the soundproof cell 40*a* shown in FIGS. 22 and 23.

However, since the size of the through-hole 48 needs to cause a suction action by the Helmholtz resonance, it is preferable that the size of the through-hole 48 is larger than 0.25 mm in diameter, and the upper limit needs to be less than the size of the frame 14. In addition, the size of the through-hole 48 is more preferably 0.3 mm to 10 mm in diameter, and even more preferably 0.5 mm to 5 mm.

Instead of the perforated plate 46, a film (fiber sheet) formed of a fiber based material or a film having a plurality of micro through-holes (micro through-hole film) can be used as a ventilation sheet.

Here, the ventilation sheet has a ventilation portion (for example, a through-hole or a void) communicating between a closed space and an outside air behind the film or the plate of the soundproofing cell, and has a ventilation sheet structure that causes a sound absorbing action by causing the friction of the air in the ventilation portion.

(Fiber Sheet Type Soundproof Cell)

Next, a fiber sheet type soundproof cell comprising a film (for example, a fiber sheet such as nonwoven fabric, woven fabric, paper, and knitted fabric) formed of a fiber material as a ventilation sheet, instead of the perforated plate 46 of the soundproof cell 40*b*, will be described.

The fiber sheet type soundproof cell has a micro void portion formed of fibers in a film formed of a fiber based material, and absorbs sound by causing viscous friction of the air in the vicinity of the fiber in a case where the sound passes through the micro void portion.

Examples of the fiber based material include aramid fiber, glass fiber, cellulose fiber, nylon fiber, vinylon fiber, polyester fiber, polyethylene fiber, polypropylene fiber, polyolefin fiber, rayon fiber, low density polyethylene resin, ethylene vinyl acetate resin, synthetic rubber, copolymerized polyamide resin, copolymerized polyester resin, paper fiber (tissue paper, Japanese paper, and the like), cellulose, metal materials, SUS (stainless steel fiber sheet "Tommy Fyrex SS" and the like, manufactured by Tamogawa Paper Co.), carbon materials, and carbon containing materials.

(Micro Through-Hole Soundproof Cell)

Next, a micro through-hole soundproof cell that is a soundproof cell having a closed space volume on the rear surface of a film or a plate with a plurality of micro through-holes will be described.

Figure 26:
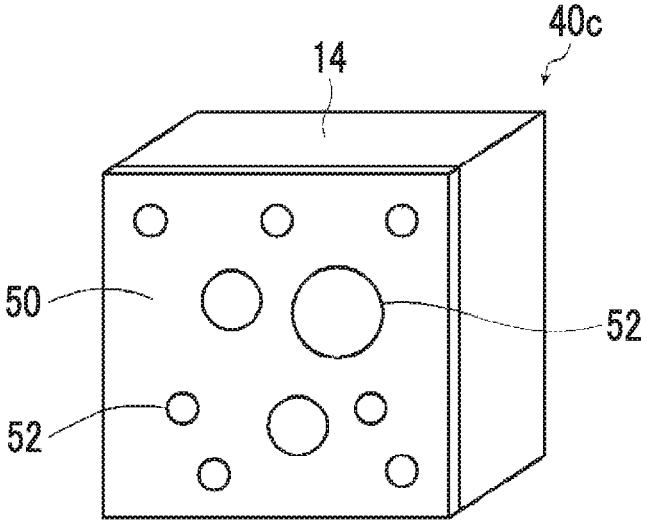
FIG. 26 is a schematic cross-sectional view of an example of a micro through-hole sound absorbing body used in the soundproof structure of the present invention.
Figure 27:
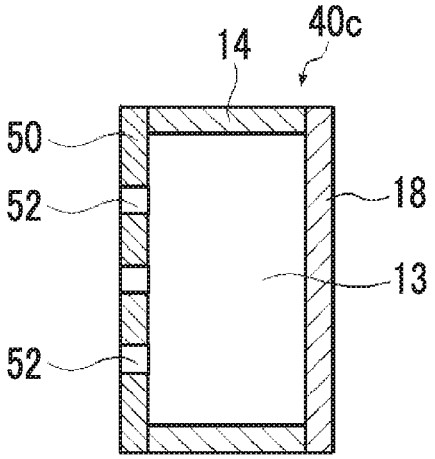
FIG. 27 is a schematic plan view of the micro through-hole sound absorbing body shown in FIG. 26.
Figure 28:
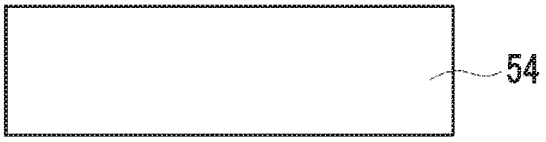
FIG. 28 is a schematic cross-sectional view illustrating an example of a method of manufacturing a micro perforated plate of the micro through-hole sound absorbing body shown in FIG. 26.
Figure 29:
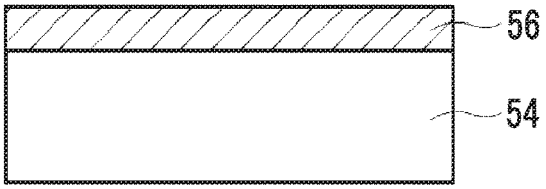
FIG. 29 is a schematic cross-sectional view illustrating an example of a method of manufacturing a micro perforated plate of the micro through-hole sound absorbing body shown in FIG. 26.

A soundproof cell 40*c* shown in FIGS. 26 and 27 is a micro through-hole soundproof cell that has a closed space volume (cavity) on the rear surface of a film or a plate with a plurality of micro through-holes of 0.1 to 250 μm and that absorbs sound by causing a sound absorbing action with the plurality of micro through-holes, and can be used as the soundproof unit 12 (12*a* and 12*b*) of the soundproof structure 10 shown in FIG. 1.

The soundproof cell 40*c* has the frame 14 having the opening portion 13, the micro perforated plate 50 that is attached to one side of the opening portion 13 of the frame 14 and functions as the sound absorbing member 16, a plurality of micro through-holes (second through-holes) 52 perforated in the micro perforated plate 50, and the rear plate 18 attached to the other side of the opening portion 13 of the frame 14.

Here, since the frame 14 and the rear plate 18 are the same components as in the soundproof cell 40 shown in FIG. 21, the description thereof will be omitted.

The micro perforated plate 50 has a plurality of micro through-holes 52 (hereinafter, simply referred to as the through-hole 52) passing therethrough in the thickness direction. A plurality of through-holes 52 formed in the micro perforated plate 50 have an average opening diameter of 0.1 μm or more and 250 μm or less.

The micro perforated plate 50 and the frame 14 may be in contact with each other, and may not be fixed. However, it is preferable that the micro perforated plate 50 and the frame 14 are fixed with an adhesive.

According to the studies of the present inventors, it has been found that there is an optimum ratio in the average opening ratio of through-holes and in particular, in a case where the average opening diameter is as relatively large as about 50 μm or more, the absorbance increases as the average opening ratio decreases. In a case where the average opening ratio is large, sound passes through a number of through-holes. In contrast, in a case where the average opening ratio is small, the number of through-holes is reduced. Accordingly, the amount of sound passing through one through-hole is increased. For this reason, it is thought that the local speed of air in a case where the sound passes through the through-hole is further increased so that the friction generated at the edge portion or the inner wall surface of the through-hole can be made larger.

Here, from the viewpoints of sound absorbing performance and the like, the average opening diameter of the through-holes 52 is preferably 0.1 μm or more and 250 μm or less, but is preferably 100 μm or less, more preferably 80 μm or less, even more preferably 70 μm or less, and particularly preferably 50 μm or less. This is because the ratio of the length of the outer peripheral portion contributing to friction in the through-hole 52 to the opening area of the through-hole 52 increases as the average opening diameter of the through-hole 52 decreases and accordingly friction easily occurs.

The average opening ratio of the through-holes 52 may be appropriately set according to the average opening diameter or the like. However, from the viewpoints of sound absorbing performance, air permeability, and the like, the average opening ratio of the through-hole 52 is preferably 2% or more and 15% or less, more preferably 3% or more, and even more preferably 5% or more. In a case where air permeability and heat exhaust performance are more important, 10% or more is preferable.

For the average opening diameter of through-holes 52, the surface of the micro perforated plate is imaged at a magnification of 200 times from one surface of the micro perforated plate using a high-resolution scanning electron microscope (SEM: model name: FE-SEMS-4100, manufactured by Hitachi High-Technologies Corporation), 20 through-holes whose surroundings are annularly connected are extracted in the obtained SEM photograph, the opening diameters of the through-holes are read, and the average value of the opening diameters is calculated as the average opening diameter. In a case where there are less than 20 through-holes in one SEM photograph, SEM photographs are taken at different positions in the surrounding area and counted until the total number reaches 20.

The opening diameter of the through-hole 52 was evaluated using a diameter (circle equivalent diameter) in a case where the area of the through-hole portion was measured and replaced with a circle having the same area. That is, since the shape of the opening portion of the through-hole is not limited to the approximately circular shape, the diameter of a circle having the same area was evaluated in a case where the shape of the opening portion is a non-circular shape. Therefore, for example, even in the case of through-holes having such a shape that two or more through-holes are integrated, these are regarded as one through-hole, and the circle equivalent diameter of the through-hole is taken as the opening diameter.

For these tasks, for example, all circle equivalent diameters, opening ratios, and the like can be calculated by Analyze Particles using "Image J" (Distributor-Developer: National Institutes of Health (NIH)).

In addition, for the average opening ratio, using the high resolution scanning electron microscope (SEM), the surface of the micro perforated plate is imaged from directly thereabove at a magnification of 200 times, a through-hole portion and a non-through-hole portion are observed by performing binarization with image analysis software or the like for the field of view (five places) of 30 mm×30 mm of the obtained SEM photograph, a ratio (opening area/geometric area) is calculated from the sum of the opening areas of the through-holes and the area of the field of view (geometric area), and an average value in each field of view (five places) is calculated as the average opening ratio.

Here, in the present invention, the plurality of through-holes may be regularly arranged, or may be randomly arranged. From the viewpoints of productivity of micro through-holes, robustness of sound absorbing characteristics, suppression of sound diffraction, and the like, it is preferable that the through-holes are randomly arranged. Regarding sound diffraction, in a case where the through-holes are periodically arranged, a diffraction phenomenon of sound occurs according to the period of the through-hole. Accordingly, there is a concern that the sound is bent by diffraction and the traveling direction of noise is divided into a plurality of directions. Random is an arrangement state in which there is no periodicity like a complete arrangement, and the absorption effect by each through-hole appears but the diffraction phenomenon due to the minimum distance between through-holes does not occur.

In the embodiment of the present invention, there are samples manufactured by etching treatment in continuous treatment in a roll form. However, for mass production, it is easier to form a random pattern at once using surface treatment or the like rather than a process for manufacturing a periodic arrangement. Accordingly, from the viewpoint of productivity, it is preferable that the through-holes are randomly arranged.

A plurality of through-holes may be through-holes having one kind of opening diameter, or may be through-holes having two or more kinds of opening diameters. From the viewpoints of productivity, durability, and the like, it is preferable to form through-holes having two or more kinds of opening diameters.

As for the productivity, as in the above random arrangement, from the viewpoint of performing etching treatment in a large quantity, the productivity is improved by allowing variations in the opening diameter. In addition, from the viewpoint of durability, the size of dirt or dust differs depending on the environment. Accordingly, assuming that through-holes having one kind of opening diameter are provided, all the through-holes are influenced in a case where the size of the main dust almost matches the size of the through-hole. By providing through-holes having a plurality of kinds of opening diameters, a device that can be applied in various environments is obtained.

In addition, from the viewpoint of further increasing the friction in a case where the sound passes through the through-hole 52, it is preferable that the inner wall surface of the through-hole 52 is roughened. Specifically, the surface roughness Ra of the inner wall surface of the through-hole 52 is preferably 0.1 μm or more, more preferably 0.1 μm to 10.0 μm, and even more preferably 0.2 μm to 1.0 μm.

Here, the surface roughness Ra can be measured by measuring the inside of the through-hole 52 with an atomic force microscope (AFM: model number: SPA300/SPI3800N: manufactured by Hitachi High-Technologies Corporation: measured in DFM mode (tapping mode), cantilever: OMCL-AC200TS). Since the roughness is about several microns, using the AFM is easier to measure as a scale than other measurement methods.

In addition, it is possible to calculate the average particle diameter of protruding portions by regarding each one of the protruding portions of the unevenness in the through-hole as a particle from the SEM image in the through-hole.

Specifically, an SEM image captured at 2000 times is captured into Image J and binarized into black and white so that the protruding portion is white, and the area of each protruding portion is calculated by Analyze Particles. A circle equivalent diameter assuming a circle having the same area as the area of each protruding portion was calculated for each protruding portion, and the average value was calculated as the average particle diameter. The imaging range of the SEM image is about 100 μm×100 μm.

The average particle diameter of the protruding portion is preferably 0.1 μm or more and 10.0 μm or less, and more preferably 0.2 μm or more and 5.0 μm or less.

The thickness of the micro perforated plate 50 may be appropriately set in order to obtain the natural vibration mode of the soundproof cell 40*c* of the structure configured to include the frame 14 and the micro perforated plate 50 to a desired frequency. As the thickness increases, the friction energy received in a case where the sound passes through the through-hole 52 increases. Therefore, it can be thought that the sound absorbing performance is further improved. In addition, in a case where the micro perforated plate 50 is extremely thin, it is difficult to handle the micro perforated plate 50 and the micro perforated plate 50 is easy to break. For this reason, it is preferable to have a thickness enough to maintain the micro perforated plate 50. On the other hand, from the viewpoints of miniaturization, air permeability, and light transmittance, it is preferable that the thickness is small. In a case where etching or the like is used for the method of forming the through-hole 52, a longer manufacturing time is required as the thickness becomes larger. Therefore, from the viewpoint of productivity, it is preferable that the thickness is small.

From the viewpoints of sound absorbing performance, miniaturization, air permeability, light transmittance, and the like, the thickness of the micro perforated plate 50 is preferably 5 μm to 500 μm, more preferably 10 μm to 300 μm, and particularly preferably 20 μm to 100 μm.

The material of the micro perforated plate 50 may also be appropriately set in order to obtain a desired frequency as the natural vibration mode of the soundproof structure. Specifically, as the material of the micro perforated plate 50, a metal material, a resin material, and the like can be used. Here, as the metal materials, for example, aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium, and alloys of these metals can be mentioned. As the resin materials, for example, resin material such as polyethylene terephthalate (PET), triacetyl cellulose (TAC), polyvinyl chloride, polyethylene, polyvinyl chloride, polymethylbenzene, cycloolefin polymer (COP), polycarbonate, Zeonor, polyethylene naphthalate (PEN), polypropylene, and polyimide can be used. In addition, glass materials, such as thin film glass, or fiber reinforced plastic materials (for example, rubber materials such as silicone rubber and natural rubber), such as carbon fiber reinforced plastics (CFRP) and glass fiber reinforced plastics (GFRP), can also be used.

Also in the soundproof cell of the present embodiment, since film vibration occurs at the first natural vibration frequency, it is preferable that the plate-shaped member is hard to break against vibration. On the other hand, for the plate-shaped member, it is preferable to use a material having a high Young's modulus, which has a large spring constant and does not make the displacement of the vibration too large, in order to make use of sound absorption by the friction in the micro through-hole. From these viewpoints, it is preferable to use a metal material. Among these, aluminum or an aluminum alloy, which is lightweight and is easy to form micro through-holes by etching or the like, is preferably used from the viewpoints of availability, cost, and the like.

In the case of using a metal material, metal plating may be performed on the surface from the viewpoint of suppression of rust and the like.

In addition, by performing the metal plating on at least the inner surface of the through-hole, the average opening diameter of the through-holes may be adjusted to a smaller range.

On the other hand, in a case where transparency is required for the entire soundproof structure, a resin material or a glass material that can be made transparent can be used. For example, a PET film has a relatively high Young's modulus among resin materials, is easy to obtain, and has high transparency. Therefore, the PET film can be used as a soundproof structure suitable for forming through-holes.

<Aluminum Base Material>

The aluminum base material used as the micro perforated plate is not particularly limited. For example, known aluminum base materials, such as Alloy Nos. 1085, 1N30, and 3003 described in JIS standard H4000, can be used. The aluminum base material is an alloy plate containing aluminum as a main component and containing a small amount of different element.

The thickness of the aluminum base material is not particularly limited, and is preferably 5 μm to 1000 μm, more preferably 5 μm to 200 μm, and particularly preferably 10 μm to 100 μm.

[Method of Manufacturing a Micro Perforated Plate Having a Plurality of Through-Holes]

Next, a method of manufacturing a micro perforated plate having a plurality of through-holes will be described with a case using an aluminum base material as an example.

The method of manufacturing a micro perforated plate having a plurality of through-holes using an aluminum base material has a coating film forming step for forming a coating film containing aluminum hydroxide as a main component on the surface of the aluminum base material, a through-hole forming step for forming a through-hole by performing through-hole forming treatment after the coating film forming step, and a coating film removing step for removing the aluminum hydroxide coating film after the through-hole forming step.

By having the coating film forming step, the through-hole forming step, and the coating film removing step, it is possible to appropriately form through-holes having an average opening diameter of 0.1 μm or more and 250 μm or less.

Next, each step of the method of manufacturing a micro perforated plate having a plurality of through-holes will be described with reference to FIGS. 28 to 32, and then each step will be described in detail.

FIGS. 28 to 32 are schematic cross-sectional views illustrating an example of a preferred embodiment of the method of manufacturing a micro perforated plate having a plurality of through-holes using an aluminum base material.

Figure 30:
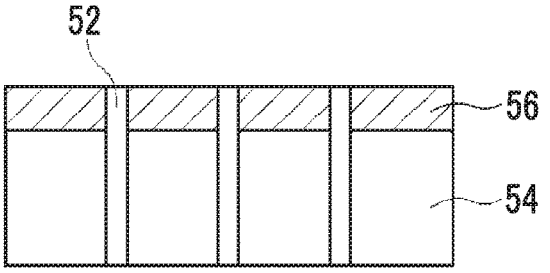
FIG. 30 is a schematic cross-sectional view illustrating an example of a method of manufacturing a micro perforated plate of the micro through-hole sound absorbing body shown in FIG. 26.
Figure 31:
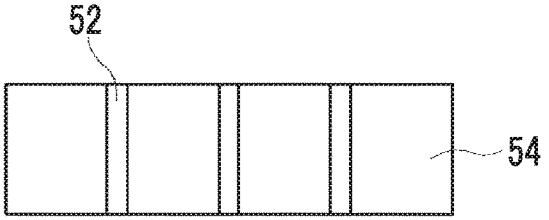
FIG. 31 is a schematic cross-sectional view illustrating an example of a method of manufacturing a micro perforated plate of the micro through-hole sound absorbing body shown in FIG. 26.

As shown in FIGS. 28 to 32, the method of manufacturing a micro perforated plate having a plurality of through-holes is a manufacturing method having a coating film forming step in which coating film forming treatment is performed on one main surface of an aluminum base material 54 to form an aluminum hydroxide coating film 56 (FIGS. 28 and 29), a through-hole forming step in which the through-holes 52 are formed by performing electrolytic dissolution treatment after the coating film forming step so that through-holes are formed in the aluminum base material 54 and the aluminum hydroxide coating film 56 (FIGS. 29 and 30), and a coating film removing step in which the aluminum hydroxide coating film 56 is removed after the through-hole forming step to manufacture the micro perforated plate 50 having the through-holes 52 (FIGS. 30 and 31).

Figure 32:
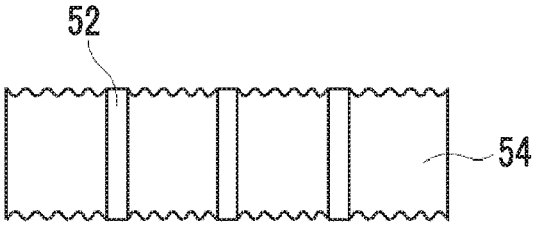
FIG. 32 is a schematic cross-sectional view illustrating an example of a method of manufacturing a micro perforated plate of the micro through-hole sound absorbing body shown in FIG. 26.

In the method of manufacturing a micro perforated plate having a plurality of through-holes, it is preferable to perform electrochemical surface roughening treatment on the micro perforated plate 50 having the through-holes 52 after the coating film removing step and to have a surface roughening treatment step for roughening the surface of the micro perforated plate 50 (FIGS. 31 and 32).

Small holes are easily formed in the aluminum hydroxide coating film. Therefore, by forming through-holes by performing electrolytic dissolution treatment in the through-hole forming step after the coating film forming step for forming the aluminum hydroxide coating film, it is possible to form through-holes having an average opening diameter of 0.1 μm or more and 250 μm or less.

[Coating Film Forming Step]

In the present invention, the coating film forming step included in the method of manufacturing a micro perforated plate having a plurality of through-holes is a step of performing coating film forming treatment on the surface of the aluminum base material to form an aluminum hydroxide coating film.

<Coating Film Forming Treatment>

The above-described coating film forming treatment is not particularly limited. For example, the same treatment as the conventionally known aluminum hydroxide coating film forming treatment can be performed.

As the coating film forming treatment, for example, conditions or apparatuses described in the paragraphs of [0013] to [0026] of JP2011-201123A can be appropriately adopted.

In the present invention, the conditions of the coating film forming treatment change according to the electrolyte to be used and accordingly cannot be unconditionally determined. In general, however, it is appropriate that the electrolyte concentration is 1 to 80% by mass, the liquid temperature is 5 to 70° C., the current density is 0.5 to 60 A/dm$^2$, the voltage is 1 V to 100 V, and the electrolysis time is 1 second to 20 minutes, and these are adjusted so as to obtain a desired amount of coating film.

In the present invention, it is preferable to perform electrochemical treatment using nitric acid, hydrochloric acid, sulfuric acid, phosphoric acid, oxalic acid, or mixed acids of two or more of these acids as an electrolyte.

In the case of performing electrochemical treatment in the electrolyte containing nitric acid and hydrochloric acid, a direct current may be applied between the aluminum base material and the counter electrode, or an alternating current may be applied. In the case of applying a direct current to the aluminum base material, the current density is preferably 1 to 60 A/dm$^2$, and more preferably 5 to 50 A/dm$^2$. In the case of continuously performing the electrochemical treatment, it is preferable to perform the electrochemical treatment using a liquid power supply method for supplying electric power to the aluminum base material through the electrolyte.

In the present invention, the amount of the aluminum hydroxide coating film formed by the coating film forming treatment is preferably 0.05 to 50 g/m$^2$, and more preferably 0.1 to 10 g/m$^2$.

[Through-Hole Forming Step]

The through-hole forming step is a step of forming through-holes by performing electrolytic dissolution treatment after the coating film forming step.

[Electrolytic Dissolution Treatment]

The electrolytic dissolution treatment is not particularly limited, and a direct current or an alternating current may be used, and an acidic solution may be used as the electrolyte. Among these, it is preferable to perform electrochemical treatment using at least one acid of nitric acid or hydrochloric acid, and it is more preferable to perform electrochemical treatment using mixed acids of at least one or more of sulfuric acid, phosphoric acid, or oxalic acid in addition to these acids. In the present invention, as an acidic solution that is an electrolyte, in addition to the above-mentioned acids, electrolytes described in U.S. Pat. Nos. 4,671,859B, 4,661,219B, 4,618,405B, 4,600,482B, 4,566,960B, 4,566,958B, 4,566,959B, 4,416,972B, 4,374,710B, 4,336,113B, 4,184,932B, and the like can also be used.

The concentration of the acidic solution is preferably 0.1 to 2.5% by mass, and particularly preferably 0.2 to 2.0% by mass. The solution temperature of the acidic solution is preferably 20 to 80° C., more preferably 30 to 60° C.

As the above-described acid based aqueous solution, it is possible to use an aqueous solution of acid having a concentration of 1 to 100 g/L in which at least one of a nitric acid compound having nitrate ions, such as aluminum nitrate, sodium nitrate, and ammonium nitrate, a hydrochloric acid compound having hydrochloric acid ions, such as aluminum chloride, sodium chloride, and ammonium chloride, or a sulfuric acid compound having sulfate ions, such as aluminum sulfate, sodium sulfate, and ammonium sulfate, is added in a range of 1 g/L to saturation.

In addition, metals contained in aluminum alloys, such as iron, copper, manganese, nickel, titanium, magnesium, and silica, may be dissolved in the above-described acid based aqueous solution. A solution obtained by adding aluminum chloride, aluminum nitrate, aluminum sulfate, or the like to an aqueous solution having an acid concentration of 0.1 to 2% by mass so that the concentration of aluminum ions is 1 to 100 g/L is preferably used.

In the electrochemical dissolution treatment, a direct current is mainly used. However, in the case of using an alternating current, the AC power supply wave is not particularly limited, and a sine wave, a rectangular wave, a trapezoidal wave, a triangular wave, and the like are used. Among these, a rectangular wave or a trapezoidal wave is preferable, and a trapezoidal wave is particularly preferable.

(Nitric Acid Electrolysis)

In the present invention, it is possible to easily form through-holes having an average opening diameter of 0.1 μm or more and 250 μm or less by electrochemical dissolution treatment using a nitric acid based electrolyte (hereinafter, also abbreviated as "nitric acid dissolution treatment").

Here, for the reason that it is easy to control the melting point of the through-hole formation, the nitric acid dissolution treatment is preferably an electrolytic treatment performed under the conditions that a direct current is used and the average current density is 5 A/dm$^2$ or more and the electric quantity is 50 C/dm$^2$ or more. The average current density is preferably 100 A/dm$^2$ or less, and the electric quantity is preferably 10000 C/dm$^2$ or less.

The concentration or temperature of the electrolyte in the nitric acid electrolysis is not particularly limited, and electrolysis can be performed at 30 to 60° C. using a nitric acid electrolyte having a high concentration, for example, a nitric acid concentration of 15 to 35% by mass, or electrolysis can be performed at a high temperature, for example, 80° C. or more, using a nitric acid electrolyte having a nitric acid concentration of 0.7 to 2% by mass.

In addition, electrolysis can be performed by using an electrolyte in which at least one of sulfuric acid, oxalic acid, or phosphoric acid having a concentration of 0.1 to 50% by mass is mixed in the nitric acid electrolyte.

(Hydrochloric Acid Electrolysis)

In the present invention, it is also possible to easily form through-holes having an average opening diameter of 1 μm or more and 250 μm or less by electrochemical dissolution treatment using a hydrochloric acid based electrolyte (hereinafter, also abbreviated as "hydrochloric acid dissolution treatment").

Here, for the reason that it is easy to control the melting point of the through-hole formation, the hydrochloric acid dissolution treatment is preferably an electrolytic treatment performed under the conditions that a direct current is used and the average current density is 5 A/dm$^2$ or more and the electric quantity is 50 C/dm$^2$ or more. The average current density is preferably 100 A/dm$^2$ or less, and the electric quantity is preferably 10000 C/dm$^2$ or less.

Specifically, the hole diameter can be changed by the solution and the current density. For example, in order to obtain a through-hole diameter of 250 μm, the following steps are possible.

Through-holes were formed on the aluminum base material and the aluminum hydroxide coating film by performing electrolytic treatment under the conditions that the total electric quantity was 1000 C/dm$^2$ by using the aluminum base material as an anode and using an electrolyte (nitric acid concentration of 1%, sulfuric acid concentration of 0.2%, aluminum concentration of 0.5%) kept at 50° C. In addition, electrolytic treatment was performed with a DC power supply. The current density was set to 5 A/dm$^2$.

After forming the through-holes, washing by spraying was performed for drying. In order to obtain an average opening diameter of 46 μm, the current density can be changed to 25 A/dm 2, and the other conditions can be the same. In this manner, the through-hole diameter can be made different by changing the conditions.

The concentration or temperature of the electrolyte in the hydrochloric acid electrolysis is not particularly limited, and electrolysis can be performed at 30 to 60° C. using a hydrochloric acid electrolyte having a high concentration, for example, a hydrochloric acid concentration of 10 to 35% by mass, or electrolysis can be performed at a high temperature, for example, 80° C. or more, using a hydrochloric acid electrolyte having a hydrochloric acid concentration of 0.7 to 2% by mass.

In addition, electrolysis can be performed by using an electrolyte in which at least one of sulfuric acid, oxalic acid, or phosphoric acid having a concentration of 0.1 to 50% by mass is mixed in the hydrochloric acid electrolyte.

[Coating Film Removing Step]

The coating film removing step is a step of performing chemical dissolution treatment to remove the aluminum hydroxide coating film.

In the coating film removing step, for example, the aluminum hydroxide coating film can be removed by performing an acid etching treatment or an alkali etching treatment to be described later.

<Acid Etching Treatment>

The above-described dissolution treatment is a treatment of dissolving the aluminum hydroxide coating film using a solution that preferentially dissolves aluminum hydroxide rather than aluminum (hereinafter, referred to as "aluminum hydroxide solution").

Here, as the aluminum hydroxide solution, for example, an aqueous solution containing at least one selected from nitric acid, hydrochloric acid, sulfuric acid, phosphoric acid, oxalic acid, a chromium compound, a zirconium compound, a titanium compound, a lithium salt, a cerium salt, a magnesium salt, sodium silicofluoride, zinc fluoride, a manganese compound, a molybdenum compound, a magnesium compound, a barium compound, and a halogen simple substance is preferable.

Specifically, examples of the chromium compound include chromium oxide (III) and chromium anhydride (VI) acid.

Examples of the zirconium based compound include zirconium fluoride, zirconium fluoride, and zirconium chloride.

Examples of the titanium compound include titanium oxide and titanium sulfide.

Examples of the lithium salt include lithium fluoride and lithium chloride.

Examples of the cerium salt include cerium fluoride and cerium chloride.

Examples of the magnesium salt include magnesium sulfide.

Examples of the manganese compound include sodium permanganate and calcium permanganate.

Examples of the molybdenum compound include sodium molybdate.

Examples of the magnesium compound include magnesium fluoride and pentahydrate.

Examples of the barium compound include barium oxide, barium acetate, barium carbonate, barium chlorate, barium chloride, barium fluoride, barium iodide, barium lactate, barium oxalate, barium oxalate, barium perchlorate, barium selenate, selenite barium, barium stearate, barium sulfite, barium titanate, barium hydroxide, barium nitrate, and hydrates thereof.

Among the barium compounds, barium oxide, barium acetate, and barium carbonate are preferable, and barium oxide is particularly preferable.

Examples of halogen simple substance include chlorine, fluorine, and bromine.

Among these, it is preferable that the aluminum hydroxide solution is an aqueous solution containing an acid, and examples of the acid include nitric acid, hydrochloric acid, sulfuric acid, phosphoric acid, and oxalic acid and a mixture of two or more acids may be used.

The acid concentration is preferably 0.01 mol/L or more, more preferably 0.05 mol/L or more, and even more preferably 0.1 mol/L or more. There is no particular upper limit, but in general it is preferably 10 mol/L or less, and more preferably 5 mol/L or less.

The dissolution treatment is performed by bringing the aluminum base material on which the aluminum hydroxide coating film is formed into contact with the solution described above. The method of contacting is not particularly limited, and examples thereof include an immersion method and a spray method. Among these, the immersion method is preferable.

The immersion treatment is a treatment of immersing an aluminum base material on which an aluminum hydroxide coating film is formed into the solution described above. Stirring during immersion treatment is preferably performed since uniform treatment is performed.

The immersion treatment time is preferably 10 minutes or more, more preferably 1 hour or more, and even more preferably 3 hours or more or 5 hours or more.

<Alkali Etching Treatment>

The alkali etching treatment is a treatment for dissolving the surface layer by bringing the aluminum hydroxide coating film into contact with an alkali solution.

Examples of the alkali used in the alkali solution include caustic alkali and alkali metal salts. Specifically, examples of the caustic alkali include sodium hydroxide (caustic soda) and caustic potash. Examples of the alkali metal salt include: alkali metal silicates such as sodium metasilicate, sodium silicate, potassium metasilicate, and potassium silicate; alkali metal carbonates such as sodium carbonate and potassium carbonate; alkali metal aluminates such as sodium aluminate and potassium aluminate; alkali metal aldonic acid salts such as sodium gluconate and potassium gluconate; and alkali metal hydrogenphosphate such as secondary sodium phosphate, secondary potassium phosphate, tertiary sodium phosphate, and tertiary potassium phosphate. Among these, a solution containing caustic alkali and a solution containing both caustic alkali and alkali metal aluminate are preferable from the viewpoint of high etching speed and low cost. In particular, an aqueous solution of sodium hydroxide is preferred.

The concentration of the alkali solution is preferably 0.1 to 50% by mass, and more preferably 0.2 to 10% by mass. In a case where aluminum ions are dissolved in the alkali solution, the concentration of aluminum ions is preferably 0.01 to 10% by mass, and more preferably 0.1 to 3% by mass. The temperature of the alkali solution is preferably 10 to 90° C. The treatment time is preferably 1 to 120 seconds.

Examples of the method of bringing the aluminum hydroxide coating film into contact with the alkali solution include a method in which an aluminum base material having an aluminum hydroxide coating film formed thereon is made to pass through a tank containing an alkali solution, a method in which an aluminum base material having an aluminum hydroxide coating film formed thereon is immersed in a tank containing an alkali solution, and a method in which an alkali solution is sprayed onto the surface (aluminum hydroxide coating film) of an aluminum base material on which an aluminum hydroxide coating film is formed.

[Surface Roughening Treatment Step]

In the present invention, any surface roughening treatment step which may be included in the method of manufacturing a micro perforated plate having a plurality of through-holes is a step of roughening the front surface or the back surface of the aluminum base material by performing electrochemical roughening treatment (hereinafter, also abbreviated as "electrolytic surface roughening treatment") on the aluminum base material from which the aluminum hydroxide coating film has been removed.

In the embodiment described above, the surface roughening treatment is performed after forming through-holes. However, the present invention is not limited thereto, and through-holes may be formed after the surface roughening treatment.

In the present invention, the surface can be easily roughened by electrochemical surface roughening treatment (hereinafter, also abbreviated as "nitric acid electrolysis") using a nitric acid based electrolyte.

Alternatively, the surface can also be roughened by electrochemical surface roughening treatment (hereinafter, also abbreviated as "hydrochloric acid electrolysis") using a hydrochloric acid based electrolyte.

[Metal Coating Step]

In the present invention, for the reason that the average opening diameter of the through-hole formed by the above-described electrolytic dissolution treatment can be adjusted to a small range of about 0.1 μm to 20 μm, it is preferable that the method of manufacturing a plate-shaped member having a plurality of through-holes has a metal coating step for coating a part or entirety of the surface of the aluminum base material including at least the inner wall of the through-hole with a metal other than aluminum after the coating film removing step described above.

Here, "coating a part or entirety of the surface of the aluminum base material including at least the inner wall of the through-hole with a metal other than aluminum" means that at least the inner wall of the through-hole in the entire surface of the aluminum base material including the inner wall of the through-hole is coated. A surface other than the inner wall may not be coated, or a part or entirety of the surface other than the inner wall may be coated.

In the metal coating step, for example, substitution treatment and plating treatment to be described later are performed on the aluminum base material having through-holes.

<Substitution Treatment>

The above-described substitution treatment is a treatment for performing substitution plating of zinc or zinc alloy on a part or entirety of the surface of the aluminum base material including at least the inner wall of the through-hole.

Examples of the substitution plating solution include a mixed solution of sodium hydroxide of 120 g/L, zinc oxide of 20 g/L, crystalline ferric chloride of 2 g/L, Rossel salt of 50 g/L, and sodium nitrate of 1 g/L. Commercially available Zn or Zn alloy plating solution may be used. For example, substars Zn-1, Zn-2, Zn-3, Zn-8, Zn-10, Zn-111, Zn-222, and Zn-291 manufactured by Okuno Pharmaceutical Industries can be used.

The time of immersion of the aluminum base material in such a substitution plating solution is preferably 15 seconds to 40 seconds, and the immersion temperature is preferably 20° C. to 50° C.

<Plating Treatment>

In a case where zinc or zinc alloy is substituted for plating on the surface of the aluminum base material by the substitution treatment described above to form a zinc coating film, for example, it is preferable to perform plating treatment in which the zinc coating film is substituted to nickel by electrolytic plating to be described later and then various metals are precipitated by electrolytic plating to be described later.

(Electroless Plating Treatment)

As a nickel plating solution used for the electroless plating treatment, commercially available products can be widely used. For example, an aqueous solution containing nickel sulfate of 30 g/L, sodium hypophosphite of 20 g/L, and ammonium citrate of 50 g/L can be mentioned.

In addition, examples of the nickel alloy plating solution include an Ni—P alloy plating solution in which a phosphorus compound is used as a reducing agent or an Ni—B plating solution in which a boron compound is used as a reducing agent.

The time of immersion in such a nickel plating solution or nickel alloy plating solution is preferably 15 seconds to 10 minutes, and the immersion temperature is preferably 30° C. to 90° C.

(Electrolytic Plating Treatment)

As a plating solution in the case of electroplating Cu as an example of electrolytic plating treatment, for example, a plating solution obtained by adding sulfuric acid Cu of 60 to 110 g/L, sulfuric acid of 160 to 200 g/L, and hydrochloric acid of 0.1 to 0.15 mL/L to pure water and adding Top Lucina SF base WR of 1.5 to 5.0 mL/L, Top Lucina SF-B of 0.5 to 2.0 mL/L, and Top Lucina SF leveler of 3.0 to 10 mL/L, which are manufactured by Okuno Pharmaceutical Co., Ltd., as additives can be mentioned.

The immersion time in such a copper plating solution depends on the thickness of the Cu film and accordingly is not particularly limited. For example, in a case where a Cu film having a thickness of 2 μm is applied, immersion for about 5 minutes at a current density of 2 A/dm$^2$ is preferable, and the immersion temperature is preferably 20° C. to 30° C.

[Washing Treatment]

In the present invention, it is preferable to perform washing after the end of each treatment step described above. Pure water, well water, tap water, and the like can be used for washing. A nipping apparatus may be used to prevent the inflow of treatment solution to the next step.

Such a micro perforated plate having through-holes may be manufactured by using a cut sheet-shaped aluminum base material, or may be manufactured by roll-to-roll (hereinafter, also referred to as RtoR).

As is well known, RtoR is a manufacturing method in which a raw material is pulled out from a roll on which a long raw material is wound, various treatments such as surface treatment are performed while transporting the raw material in the longitudinal direction, and the treated raw material is wound onto the roll again.

In the manufacturing method of forming through-holes in the aluminum base material as described above, it is possible to easily and efficiently form a through-hole of about 20 μm by RtoR.

The method of forming through-holes is not limited to the method described above, and the through-holes may be formed by using a known method depending on a material for forming the micro perforated plate or the like.

For example, in a case where a resin film such as a PET film is used as a micro perforated plate, it is possible to use a processing method for absorbing energy, such as laser processing.

In a case where the target film is thin regardless of a material, such as a resin film or a metal, it is possible to form through-holes by using a mechanical processing method based on physical contact, such as punching and needle processing. For example, in a case where the aluminum film has a thickness of about 100 μm or less, a large number of through-holes of about 100 μm or more can be formed by using the punching method.

It is preferable to include a porous sound absorbing body or a fibrous sound absorbing body in the entirety or a part of the closed space (that is, inside the frame) behind the film 42, the perforated plate 46, the fiber sheet, the micro perforated plate 50, and the rear plate 18 that are the sound absorbing members 16 of each soundproof cell. Such a sound absorbing body is not particularly limited. For example, known materials, such as (1) materials containing foamed materials, such as foamed urethane, flexible urethane foam, wood, ceramic particle sintered material, and phenol foam, and minute air and (2) a gypsum board can be used as porous sound absorbing bodys. As the fibrous sound absorbing body, for example, known sound absorbing materials, such as (1) fibers, such as glass wool, rock wool, microfiber (such as synthrate manufactured by 3M), floor mat, carpet, meltblown nonwoven fabric, metal nonwoven fabric, polyester nonwoven fabric, metal wool, felt, insulation board, and glass nonwoven fabric, and nonwoven fabric materials, (2) wood cement board, and (3) nanofiber-based materials such as silica nanofiber, can be appropriately used.

In a case where such a sound absorbing material is present in the closed space, it is possible to increase the absorption band compared with a case where the closed space is filled with air.

The fact that soundproof cells used as the two soundproof units 12 are different in a case where the two adjacent soundproof units 12 are different may mean that two different soundproof cells in the soundproof cells 40 and 40*a* that are the vibration film type soundproof cells described above, the soundproof cell 40*b* that is a Helmholtz soundproof cell, and the soundproof cell 40*c* that is a micro through-hole soundproof cell may be combined. In a case where two soundproof cells of the same type among the soundproof cells 40, 40*a*, 40*b*, and 40*c* are used, at least one of the frame 14 of each soundproof cell, the film 42 that is the sound absorbing member 16, the perforated plate 46, the fiber sheet, and the micro perforated plate 50, and the rear plate 18 may be different.

The fact that the frame 14 of the soundproof cell is different means that at least one of, for example, the size, thickness, width, and material of each frame 14, the size of each opening portion 13 (the size of the opening area and the size of the space volume), or the like may be different.

The fact that the films 42 of the soundproof cells 40 and 40*a* are different means that at least one of the size, thickness, stiffness, and material of the film 42, the presence or absence of a through-hole (first through-hole) 44 provided in the film 42 and the size thereof, or the like may be different. In a case where a weight and/or a metal mesh is provided on the film 42, at least one of the presence or absence thereof, the weight, size, stiffness, or material thereof may be different.

The fact that the perforated plate 46 of the soundproof cell 40*b* is different means that at least one of the size, thickness, stiffness, and material of the perforated plate 46, the size of the through-hole (second through-hole) 48 provided in the perforated plate 46, or the like may be different.

The fact that the micro perforated plate 50 of the soundproof cell 40*c* is different means that at least one of the size, thickness, stiffness, and material of the micro perforated plate 50, the average opening diameter and the average opening ratio of the plurality of micro through-holes 52 provided in the micro perforated plate 50, the surface roughness of the inner wall surfaces, or the like may be different.

The fact that the rear plate 18 is different means that at least one of its size, thickness, stiffness, material, or the like may be different.

The soundproof cell used as the soundproof unit 12 in the present invention is basically configured as described above.

Figure 33:
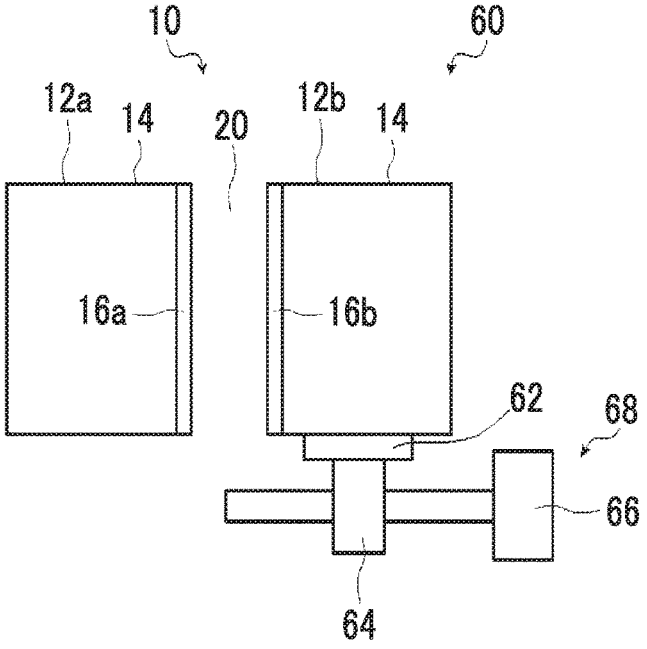
FIG. 33 is a schematic cross-sectional view of an example of a soundproof structure according to another embodiment of the present invention.

A soundproof structure 60 shown in FIG. 33 comprises the soundproof structure 10 shown in FIG. 1, a mounting table 62 for mounting and supporting the soundproof unit 12*b* of the soundproof structure 10, a traveling nut 64 fixed to the mounting table 62, and a drive screw 66 screwed to the traveling nut 64, and has a screw moving mechanism 68 that moves the soundproof unit 12*b* with respect to the soundproof unit 12*a* of the soundproof structure 10.

Here, the soundproof unit 12*a* of the soundproof structure 10 is supported by a base (not shown), and the drive screw 66, such as a ball screw, is rotatably supported on the base.

In this manner, by rotating the drive screw 66 manually or automatically to move the soundproof unit 12*b* with respect to the soundproof unit 12*a*, the average distance between the sound absorbing member 16*a* of the soundproof unit 12*a* and the sound absorbing member 16*b* of the soundproof unit 12*b* can be changed. Therefore, it is possible to adjust the absorption peak frequency at which the absorbance is the peak.

In a case where a moving mechanism such as the screw moving mechanism 68 is an automatic moving mechanism that moves automatically, the moving mechanism comprises a driving source, such as a motor, and a control unit for controlling the driving of the driving source, which are not shown. The control unit automatically controls the driving source according to the movement amount given to the control unit, so that it is possible to perform automatic movement by the movement amount.

Here, the screw moving mechanism 68 in the illustrated example moves the soundproof unit 12*b* with respect to the soundproof unit 12*a*, the present invention is not limited thereto. A moving mechanism for moving the soundproof unit 12*a* with respect to the soundproof unit 12*b* may be used, or a moving mechanism for moving both of the soundproof units 12*a* and 12*b* may be used.

That is, the moving mechanism used in the present invention may change the average distance between the two sound absorbing members 16*a* and 16*b* by moving one of the soundproof units 12*a* and 12*b* relatively with respect to the other one.

Such a moving mechanism is not particularly limited, and any moving mechanism may be used as long as at least one of the two adjacent soundproof units 12*a* and 12*b* can be moved. For example, in addition to the screw moving mechanism 68 in the illustrated example, although not shown, a rail traveling mechanism comprising a rail and a wheel on which at least one of the two adjacent soundproof units 12*a* and 12*b* is mounted and which travels on the rail, a rack and pinion mechanism which comprises a rack, to which at least one of the two adjacent soundproof units 12*a* and 12*b* is attached, a pinion engaged with the rack, and a moving mechanism such as a piezoactuator using a piezoelectric element can be mentioned.

The soundproof structure such as the soundproof structure 60 comprising the screw moving mechanism 68 described above can also be configured as a soundproof system that appropriately insulates sound according to noise from a noise source.

Figure 34:
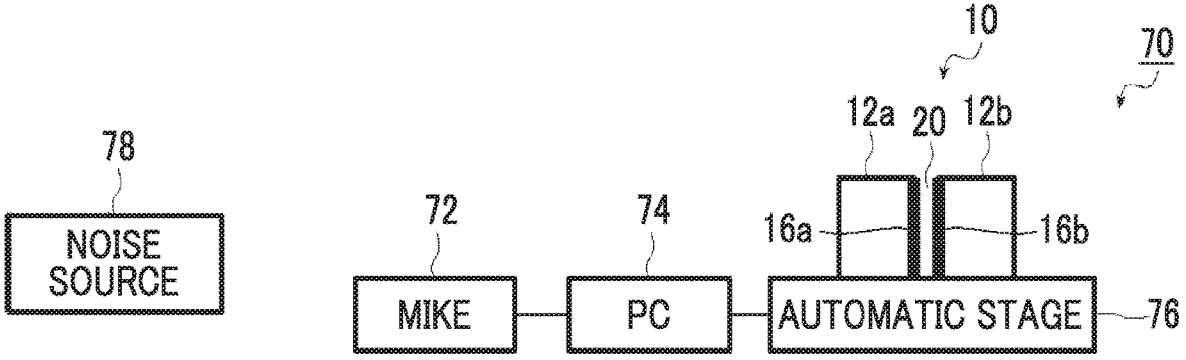
FIG. 34 is a schematic cross-sectional view of an example of a soundproof system according to an embodiment of the present invention.

A soundproof system 70 shown in FIG. 34 is a system that causes absorption at an appropriate frequency by automatically adjusting the absorption peak frequency by adjusting the distance between the sound absorbing members with respect to the noise source, and appropriately insulates, that is, shields noise by adjusting the absorption peak frequency of the soundproof structure according to the frequency of the noise of the surrounding environment of the soundproof structure, in particular, the frequency of the noise from the noise source, so that the absorption peak frequency matches the frequency of the noise or the absorption peak frequency is as close as possible to the frequency of the noise.

The soundproof system 70 has the soundproof structure 10 comprising the two adjacent soundproof units 12*a* and 12*b* shown in FIG. 1, a microphone (hereinafter, simply referred to as a mike) 72 for measuring the noise of a noise source 78 in the surrounding environment of the soundproof structure 10, a personal computer (hereinafter, referred to as a PC) 74 for analyzing the frequency of the noise measured by the mike 72, and an automatic stage 76 for changing the distance between the sound absorbing members 16*a* and 16*b* of the two adjacent soundproof units 12*a* and 12*b* according to the analysis result of the PC 74.

Here, the mike 72 is a measurement device for measuring the sound pressure of the noise from the noise source 78 in the surrounding environment of the soundproof structure 10, and configures a measurement unit. In this case, it is preferable that the position of the mike 72 is located closer to the noise source 78 than the soundproof structure 10. However, the mike 72 can be disposed anywhere as long as noise can be measured, so that analysis can be made anywhere.

The PC 74 receives sound pressure data of the noise measured by the mike 72, converts the sound pressure data into frequency characteristics, that is, frequency spectrum, and determines a soundproofing target frequency to be soundproofed or muffled. The soundproofing target frequency is not particularly limited, and is preferably a frequency of maximum sound pressure in the audible range. For example, it is preferable to determine the soundproofing target frequency on the assumption that it is desired to remove the maximum value in the frequency spectrum (that is, assuming a frequency to be shielded).

Then, the PC 74 calculates an average distance (hereinafter, referred to as an interlayer distance) between the sound absorbing members 16*a* and 16*b* corresponding to the soundproofing target frequency. Specifically, the PC 74 refers to data stored in advance in a storage unit, such as a memory, and determines the interlayer distance between the sound absorbing members 16*a* and 16*b* corresponding to or closest to the soundproofing target frequency (that is, the absorption peak frequency is the soundproofing target frequency) from the data. Here, the PC 74 is a frequency spectrum analysis apparatus, and configures an analysis unit.

The data stored in the memory of the PC 74 is a look-up table (that is, a correspondence table (data) between interlayer distances and frequencies) showing the relationship between the interlayer distance between the sound absorbing members 16*a* and 16*b* of the two adjacent soundproof units 12*a* and 12*b* and the absorption peak frequency.

In such a correspondence table, it is preferable to measure in advance the relationship between the interlayer distance between the sound absorbing members 16*a* and 16*b* and the absorption peak frequency and determine the interlayer distance between the sound absorbing members 16*a* and 16*b* based on the actually measured value.

The PC 74 transmits (inputs) the interlayer distance between the sound absorbing members 16*a* and 16*b* determined in this manner to the automatic stage 76.

Although not shown, the automatic stage 76 is an automatic moving mechanism comprising a moving mechanism such as the screw moving mechanism 68 shown in FIG. 33, a driving source such as a motor, and a control unit such as a controller for controlling the driving of the driving source. The automatic stage 76 adjusts the absorption peak frequency of the soundproof structure 10 by moving at least one of the two adjacent soundproof units 12*a* and 12*b* so as to have an interlayer distance between the sound absorbing members 16*a* and 16*b* received from the PC 74, thereby matching the absorption peak frequency to the soundproofing target frequency.

In this manner, the soundproof system 70 according to the embodiment of the present invention can appropriately muffle the noise of the soundproofing target frequency.

Although the soundproof system 70 in the illustrated example comprises the automatic stage 76, the soundproof system 70 may comprise only a moving mechanism instead of the automatic stage 76. In that case, the moving mechanism may be manually moved according to the interlayer distance determined by the PC 74.

In a case where the PC 74 does not have a correspondence table between interlayer distances and frequencies prepared in advance, feedback may be written in the automatic stage 76 while taking the sound pressure by using two mikes.

Figure 35:
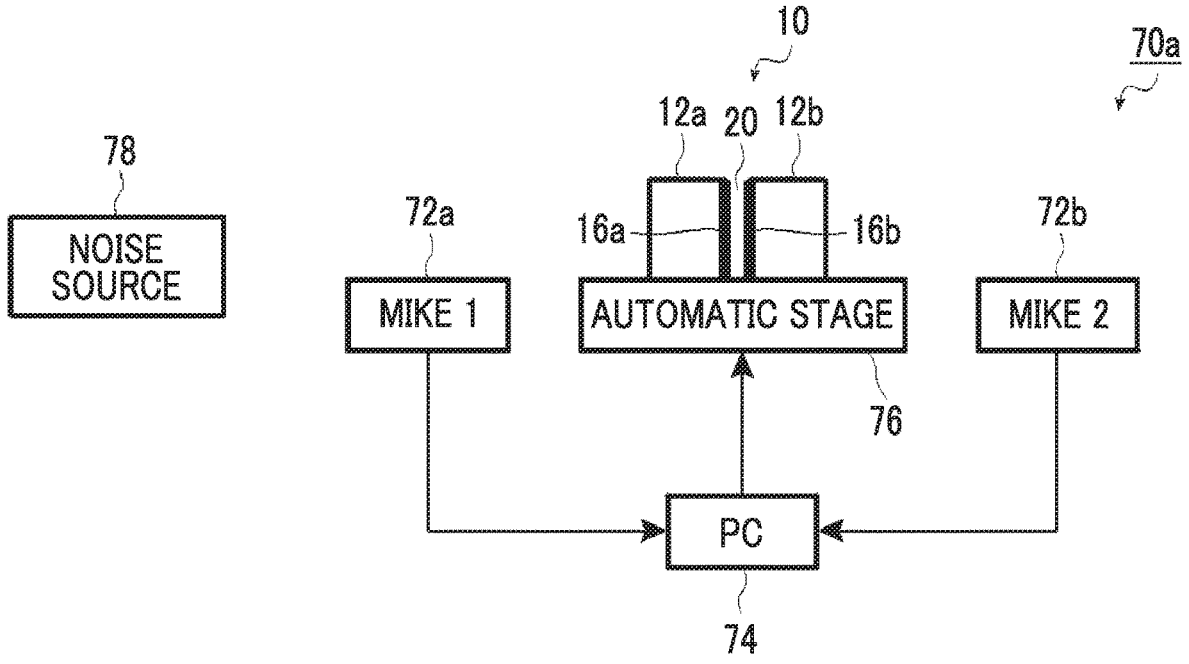
FIG. 35 is a schematic cross-sectional view of an example of a soundproof system according to another embodiment of the present invention.

A soundproof system 70*a* shown in FIG. 35 is an automatic soundproof system that comprises a feedback mechanism and adjusts the interlayer distance so that the absorption frequency of the soundproof structure matches the soundproofing target frequency while applying feedback, without creating the correspondence table of absorption frequency and interlayer distance in advance, and is a system that can make an automatic muffling mechanism function even in a case where the device characteristics of the soundproof structure change. The soundproof system 70*a* has the soundproof structure 10, two mikes (mike 1) 72*a* and (mike 2) 72*b*, the automatic stage 76, and the PC 74.

Similarly to the soundproof system 70, in the soundproof system 70*a*, the sound pressure of noise is measured by at least one mike of the two mikes 72*a* and 72*b*, and the soundproofing target frequency is determined from the spectrum information (frequency spectrum data) of the mike by the PC 74.

The two mikes 72*a* and 72*b* measure the sound pressure at the soundproofing target frequency of the noise from the noise source 78. Here, one mike, for example, the mike 72*a* takes noise with a larger sound pressure at the soundproofing target frequency, and the other mike, for example, the mike 72*b* takes noise with a smaller sound pressure at the soundproofing target frequency. Here, as shown in FIG. 35, it can be determined that the mike 72*a* with a larger sound pressure is on the noise source 78 side. The larger sound pressure at the soundproofing target frequency of the mike 72*a* is set to be p1, and the smaller sound pressure at the soundproofing target frequency of the mike 72*b* is set to be p2.

In the soundproof system 70*a*, feedback adjustment is performed by the automatic stage 76 so that the smaller sound pressure p2 is minimized with respect to the larger sound pressure p1, that is, p2/p1 is minimized.

First, a sound pressure ratio abs(p2)/abs(p1) before moving the automatic stage 76 is measured using the two mikes 72*a* and 72*b*.

Then, the sound pressure ratio abs(p2)/abs(p1) is measured while moving the automatic stage 76. By searching for an interlayer distance at which the sound pressure ratio abs(p2)/abs(p1) is minimized among these, it is possible to determine an appropriate interlayer distance.

Finally, by matching the absorption frequency to the soundproofing target frequency by adjusting the interlayer distance with the automatic stage 76 so as to match the appropriate interlayer distance, it is possible to reduce the noise of the soundproofing target frequency most.

In the illustrated example, noise with a larger sound pressure and noise with a smaller sound pressure taken by the two mikes 72*a* and 72*b* are transmitted to the PC 74, the sound pressure ratio p2/p1 is calculated, and feedback adjustment is performed by the automatic stage 76. However, the present invention is not limited thereto, and the outputs of the two mikes 72*a* and 72*b* may be directly transmitted to the direct automatic stage 76 without passing through the PC 74.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

Therefore, the film is preferably flame retardant. As the film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the film to the frame, a bonding method using a flame-retardant adhesive (Three Bond 1537 series (manufactured by Three Bond Co. Ltd.)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont Film), PEN film Teonex (registered trademark) (manufactured by Teijin DuPont Film), and/or Lumirror (registered trademark) off-anneal low shrinkage type (manufactured by Toray Industries, Inc.) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure according to the embodiment of the present invention is disposed outdoors or in a place where light is incident, the weather resistance of the structural member becomes a problem.

Therefore, as the film, it is preferable to use a weather-resistant film, such as a special polyolefin film (ARTPLY (registered trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As a frame material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing adhering dust, it is possible to remove dust by emitting sound having the resonance frequency of a film and strongly vibrating the film. The same effect can be obtained even in a case where a blower or wiping is used.

The soundproof structure and the soundproof system according to the embodiment of the present invention are basically configured as described above.

Since the soundproof structure and the soundproof system according to the embodiment of the present invention are configured as described above, low-frequency shielding that is difficult in the conventional soundproof structure can be realized and the frequency can be lowered. In addition, since the absorption peak frequency can be adjusted in the low frequency region, there is also a feature that it is possible to design a structure that is strongly soundproofed or insulated according to noise of various frequencies.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site to prevent leakage of a lot of noise around the construction site); and a soundproof member for tunnel (soundproof member installed in a tunnel to prevent noise leaking to the inside and outside the tunnel).

EXAMPLES

The soundproof structure according to the embodiment of the present invention will be specifically described by way of examples.

First, a single soundproof cell (single cell) that is a soundproof unit used in the soundproof structure according to the embodiment of the present invention was manufactured as a reference example.

In the following examples, the "interlayer distance" is defined as an "average distance between sound absorbing members".

Reference Example 1

First, as Reference example 1, the soundproof cell (single cell) 40 shown in FIG. 21 was manufactured.

The frame 14 having the opening portion 13 of a square shape having a size of 16 mm, a frame thickness of 10 mm, and a frame width of 2 mm was manufactured using acryl as a material. On the one surface, as the film 42, a PET film (Lumirror; manufactured by Toray Industries, Inc.) having a thickness of 125 μm was fixed to the frame 14 using a double-sided tape (manufactured by Nitto Denko Corporation). On the other side of the frame 14, an acrylic plate having a thickness of 2 mm and an external size of a frame (square of 20 mm) was fixed as the rear plate 18. In this manner, the soundproof cell 40 having a cell structure that was the single surface film (42) and the single surface sound insulation plate (rear plate 18) was manufactured. One cell of the soundproof cell 40 was called a cell A, and the measurement was performed.

The acoustic characteristics were measured by a transfer function method using four mikes in a self-made acrylic acoustic tube (tubular member 32: refer to FIG. 14). This method is based on "ASTM E2611-09: Standard Test Method for Measurement of Normal Incidence Sound Transmission of Acoustical Materials Based on the Transfer Matrix Method". As the acoustic tube (32), for example, an acoustic tube based on the same measurement principle as WinZac manufactured by Nippon Sound Engineering Co., Ltd. was used. It is possible to measure the sound transmission loss in a wide spectral band using this method. In particular, by measuring the transmittance and the reflectivity at the same time, the absorbance of the sample was also accurately measured. The sound transmission loss was measured in the range of 100 Hz to 4000 Hz. The inner diameter of the acoustic tube (32) is 40 mm, and can be sufficiently measured up to 4000 Hz or higher.

Figure 36:
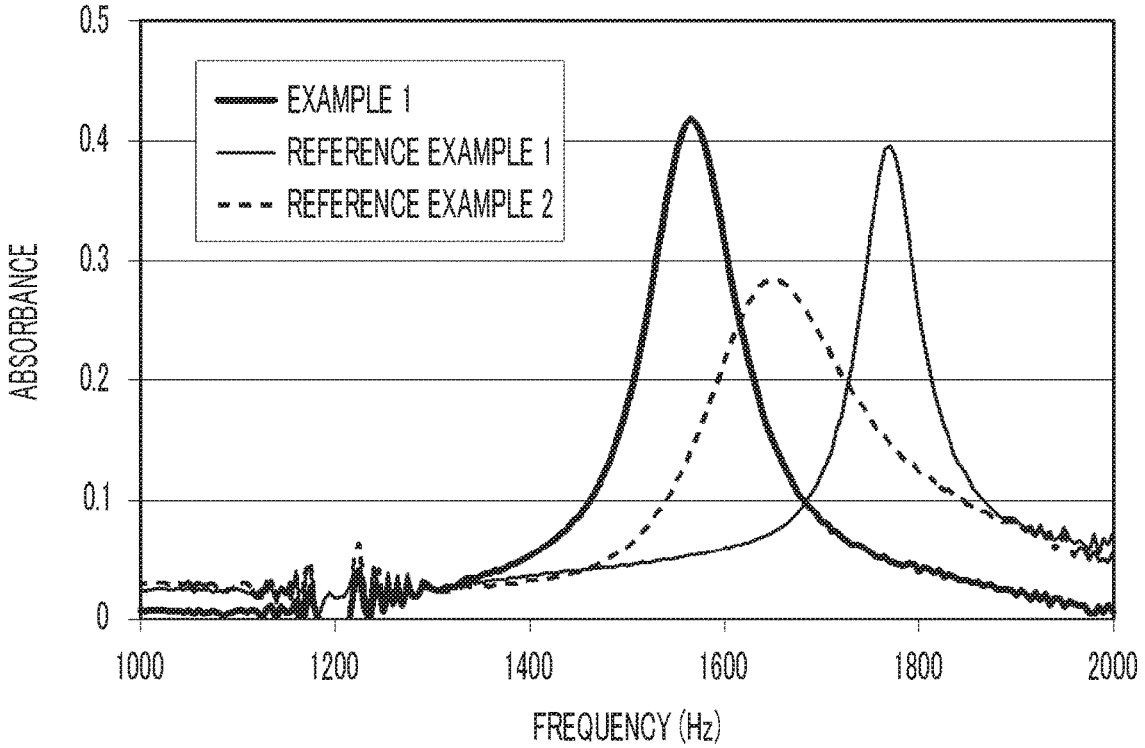
FIG. 36 is a graph showing the sound absorption characteristics of a soundproof structure of Example 1 of the present invention.

The acoustic characteristics of the cell A were measured using the transfer function method. The arrangement was that the film surface of the cell A was perpendicular to the cross section of the acoustic tube (32) (the film surface was parallel to the longitudinal direction of the acoustic tube (32)). Considering the cross section including the cell A, the cell A occupies only 19% of the acoustic tube (32). That is, approximately 81% of the acoustic tube (32) is an opening portion. The absorbances measured in this measurement are shown in FIG. 36. Reference example 1 and the measurement results are shown in Table 1.

Example 1

Next, a total of two cells A described above were manufactured. As in the case of the soundproof structure 0 shown in FIG. 1, as an arrangement in which the film surfaces of the films 42 of the two cells A face each other, the interlayer distance between the film surfaces was adjusted to 1 mm. The acoustic characteristics of the soundproof structure in which the two cells faced each other were measured. As in the soundproof structure 30 shown in FIG. 14, the measurement was performed in the arrangement in which the film surfaces of the two films 42 were perpendicular to the cross section of the acoustic tube 32 (that is, an arrangement in which vibration films (films 42) faced each other, such as the same arrangement as in Reference example 1). Hereinafter, unless otherwise stated, the arrangement was measured by the same arranging method as in Reference Example 1. The measured absorbance is shown in FIG. 36.

Example 1 and the measurement results are shown in Table 1.

In Reference example 1, a frequency at which the absorbance was maximized was 1770 Hz, whereas in Example 1, the frequency was 1565 Hz. In other words, it was found that the frequency of absorption was shifted to the low frequency simply by making the film surfaces of the two films 42 face each other.

Reference Example 2

For the purpose of comparison with a single cell having the same volume as in Example 1, a single cell was manufactured in the same manner as in Reference example 1 without changing the other conditions except that the frame thickness was set to 20 mm instead of 10 mm that was the frame thickness in Reference example 1. That is, the distance between the film 42 and the rear plate 18 facing the film 42 was changed from 10 mm in Reference example 1 to 20 mm. The acoustic characteristics of the single cell were measured, and the absorbance is shown in FIG. 36.

Reference example 2 and the measurement results are shown in Table 1.

The maximum frequency of the absorbance was 1650 Hz. That is, it was found that, in the soundproof structure 30 of Example 1 in which the films faced each other, the absorption peak appeared on the low frequency side even in the case of comparison with the absorption frequency of a single cell having the same volume. Therefore, it can be seen that the sound absorption on the low frequency side, which cannot be reached by a single cell, can be achieved by the soundproof structure 30 in which the films face each other.

Example 2

The soundproof structure 30 in which the films of two cells faced each other was manufactured in the same manner as in Example 1 except that the interlayer distance was set to 2 mm instead of the interlayer distance of 1 mm in Example 1 for the two cells of the cells A. The acoustic characteristics were measured.

Example 3

The soundproof structure 30 in which the films of two cells faced each other was manufactured in the same manner as in Example 1 except that the interlayer distance was set to 3 mm instead of the interlayer distance of 1 mm in Example 1 for the two cells of the cells A. The acoustic characteristics were measured.

Example 4

The soundproof structure 30 in which the films of two cells faced each other was manufactured in the same manner as in Example 1 except that the interlayer distance was set to 0.5 mm instead of the interlayer distance of 1 mm in Example 1 for the two cells of the cells A. The acoustic characteristics were measured.

Figure 37:
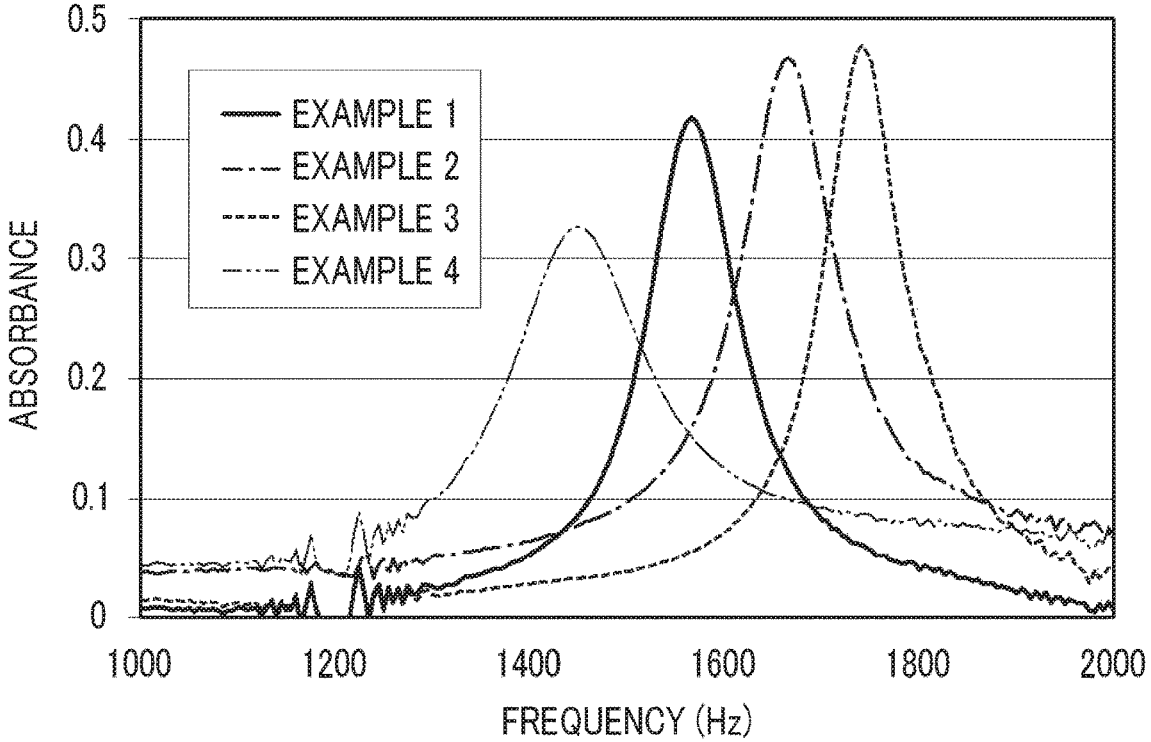
FIG. 37 is a graph showing the sound insulation characteristics of soundproof structures of Examples 1 to 4 of the present invention.

The measurement results of Examples 2 to 4 described above are also shown in FIG. 37 together with the measurement results of Example 1.

The above Examples 2 to 4 and the measurement results are shown in Table 1.

Comparative Example 1

A system in which the interlayer distance between the film surfaces of two cells was increased to 20 mm instead of 1 mm in Example 1 was defined as Comparative example 1.

First, a sample (with an interlayer distance of 1 mm) of the soundproof structure 30 of Example 1 and a sample (single) of Reference example 1 were measured by the acoustic tube 32 having a diameter of 8 cm, and it was confirmed that there was no change in the acoustic tube measurement of 4 cm in diameter and the absorption peak frequency. Next, a sample (with an interlayer distance of 20 mm) of Comparative example 1 was measured.

Comparative example 1 and the measurement results are shown in Table 1.

The absorption peak frequency was 1770 Hz. That is, it was found that there was no change from the sample of Reference example 1 and there was no effect of shifting to the low frequency in a case where the interlayer distance was increased to 20 mm.

Compared with Examples 1 to 4, it was found that, as the interlayer distance between the film surfaces of the soundproof cell 40 (soundproof unit 12) became shorter, the absorption peak frequency was shifted to a lower frequency and changed according to the interlayer distance. In particular, at a level where the interlayer distance is 1 mm or less (Example 1 and Example 4), the absorption peak is located on the low frequency side compared with a single cell having the same volume. Accordingly, it can be seen that this is very useful for small size and low frequencies of absorption.

Reference Example 3

The frame 14 having the opening portion 13 of a square shape having a size of 40 mm, a frame thickness of 15 mm, and a frame width of 5 mm was manufactured using acryl as a material. On the one surface, as the film 42, a PET film (Lumirror; manufactured by Toray Industries, Inc.) having a thickness of 125 μm was fixed to the frame 14 using a double-sided tape (manufactured by Nitto Denko Corporation). On the other side of the frame 14, an acrylic plate having a thickness of 5 mm and an external size of a frame was fixed as the rear plate 18. In this manner, the soundproof cell 40 having a cell structure that was a single surface film and a single surface sound insulation plate was manufactured.

One cell of the soundproof cell 40 is called a cell B. In the cell B, the frame size is large and the rear surface distance is large, compared with those in the cell A. Accordingly, the absorption frequency due to resonance in the cell B appears on the lower frequency side than in the cell A.

The transmittance, reflectivity, and absorbance of the acoustic tube 32 were measured using the acoustic tube 32 having an inner diameter of 80 mm. In this case, the measurement can be sufficiently performed up to 2000 Hz or higher.

Figure 38:
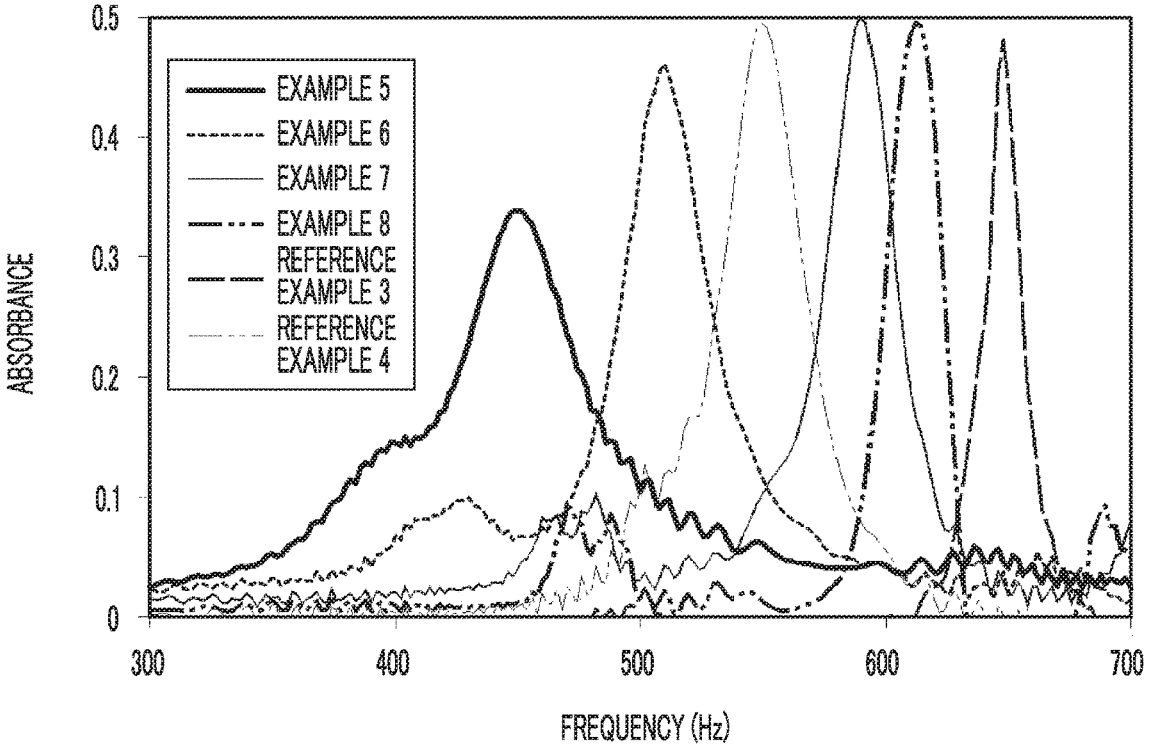
FIG. 38 is a graph showing the sound absorption characteristics of soundproof structures of Examples 5 to 8 of the present invention.

The result is shown in FIG. 38.

Reference example 3 and the measurement results are shown in Table 1.

Examples 5 to 8

Next, a total of two cells B described above were manufactured. As an arrangement in which the film surfaces of the films 42 of the two cells B faced each other, the interlayer distance between the film surfaces were adjusted to 0.5 mm (Example 5), 1 mm (Example 6), 2 mm (Example 7), and 3 mm (Example 8). The acoustic characteristics of the soundproof structure 30 in which the films of the two cells faced each other were measured. The measured absorbance is shown in FIG. 38.

In Examples 5 to 8, it was found that the absorption peak shifted to the lower frequency side and the shift width changed according to the interlayer distance between the vibration films 42, compared with Reference example 3. In Example 5, it can be seen that absorption up to the low frequency side of 452 Hz is possible.

Reference Example 4

Instead of the cell B of Reference example 3, a single cell manufactured without changing the other conditions except that the thickness of 30 mm was set was measured. In this case, the volume of the cell is almost the same as the two cells of Examples 5 to 8. The acoustic tube measurement results are shown in FIG. 38. In Examples 5 and 6 in which the interlayer distance is 1 mm or less, it can be seen that, even in a case where the volume is the same as that in Reference example 4, the frequency can be lowered by bringing the films close to each other rather than simply by increasing the volume of the rear surface structure.

Reference Example 5

As Reference example 5, the soundproof cell (single cell) 40*b* shown in FIGS. 24 and 25 was manufactured.

The frame 14 having a frame structure in which the opening portion 13 had a square shape with a size of 16 mm, the frame thickness was 10 mm, and the frame width was 2 mm was manufactured using acryl as a material. On the one surface, as the perforated plate 46, a holed acrylic plate in which the through-hole (first through-hole) 48 having a diameter of 3 mm was formed in a central portion having a thickness of 2 mm of a square acrylic plate of 20 mm squares was fixed to the portion of the frame 14 using a double-sided tape (manufactured by Nitto Denko Corporation). The perforated plate 46 having the through-hole 48 was manufactured using a laser cutter. On the other side of the frame 14, an acrylic plate having a thickness of 2 mm and an external size of a frame was fixed as the rear plate 18. In this manner, the soundproof cell 40*b* having a cell structure that was a perforated plate having a through-hole on the one surface (46) and a single surface sound insulation plate (rear plate 18) was manufactured. One cell of the soundproof cell 40*b* is called a cell C. Since the cell C has the through-hole 48 to shield the rear surface structure, the cell C functions as a Helmholtz resonator. The acoustic characteristics of the single cell C were measured.

Examples 9 to 11

Two cells C described above were manufactured. As an arrangement in which the film surfaces of two cells faced each other, the interlayer distance between the film surfaces were adjusted to 1 mm (Example 9), 2 mm (Example 10), and 3 mm (Example 11). The acoustic characteristics of the soundproof structure 30 in which the films of the two cells faced each other were measured.

Figure 39:
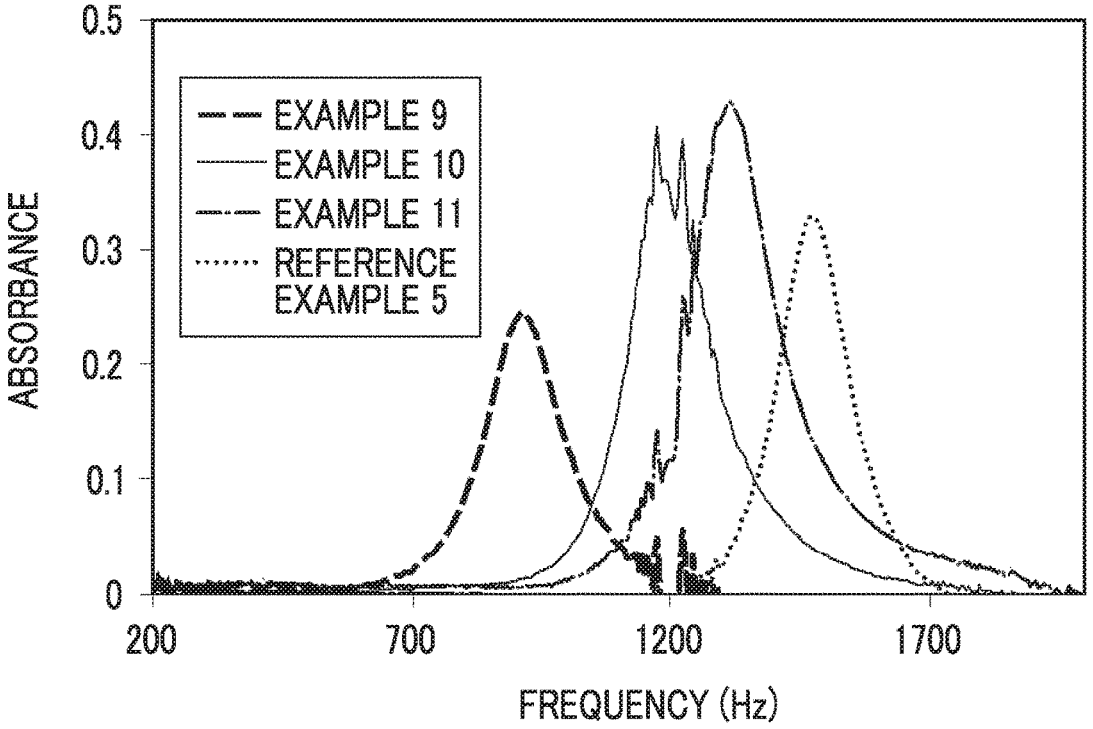
FIG. 39 is a graph showing the sound absorption characteristics of soundproof structures of Examples 9 and 10 of the present invention.

The absorbances measured in Reference example 5 and Examples 9 to 11 are shown in FIG. 39.

Reference example 5 and Examples 9 to 11 and the measurement results are shown in Table 1.

Also in the soundproof structure 30 of the Helmholtz resonance structure, it was found that the absorption frequency was lowered by bringing the perforated plates 46 having through-holes, which were sound absorbing structures, close to each other.

Reference Example 6

As Reference example 6, the soundproof cell (single cell) 40*c* shown in FIGS. 26 and 27 was manufactured.

The frame 14 having a frame structure in which the opening portion 13 had a square shape with a size of 40 mm, the frame thickness was 15 mm, and the frame width was 5 mm was manufactured using acryl as a material. On the one surface, as the micro perforated plate 50, an aluminum foil randomly having the micro through-hole (second through-hole) 52 of about 20 μm was fixed to the portion of the frame 14 using a double-sided tape (manufactured by Nitto Denko Corporation). The average opening diameter of the through-hole 52 is 24 the opening ratio of the surface is 5.3%, and the thickness of the aluminum foil is 20 On the other side of the frame 14, an acrylic plate having a thickness of 5 mm and an external size of a frame was fixed as the rear plate 18. In this manner, the soundproof cell 40*c* having a cell structure in which one surface was a film (micro perforated plate 50) having a plurality of micro through-holes 52 and the other one surface was a sound insulation plate (rear plate 18) was manufactured. As the diameter of the through-hole 52 decreases, contribution to the friction of the through-hole 52 increases. Therefore, compared with a case where the opening diameter is several millimeters such as the case of Helmholtz resonance, the micro through-hole 52 functions satisfactorily as a resistance against the sound, and the band of the frequency to be absorbed becomes wide. One cell of the soundproof cell 40*c* is called a cell D. The acoustic characteristics of the single cell D were measured.

Examples 12 to 15

Two cells D of Reference example 6 were manufactured. As an arrangement in which the film surfaces of two cells faced each other, the interlayer distance between the film surfaces were adjusted to 0.5 mm (Example 12), 1 mm (Example 13), 2 mm (Example 14), and 3 mm (Example 15). The acoustic characteristics of the soundproof structure 30 in which the films of the two cells faced each other were measured.

Figure 40:
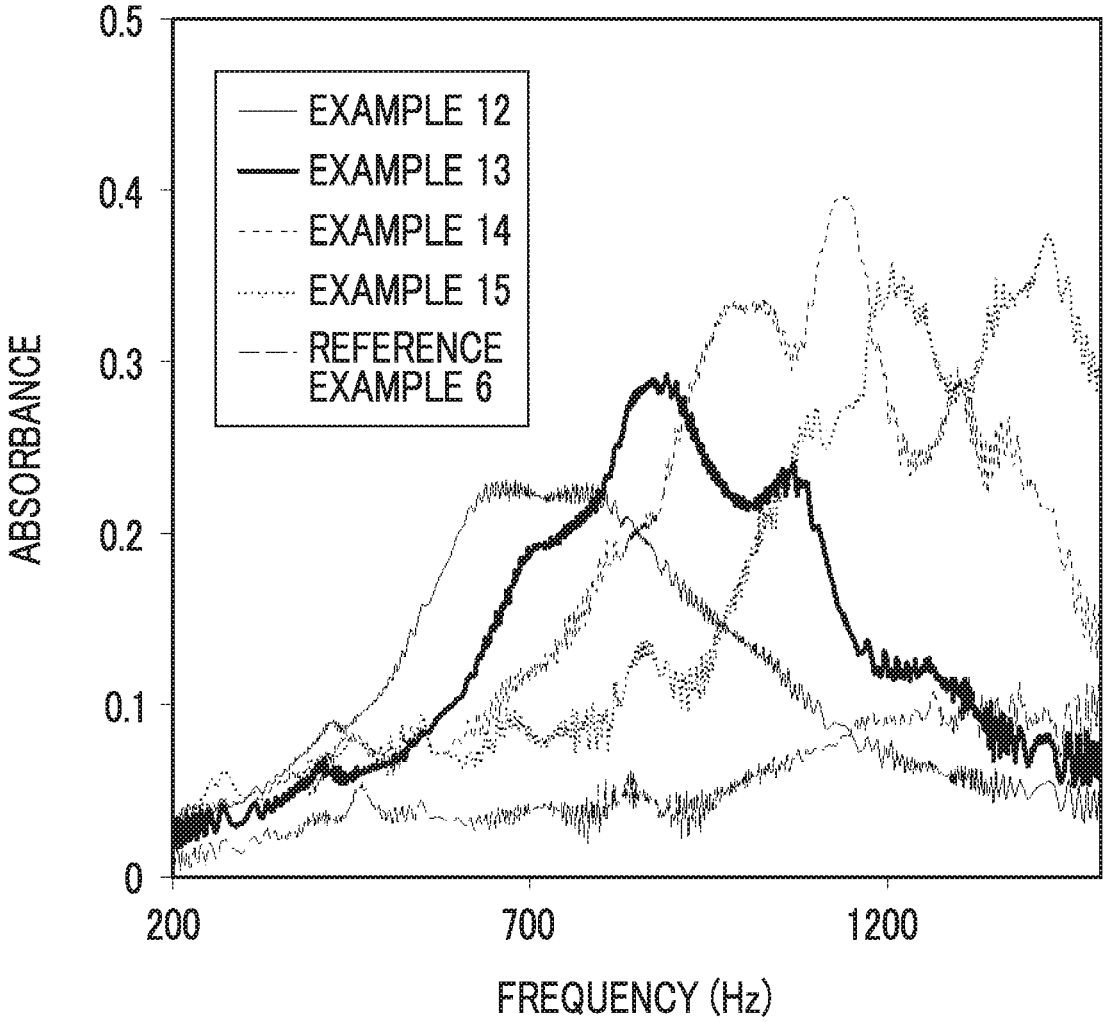
FIG. 40 is a graph showing the sound absorption characteristics of soundproof structures of Examples 12 to 15 of the present invention.

The absorbances measured in Reference example 6 and Examples 12 to 15 are shown in FIG. 40.

Reference example 6 and Examples 12 to 15 and the measurement results are shown in Table 1.

Including Reference example 6, by forming the micro through-hole 52 as a sound absorbing structure, the peak of the absorption spectrum is widened compared with the film vibration or the Helmholtz resonance. On the other hand, since the absorption frequency strongly depends on the size of the rear surface structure, it is difficult to obtain a wide sound absorbing characteristic on the low frequency side while maintaining the size.

In each of the film proximity soundproof structures of Examples 12 to 15, the absorbance is lowered and the peak value is larger than that in the original Reference example 6. Since the characteristics of the absorption spectrum remain wide, low-frequency absorption can be realized while taking the advantages of the micro through-hole sound absorbing structure.

Reference Example 6A

The soundproof cell 40*c* having a cell structure was manufactured in the same manner as in Reference example 6 except that the frame 14 having a "frame structure in which the opening portion 13 had a square shape with a size of 16 mm, the frame thickness was 30 mm, and the frame width was 2 mm" was used instead of the frame 14 having a "frame structure in which the opening portion 13 had a square shape with a size of 40 mm, the frame thickness was 15 mm, and the frame width was 5 mm" in Reference example 6. One cell of the soundproof cell 40*c* is called a cell E.

The acoustic characteristics of the single cell E were measured using an acoustic tube.

Examples 15A and 15B and Comparative Example 4

Two cells E were manufactured, and the interlayer distance between films having a number of micro through-holes as sound absorbing structures was set to 1 mm (Example 15A), 5 mm (Example 15B), and 20 mm (Comparative example 4). The acoustic characteristics of the soundproof structure 30 in which the films of the two cells faced each other were measured by the acoustic tube.

Figure 40A:
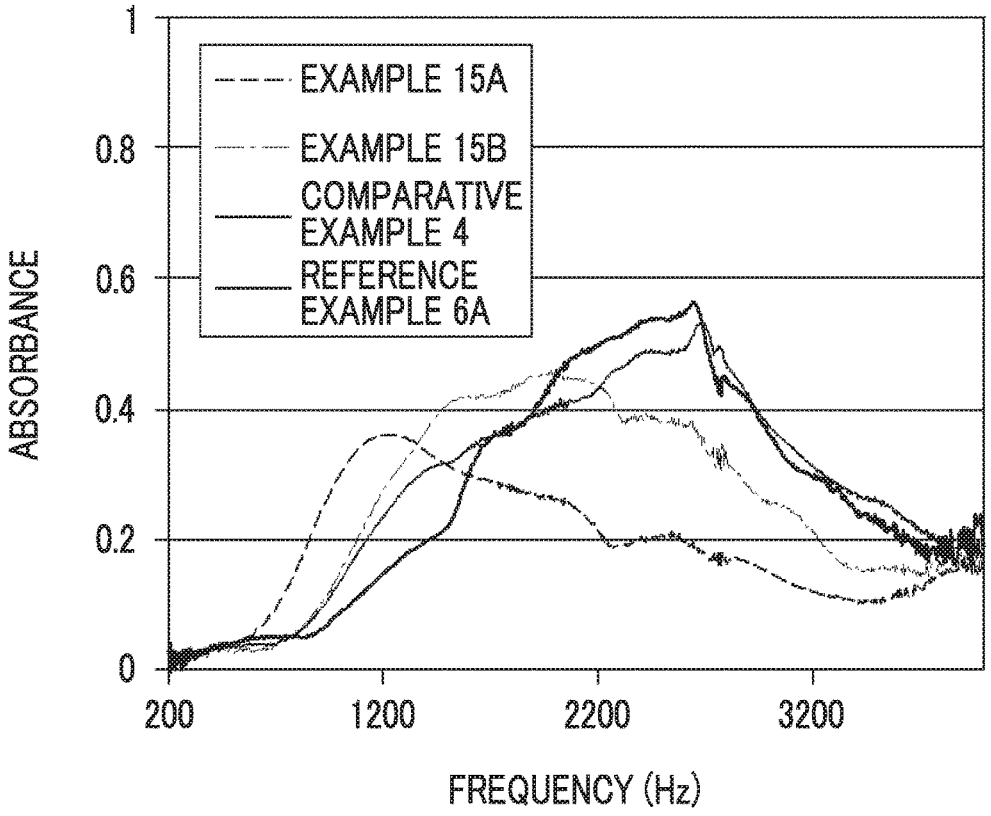
FIG. 40A is a graph showing the sound absorption characteristics of soundproof structures of Examples 15A and 15B of the present invention.

The absorbances measured in Reference example 6A, Examples 15A and 15B, and Comparative example 4 are shown in FIG. 40A.

Reference example 6A, Examples 15A and 15B, Comparative example 4, and the measurement results are shown in Table 1.

Even in the case of Reference example 6A in which the size of the frame 14 was different from that in Reference example 6, it was found that the absorption frequency peak was shifted by changing the interlayer distance between the film surfaces of the two cells E in the soundproof structure 30 using the two cells E (soundproof cells 40*c*) having the frame structures of the frames 14, which were different in size as described above, and the micro perforated plate 50 having the micro through-hole 52.

Examples 16 to 18

The arrangement method and absorption characteristics of the soundproof cell proximity structure were examined. As shown in FIG. 17, each cell A in Examples 4, 1, and 2 was rotated by 90° in the acoustic tube 32 so that the absorption film surface was disposed in parallel to the cross section of the acoustic tube 32. The acoustic characteristics of each soundproof structure 30*c* having an interlayer distance of 0.5 mm (Example 16), 1 mm (Example 17), and 2 mm (Example 18) were measured in the same manner as in Example 1.

Figure 41:
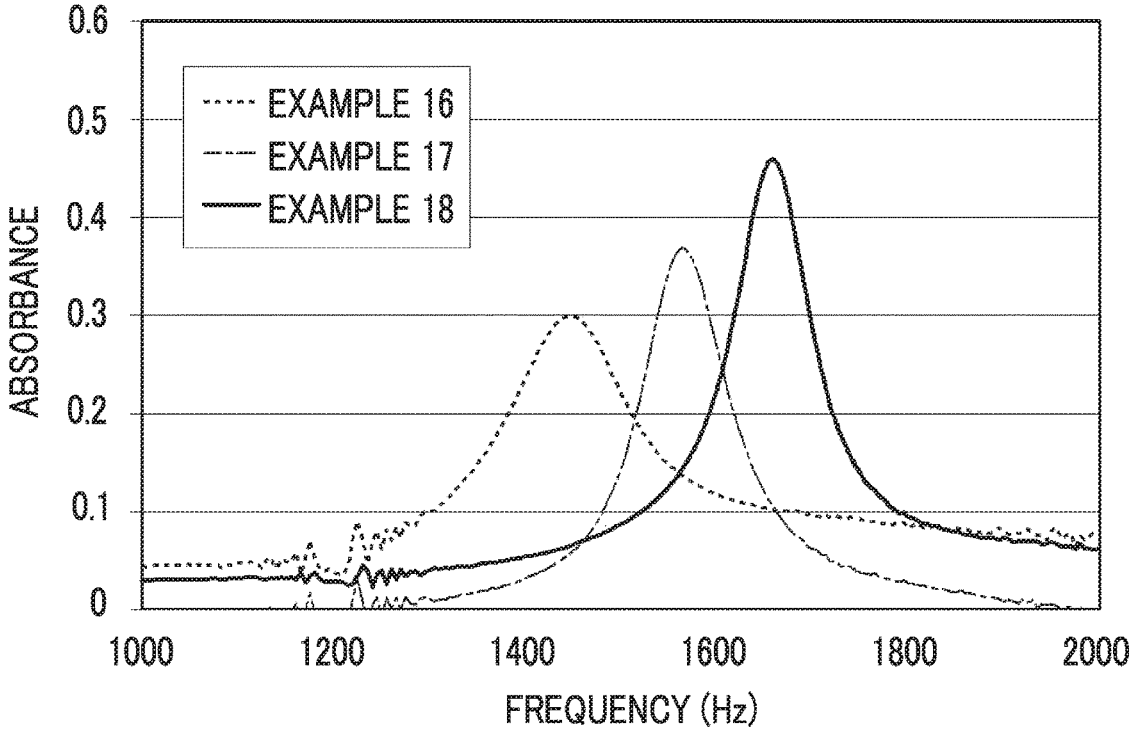
FIG. 41 is a graph showing the sound insulation characteristics of soundproof structures of Examples 16 to 18 of the present invention.

The measured absorption spectrum is shown in FIG. 41.

Examples 16 to 18 and the measurement results are shown in Table 2.

As can be seen from FIG. 41 and Table 2, the absorption peak frequency hardly changed in both a case where the arrangement method was based on the direction in Examples 4, 1 and 2 and a case where the arrangement method was based on the direction in Examples 16 to 18. Therefore, it was found that there was robustness with respect to the cell direction.

Examples 19 and 20

An effect in a case where a plurality of soundproof unit sets 24 of a soundproof cell proximity structure were arranged was examined.

Two pairs of the structure of Example 4 having an interlayer distance of 0.5 mm were manufactured and arranged in series. The arrangement method was two types of arrangements of the arrangement of Example 19, which was an arrangement based on the same arrangement method as in Example 4 like the soundproof structure 30*a* shown in FIG. 15, and the arrangement of Example 20, which was an arrangement based on the same arrangement method as in Example 16 like the soundproof structure 30*d* shown in FIG. 18, and the acoustic characteristics were measured.

Figure 42:
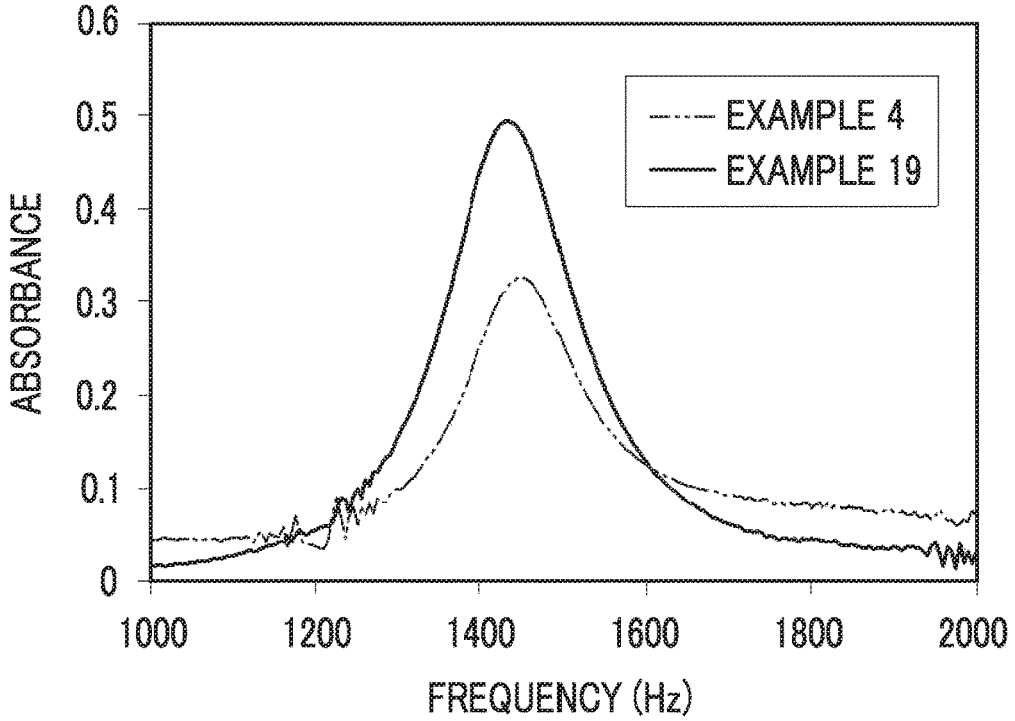
FIG. 42 is a graph showing the sound absorption characteristics of soundproof structures of Examples 4 and 19 of the present invention.
Figure 43:
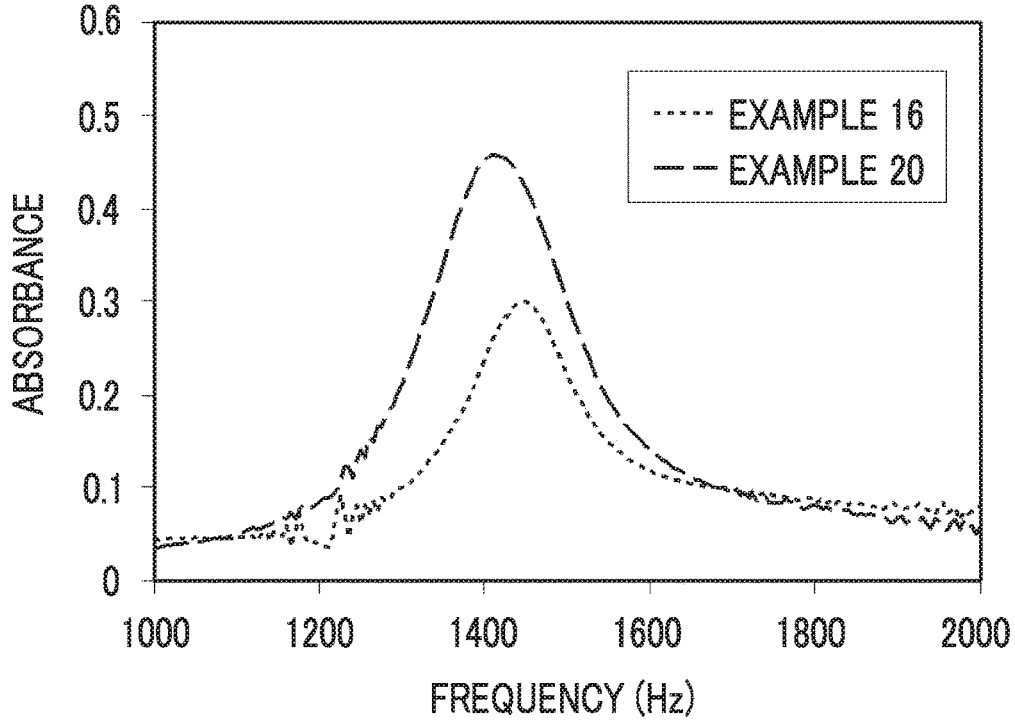
FIG. 43 is a graph showing the sound absorption characteristics of soundproof structures of Examples 16 and 20 of the present invention.

The measurement result of Example 19 is shown in FIG. 42 together with the measurement result of Example 4, and the measurement result of Example 20 is shown in FIG. 43 together with the measurement result of Example 16.

Examples 19 and 20 and the measurement results are shown in Table 2.

In both cases, the absorption peak in a case where cells are connected is higher than that in the case of one cell. Therefore, it is possible to obtain a desired absorbance by using a plurality of absorber proximity structures.

Examples 21 and 22

The effect of a soundproof structure 30*b* in which a plurality of soundproof unit sets 24 of absorber proximity structures having different configurations were arranged was examined.

The structure of Example 4 having an interlayer distance of 0.5 mm and the structure of Example 2 having an interlayer distance of 2 mm were manufactured and arranged in series. Measurement was performed in two types of arrangements of a configuration (Example 21), which was an arrangement opposite to the arrangement of the soundproof structure 30*b* shown in FIG. 16 and in which the soundproof unit set 24 having an interlayer distance of 0.5 mm was disposed on the speaker side (sound incidence side) and the soundproof unit set 24 having an interlayer distance of 2 mm was disposed thereafter (on the downstream side), and a configuration (Example 22), in which the soundproof unit set 24 having an interlayer distance of 2 mm from the speaker side and the soundproof unit set 24 having an interlayer distance of 0.5 mm were disposed in this order as in the soundproof structure 30*b* shown in FIG. 16.

Figure 44:
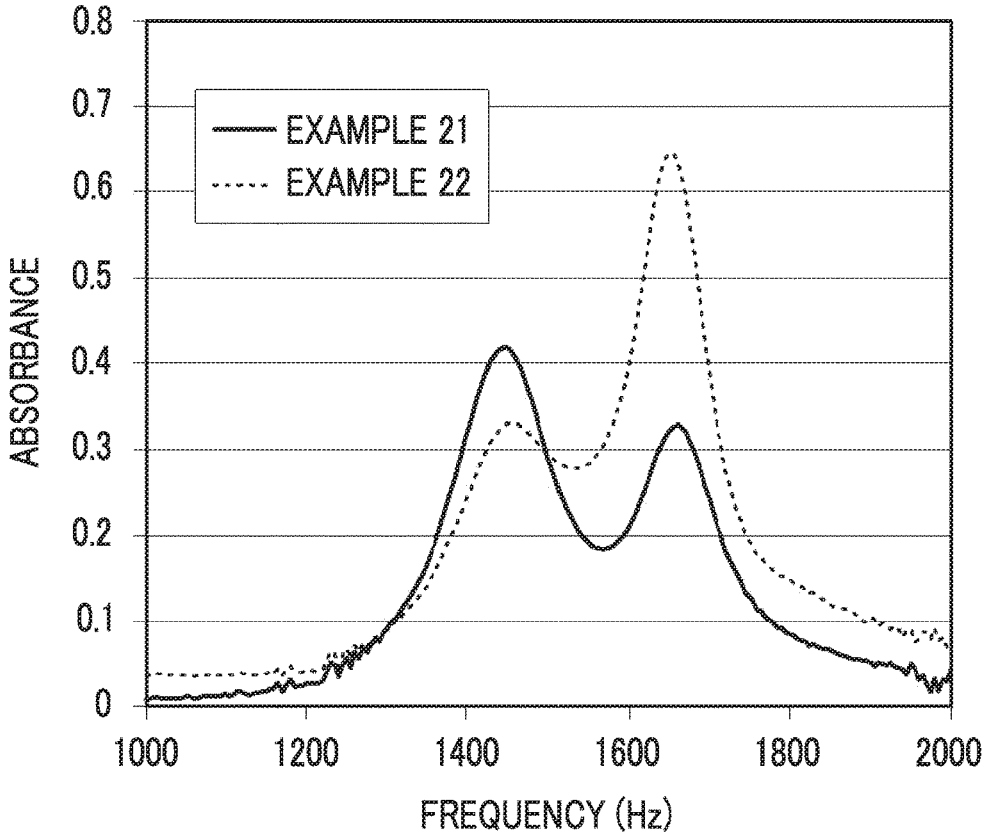
FIG. 44 is a graph showing the sound absorption characteristics of soundproof structures of Examples 21 and 22 of the present invention.

The measurement result is shown in FIG. 44.

Examples 21 and 22 and the measurement results are shown in Table 2.

A double peak structure corresponding to the absorption peak of each soundproof structure is obtained. It was also found that that the absorbance at the absorption peak frequency of a device (soundproof unit set 24) disposed on the speaker side was large.

Examples 23 to 27 and Reference Example 7

Figure 45:
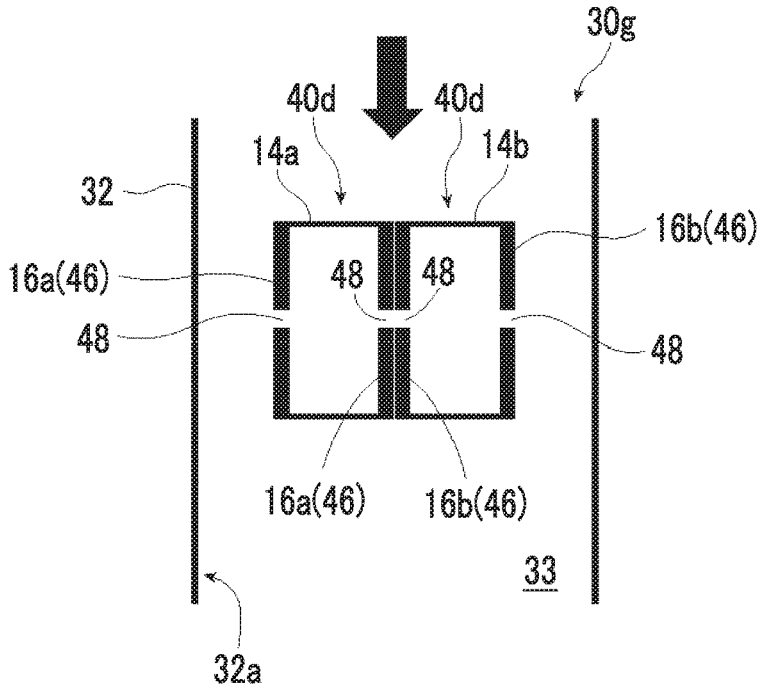
FIG. 45 is a schematic cross-sectional view of an example of a soundproof structure according to another embodiment of the present invention.

As a case where both surfaces were sound absorbing members 16 (16*a*, 16*b*) and were open as in a soundproof structure 30*g* shown in FIG. 45, the through-hole 48 was formed in the perforated plate 46 having both surfaces that were the sound absorbing members 16, and two soundproof cells 40*d* were arranged with the soundproof cell 40*d* functioning like the Helmholtz resonance as a basis. Measurement was performed while changing the interlayer distance between the film surfaces of the two soundproof cells 40*d*.

The frame 14 having a frame structure in which the opening portion 13 had a square shape with a size of 16 mm, the frame thickness was 10 mm, and the frame width was 2 mm was manufactured using acryl as a material. On both the surfaces, as the perforated plate 46, a holed acrylic plate in which the through-hole 48 having a diameter of 2 mm was provided in a central portion having a thickness of 2 mm of a square acrylic plate of 20 mm squares was fixed to the portion of the frame 14 using a double-sided tape (manufactured by Nitto Denko Corporation). The perforated plate 46 having the through-hole 48 was manufactured using a laser cutter. In this manner, the soundproof cell 40*d* of a single cell structure that was the perforated plate 46 having a through-hole on both surfaces was manufactured.

The soundproof cell 40*d* of the single cell structure was referred to as Reference example 7, and the acoustic characteristics were measured. Reference example 7 and the measurement results are shown in Table 2.

In Reference example 7, an absorption peak due to the Helmholtz resonance phenomenon appeared at 1408 Hz.

Figure 46:
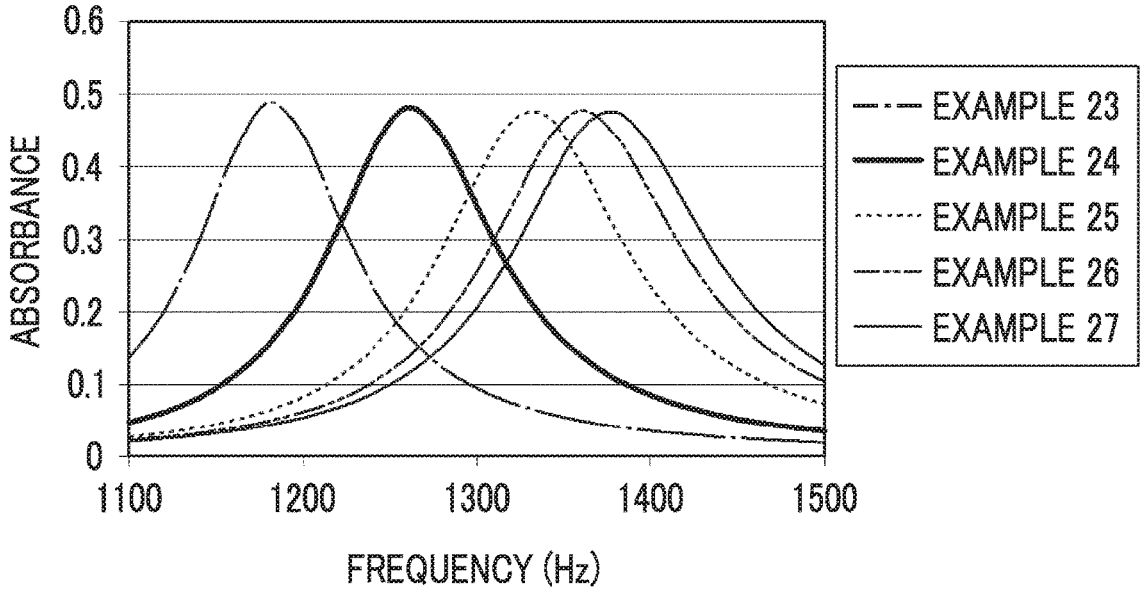
FIG. 46 is a graph showing the sound absorption characteristics of soundproof structures of Examples 23 to 27 of the present invention.

Next, two cells of the soundproof cells 40*d* of the above-described single cell structure were manufactured, and the acoustic characteristics of each soundproof structure 30*g* were measured in a case where the interlayer distance between the two soundproof cells 40*d* was 0.5 mm (Example 23), 1 mm (Example 24), 2 mm (Example 25), 3 mm (Example 26), and 4 mm (Example 27). The measurement result is shown in FIG. 46.

Examples 23 to 27 and the measurement results are shown in Table 2.

It was found that, even in a case where both surfaces were absorbing structures and opened, a low frequency of the absorption peak occurred by bringing the surfaces close to each other and the shift amount depended on the interlayer distance. Compared with Reference example 7, it can be seen that in all of Examples 23 to 27, the frequency is shifted lower than the absorption frequency of the single soundproof cell 40*d*.

Examples 28 to 33

The soundproof structure 30 (refer to FIG. 14) having a Helmholtz resonance structure with a rear surface volume larger than in Example 9 was manufactured. By decreasing the interlayer distance, it was examined whether or not the effect of frequency lowering due to the decrease would occur on the lower frequency side.

The frame 14 having a frame structure in which the opening portion 13 had a square shape with a size of 40 mm, the frame thickness was 10 mm, and the frame width was 2 mm was manufactured using acryl as a material. On the one surface, as the perforated plate 46, a holed acrylic plate in which the through-hole 48 having a diameter of 2 mm was provided in a central portion having a thickness of 2 mm of a square acrylic plate of 44 mm squares was fixed to the portion of the frame 14 using a double-sided tape (manufactured by Nitto Denko Corporation). On the other side of the frame 14, an acrylic plate having a thickness of 2 mm and an external size of a frame was fixed as the rear plate 18. In this manner, the soundproof cell 40*b* (refer to FIGS. 24 and 25) having a single cell structure that was a plate having a through-hole on the one surface (perforated plate 46) and a single surface sound insulation plate (rear plate 18) was manufactured.

The soundproof cell 40*b* of the single cell structure was referred to as Reference example 8, and the acoustic characteristics were measured. Reference example 8 and the measurement results are shown in Table 2.

In Reference example 8, an absorption peak due to the Helmholtz resonance phenomenon appeared at 400 Hz.

Next, two soundproof cells 40*b* having the above-described single cell structure were manufactured. The hole surfaces of the perforated plates 46 were disposed so as to face each other, and the interlayer distance between the two soundproof cells 40*b* was changed.

The acoustic characteristics of each soundproof structure 30 were measured in a case where the interlayer distance was 0.2 mm (Example 28), 0.4 mm (Example 29), 0.6 mm (Example 30), 0.8 mm (Example 31), 1 mm (Example 32), and 5 mm (Example 33).

The measurement result is shown in Table 2.

Even in a low frequency region equal to or lower than 500 Hz, the effect of frequency lowering due to proximity appeared, and the frequency shifted to the lower frequency side than the absorption frequency of the single cell of Reference Example 8. In the case of Example 28 in which the proximity was the highest, it was found that the absorption effect occurred at 161 Hz. Therefore, it can be seen that this functions effectively as a method of absorbing the low frequency side relatively small.

Examples 34 and 35

For a slit between two films, by blocking the slit by arranging a plate or the like to confine the sound, a low-frequency sound absorption effect can be expected. In contrast to the configuration of Example 4, a configuration in which the plate 22 was disposed on the back side as in the soundproof structure 10*e* shown in FIG. 7 was referred to as Example 34, and a configuration in which three directions other than the sound incidence direction were blocked by the plates 22 and 23 as in the soundproof structure 10*f* shown in FIG. 8 was referred to as Example 35. Measurement was performed for each of the configurations.

The result is shown in Table 2.

It can be thought that, by blocking the slit 20 except in the sound incidence direction, the sound pressure increases in the slit 20, so that the state changes and the low frequency shift occurs.

Examples 36 to 40

In the soundproof cell 40 (refer to FIG. 21) due to film vibration, it is known that the resonance peak of absorption appears on the lower frequency side as the size of the film 42 becomes larger. In the configuration of the soundproof structure according to the embodiment of the present invention, the interlayer distance between the film surfaces of the film 42 of the two soundproof cells 40 is reduced. It is possible to increase the size of the film 42 while maintaining the total volume of the two soundproof cells 40.

Figure 6:
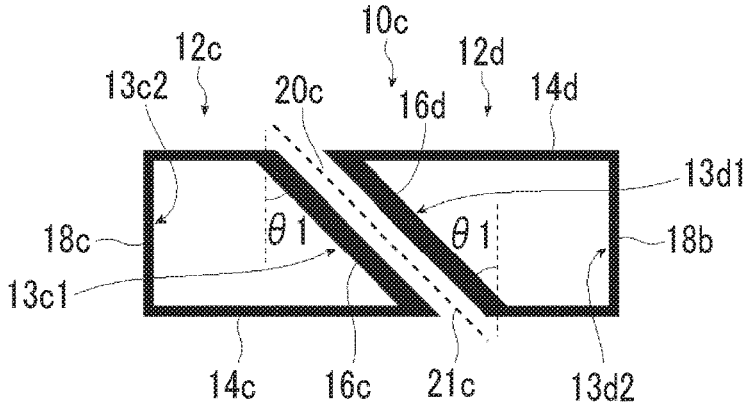
FIG. 6 is a schematic cross-sectional view of an example of a soundproof structure according to another embodiment of the present invention.

Therefore, as in the soundproof structure 10*c* shown in FIG. 6, two cells (soundproof units 12*c* and 12*d*) facing each other can be shaped to have trapezoidal cross sections having obliquely inclined sides (sound absorbing members 16*c* and 16*d*), and these can be made to face each other. The angle of the inclined side was set to θ1, and cells in which θ1 was changed were manufactured. As in Example 1, a PET having a thickness of 125 μm was used as a film (sound absorbing members 16*c* and 16*d*), and the opening of each cell on the rear surface side was a square of 16 mm squares as in Example 1. The frame width of the frame 14 was also set to 2 μm. The frames 14 were manufactured so that the angle of θ1 was 10° (Example 36), 20° (Example 37), 30° (Example 38), and 40° (Example 39), and two cells in which the PET film was fixed to each frame were manufactured for each angle. Using these as a pair, the interlayer distance between the films (sound absorbing members) was set to 1 mm, and the acoustic characteristics of each soundproof structure 10*c* were measured.

Measurement results, such as an absorption peak frequency, are shown in Table 3. As θ increases, the film size increases, and the absorption peak frequency is shifted to the lower frequency side.

In addition, in Example 40, a result is shown in a case where the interlayer distance is reduced to 0.2 mm in the configuration of Example 39 in which the frequency is shifted to the lowest frequency side. It was found that, even in a case where the film was inclined, shift of the absorption frequency due to the interlayer distance occurred and the frequency was lowered due to the reduction in the interlayer distance.

Examples 41 to 44

A positional shift between cells was examined.

As in the soundproof structure 10*a* shown in FIG. 4, the relationship between a positional shift 6 in a direction within the film surface (between the sound absorbing members 16*a* and 16*b*) and the frequency shift amount was examined.

In the configuration of the interlayer distance of 1 mm in Example 1, the shift amount δ in the parallel direction was set to 4 mm, 8 mm, 12 mm, and 16 mm (Examples 41 to 44). Since the frame size (the size of the opening portion 13) was 16 mm, shifting occurred by ¼ of the frame size. The acoustic characteristics of these soundproof structures 10*a* were measured.

The obtained frequency shift amount is shown in Table 3. It can be seen that, in a case where the shift amount is 16 mm, that is, in a case where shifting occurs by the frame size, the frequency shift is only 3 Hz due to the frequency difference from the single cell state of Reference example 1. Therefore, it is desirable that the sound absorbing members have areas facing each other. In order to lower the frequency, it is more desirable that the sound absorbing members overlap each other as much as possible.

On the other hand, even with positional shift in the film (sound absorbing member) direction, the frequency changes as shown in the table. Therefore, as a method for adjusting the frequency, the frequency can also be adjusted by shifting the cells in a direction parallel to the film surface in addition to changing the interlayer distance between the film surfaces. It was also possible to confirm that the frequency peak amount was continuously changed by changing the shift amount continuously in practice.

Examples 45 to 50

Cell Parallelism

The relationship of the frequency shift amount was examined in a case where the film surfaces (the surfaces of the sound absorbing members 6*a* and 16*b*) of the soundproof cells (soundproof units 12*a* and 12*b*) having absorbing structures facing each other were disposed so as to be inclined as in the soundproof structure 10*b* shown in FIG. 5.

First, for the film surfaces (sound absorbing members) of the soundproof cells facing each other with an interlayer distance of 1 mm between the film surfaces, corresponding to Example 1, the angle θ was changed to 0° (Example 1), 2.5° (Example 45), and 5° (Example 46). Here, the "interlayer distance" is defined as the average of the interlayer distances between films facing each other. That is, in the case of rotation around the central portion of the film, the "distance" does not change. In order to geometrically keep the average distance between the sound absorbing members 1 mm and make the two cells not in contact with each other, only rotation up to about 5° is allowed. The acoustic characteristics of these soundproof structures 10*b* were measured.

The obtained frequency shift amount is shown in Table 3.

As shown in Table 3, the frequency hardly changed with respect to rotation.

Then, for a soundproof cell of an absorbing structure adjusted to have a distance 3 mm instead of the distance of 1 mm in the same manner as described above, the angle θ was changed every 5° from 0° to 15° (Examples 47 to 50).

The acoustic characteristics of these soundproof structures 10*b* were measured.

The obtained frequency shift amount is shown in Table 3.

Also in this case, the absorption peak frequency hardly changed.

Therefore, it was found that as long as the average distance between the film surfaces of the soundproof cells was kept, even if there was a slope in parallelism between the films, the absorption peak frequency hardly changed.

Reference Examples 9 and 10

As Reference example 9, in the same manner as in Reference example 5 except for the size (frame size) of the opening portion 13 of the frame 14 and the through-hole diameter of the through-hole (first through-hole) 48 of the holed acrylic plate that was the perforated plate 46, the soundproof cell 40*b* (Helmholtz resonance type soundproof cell: refer to FIGS. 24 and 25) comprising the frame 14, which had a frame structure having the opening portion 13 of a square shape having a size of 20 mm, a frame thickness of 10 mm, and a frame width of 2 mm, and the perforated plate 46 having the through-hole 48 having a through-hole diameter of 2 mm were manufactured by using acryl as a material. The acoustic characteristics of the single soundproof cell 40*b* were measured.

As Reference example 10, the soundproof cell 40*b* having a through-hole diameter of 3 mm, instead of 2 mm, of the through-hole 48 in Reference example 9 was manufactured, and the acoustic characteristics were similarly measured.

Examples 51 to 54

The soundproof structure 30 was configured within the acoustic tube such that a cell having the above-described through-hole diameter of 2 mm and a cell having a through-hole diameter of 3 mm faced each other and the interlayer distance between the surfaces of the perforated plates 46 was reduced, and the acoustic characteristics were measured. The positions of the through-holes 48 were adjusted so that the centers of the through-hole 48 matched each other.

The interlayer distance was set to 0.5 mm, 1 mm, 2 mm, and 3 mm (Examples 51 to 54).

Figure 47:
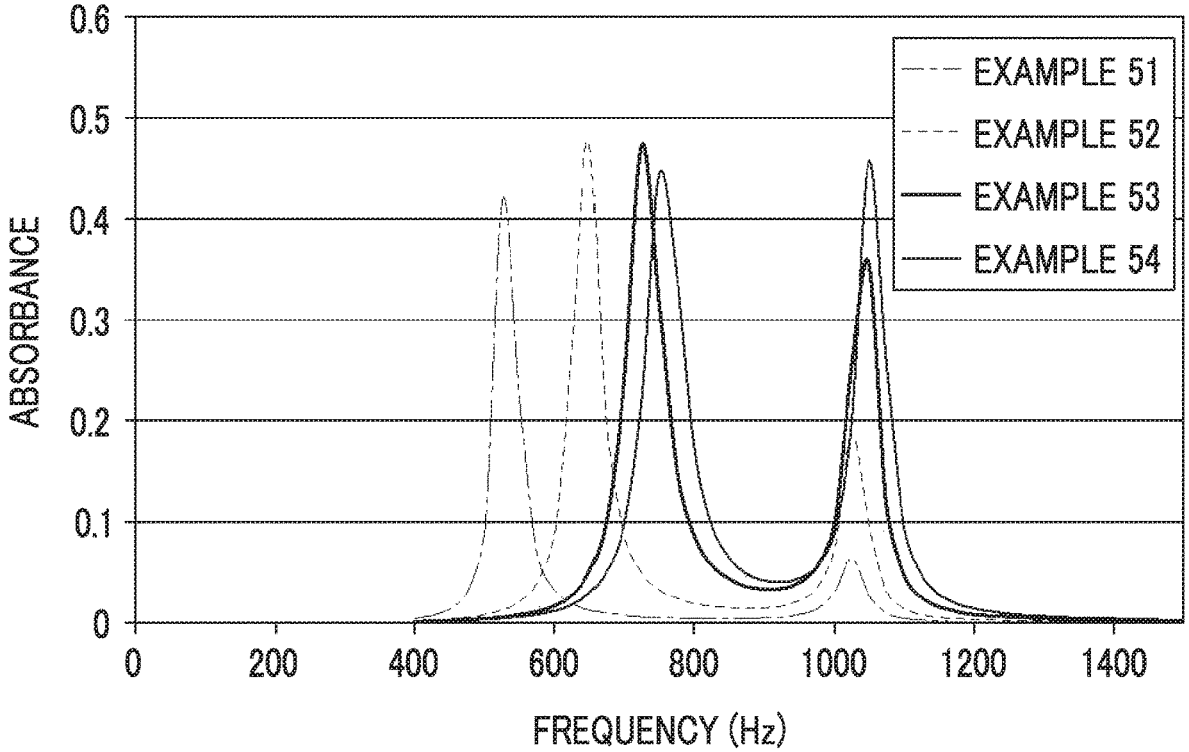
FIG. 47 is a graph showing the sound absorption characteristics of soundproof structures of Examples 51 to 54 of the present invention.

The measured absorbance is shown in FIG. 47. The measurement results of Examples 51 to 54 including Reference examples 9 and 10 are shown in Table 3, and the absorption peak frequencies are summarized in Table 3.

As shown in FIG. 47, by combining different resonance cells (resonance type soundproof cells), two absorption peaks appeared. As shown in Table 3, the absorption peak frequency on the high frequency side is not changed much according to the distance, and is considered to correspond to the measurement of a single resonance cell having a through-hole diameter of 3 mm, that is, resonance having a resonance absorption peak on the high frequency side.

On the other hand, in these examples, it can be seen that the resonance absorption peak on the low frequency side is largely shifted to the lower frequency side in a case where the interlayer distance becomes larger. In a case where the interlayer distance is 0.5 mm, the resonance absorption peak is shifted to the low frequency side of 275 Hz as compared with a single resonance cell having a through-hole diameter of 2 mm.

As described above, it was found that, even in a case where the distance between different resonance cells was reduced, shifting of the resonance absorption peak frequency appeared by changing the interlayer distance.

The characteristics of different resonance cells can be summarized as follows.

1. For the absorption peak on the low frequency side, the resonance frequency is largely shifted depending on the interlayer distance. On the other hand, the absorption amount is not changed much according to the interlayer distance.

2. The resonance frequency at the absorption peak on the high frequency side is hardly shifted according to the interlayer distance. On the other hand, the absorption amount is small in a case where the interlayer distance is small, and is increased by increasing the interlayer distance.

Reference Example 11

As Reference example 11, in the same manner as in Reference example 2 except that a fiber sheet was used instead of the vibration film (film 42), a fiber sheet type soundproof cell (single cell) was manufactured in which the distance between the fiber sheet and the rear plate facing the fiber sheet was 20 mm.

That is, a frame having an opening portion of a square shape having a size of 16 mm, a frame thickness of 20 mm, and a frame width of 2 mm was manufactured using acryl as a material. On the one surface, a sheet of tissue paper having a thickness of about 40 μm ("Elieres luxury moisturizing" manufactured by Daio Paper Mills Co., Ltd.) was fixed to the portion of the frame using a double-sided tape (manufactured by Nitto Denko Corporation), and the rear surface was closed with an acrylic plate.

Examples 55 to 58 and Comparative Example 5

Two cells of Reference example 11 were manufactured and disposed so that the fiber sheets of the two cells faced each other. As the arrangement of two cells, the distance between the fiber sheets was adjusted to 1 mm (Example 55), 2 mm (Example 56), 3 mm (Example 57), 5 mm (Example 58), and 20 mm (Comparative example 5).

Figure 49:
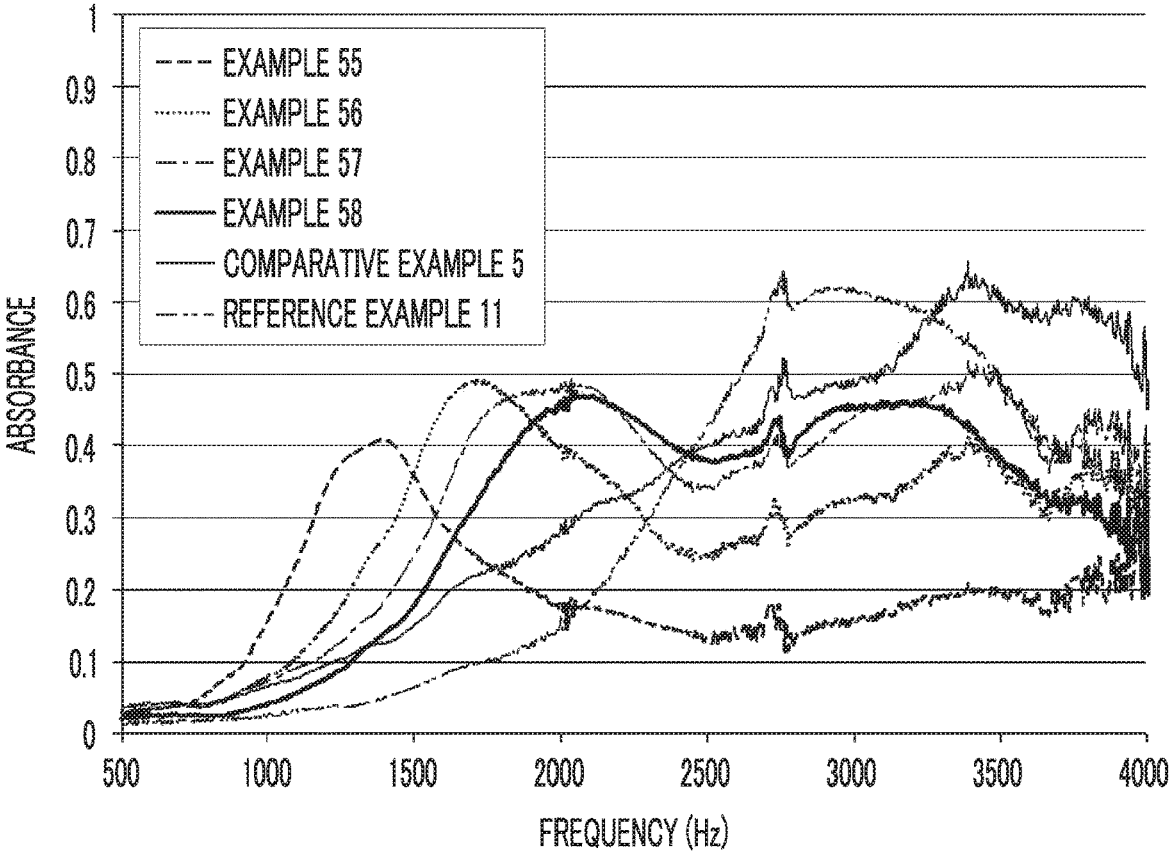
FIG. 49 is a graph showing the sound absorption characteristics of soundproof structures of Examples 55 to 58 of the present invention.

The absorbances measured in Reference example 11, Examples 55 to 58, and Comparative example 5 are shown in FIG. 49.

Reference example 11, Examples 55 to 58, Comparative example 5, and the measurement results are shown in Table 4.

It was obvious that the absorption peak shifted to the lower frequency side as the distance between two fiber sheet type soundproof cells became shorter.

Reference Examples 12 and 13

As Reference example 12, a Helmholtz resonance type soundproof cell was manufactured in the same manner as in Reference example 5 except for the frame thickness of the frame 14, the thickness of the perforated plate 46, and the shape of the through-hole 48.

That is, a frame having an opening portion of a square shape having a size of 16 mm, a frame thickness of 20 mm, and a frame width of 2 mm was manufactured using acryl as a material. On the one surface, as the perforated plate 46, a holed acrylic plate which had a plate thickness of 5 mm and in which a square through-hole having one side of 5 mm was formed in a central portion was fixed, and the rear surface was closed with the acrylic plate.

As Reference example 13, a Helmholtz resonance type soundproof cell was manufactured in the same manner as in Reference example 12 except that the plate thickness of the perforated plate was changed to 2 mm.

Examples 59 to 63 and Comparative Example 6

The soundproof cell manufactured in Reference example 12 and the soundproof cell manufactured in Reference example 13 were disposed so as to face each other. As the arrangement of two cells, the distance between the perforated plates was adjusted to 1 mm (Example 59), 2 mm (Example 60), 3 mm (Example 61), 5 mm (Example 62), 10 mm (Example 63), and 20 mm (Comparative example 6).

Figure 50:
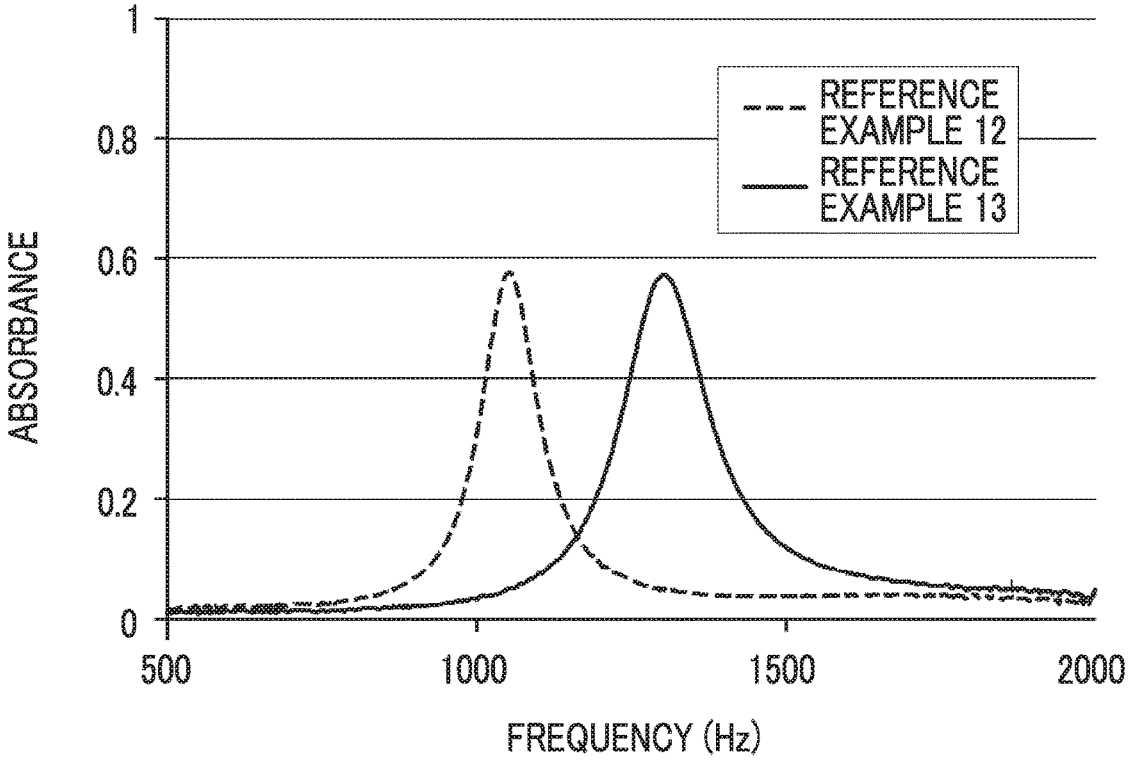
FIG. 50 is a graph showing the sound absorption characteristics of soundproof structures of Reference examples 12 and 13 of the present invention.
Figure 51:
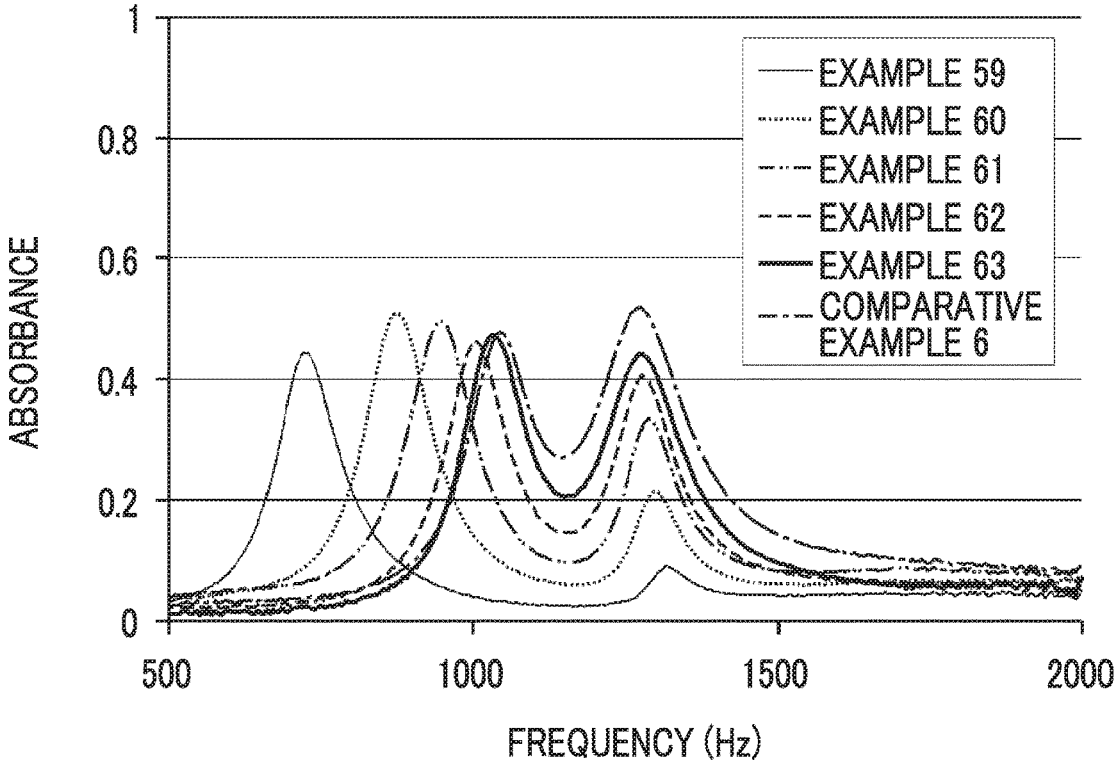
FIG. 51 is a graph showing the sound absorption characteristics of soundproof structures of Examples 59 to 63 of the present invention.

The absorbances measured in Reference examples 12 and 13 are shown in FIG. 50, and the absorbances measured in Examples 59 to 63 and Comparative example 6 are shown in FIG. 51.

Reference examples 12 and 13, Examples 59 to 63, Comparative example 6, and the measurement results are shown in Table 5.

As shown in FIG. 51, by combining resonance cells (resonance type soundproof cells) having different plate thicknesses of perforated plates, two absorption peaks appeared. As shown in Table 5, it can be seen that the absorption peak frequency on the high frequency side is not changed much at the distance between cells, while the resonance absorption peak on the low frequency side is largely shifted to the lower frequency side as the distance between the cells becomes shorter.

As described above, it was found that, even in a case where the distance between the resonance cells having different plate thicknesses of perforated plates was reduced, shifting of the resonance absorption peak frequency appeared by changing the distance between the cells as in Examples 51 to 54.

Reference Examples 14 to 16

A cell with glass wool in a closed space behind the perforated plate 46 of the soundproof cell 40*b* of Reference example 5 shown in FIGS. 24 and 25 and a cell without glass wool in the closed space were manufactured.

That is, a single cell in which glass wool having a flow resistivity of 20000 (Pa s/m$^2$) was not put in the closed space of a cell having a distance of 10 mm between the perforated plate 46 and the rear plate facing the perforated plate 46 (Reference example 14), a single cell containing glass wool with a thickness of 5 mm (Reference example 15), and a single cell containing glass wool with a thickness of 10 mm (Reference example 16) were prepared. The cell of Reference example 15 is in a state in which glass wool is disposed on the rear surface side spaced apart from the through-hole, and the cell of Reference example 16 is in a state in which the closed space behind the perforated plate 46 is filled with glass wool.

Examples 64 to 81

Two single cells of each of Reference examples 14 to 16 were manufactured and disposed so that the cells having the same configuration faced each other. As the arrangement of two cells, the distance between the cells was adjusted to 0.5 mm (Examples 64 to 66), 1 mm (Examples 67 to 69), 2 mm (Examples 70 to 72), 3 mm (Examples 73 to 75), 5 mm (Examples 76 to 78), and 10 mm (Examples 79 to 81).

Figure 52:
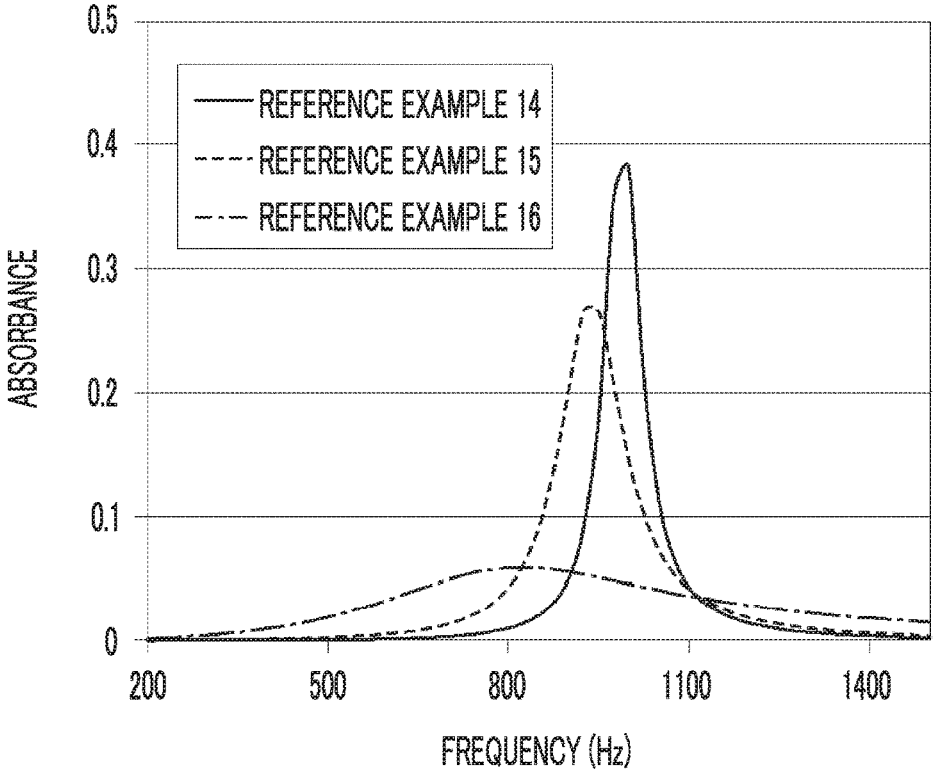
FIG. 52 is a graph showing the sound absorption characteristics of soundproof structures of Reference examples 14 to 16 of the present invention.
Figure 53:
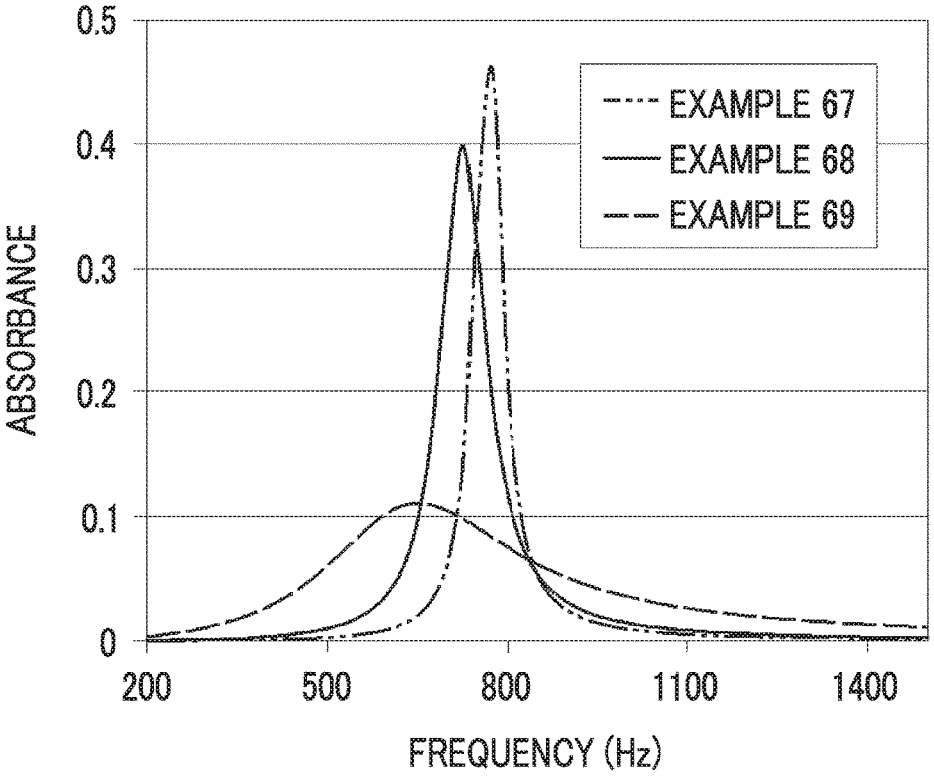
FIG. 53 is a graph showing the sound absorption characteristics of soundproof structures of Examples 67 to 69 of the present invention.

The absorbances measured in Reference examples 14 to 16 are shown in FIG. 52, and the absorbances measured in Examples 67 to 69 in which the distance between two cells was adjusted to 1 mm are shown in FIG. 53.

Reference examples 14 to 16, Examples 64 to 81, and the measurement results are shown in Table 4.

From FIG. 52, it can be seen that the absorption peak is highest in a case where no glass wool is put in the closed space behind the perforated plate 46. In addition, it can be seen that the absorption frequency band is widened in a case where the closed space behind the perforated plate 46 is filled with glass wool (that is, in a case where glass wool with a large thickness is put).

In a case where the absorbances measured in Reference examples 14 to 16 of the single cell shown in FIG. 52 are compared with the absorbances measured in Examples 67 to 69 in which the distance between two cells shown in FIG. 53 is adjusted to 1 mm, it can be seen that the peak of absorption shifts to the low frequency side in any case of two cells. In addition, in any case of two cells, it can be seen that the width of the absorption frequency band is almost the same as the width of the absorption frequency band of the single cell and accordingly reflects the characteristics of each single cell.

Also from Table 6 including the measurement results of examples not shown in FIG. 53, it can be seen that the resonance absorption peak is shifted to the lower frequency side as the distance between the two cells becomes shorter. In addition, the width of the absorption frequency band in examples not shown in FIG. 53 also reflects the characteristics of each single cell.

TABLE 1

| | Sound absorbing structure | State | Frame (mm) | Thickness (mm) | Surface other than sound absorbing structure | Distance of sound absorbing structure (mm) | Absorption peak frequency (Hz) | Frequency difference from single cell (Hz) | Remarks |
|---|---|---|---|---|---|---|---|---|---|
| Reference example 1 | Vibration film | Single | 16 | 10 | Plate closed | — | 1770 | — | Film vibration |
| Example 1 | Vibration film | Two cells face each other | 16 | 10 | Plate closed | 1 | 1565 | 205 | |
| Reference example 2 | Vibration film | Single | 16 | 20 | Plate closed | — | 1645 | — | |
| Example 2 | Vibration film | Two cells face each other | 16 | 10 | Plate closed | 2 | 1665 | 105 | |
| Example 3 | Vibration film | Two cells face each other | 16 | 10 | Plate closed | 5 | 1740 | 30 | |
| Example 4 | Vibration film | Two cells face each other | 16 | 10 | Plate closed | 0.5 | 1450 | 320 | |
| Comparative Example 1 | Vibration film | Two cells face each other | 16 | 10 | Plate closed | 20 | 1770 | 0 | |
| Reference example 3 | Vibration film | Single | 40 | 15 | Plate closed | — | 648 | — | Film vibration, low frequency side |
| Example 5 | Vibration film | Two cells face each other | 40 | 15 | Plate closed | 0.5 | 452 | 196 | |
| Example 6 | Vibration film | Two cells face each other | 40 | 15 | Plate closed | 1 | 510 | 138 | |
| Example 7 | Vibration film | Two cells face each other | 40 | 15 | Plate closed | 2 | 592 | 56 | |
| Example 8 | Vibration film | Two cells face each other | 40 | 15 | Plate closed | 3 | 612 | 36 | |
| Reference example 4 | Vibration film | Single | 40 | 30 | Plate closed | — | 550 | — | |
| Reference example 5 | Through-hole plate | Single | 16 | 10 | Plate closed | — | 1475 | — | Helmholtz |
| Example 9 | Through-hole plate | Two cells face each other | 16 | 10 | Plate closed | 1 | 910 | 565 | |
| Example 10 | Through-hole plate | Two cells face each other | 16 | 10 | Plate closed | 2 | 1175 | 300 | |
| Example 11 | Through-hole plate | Two cells face each other | 16 | 10 | Plate closed | 3 | 1315 | 160 | |
| Comparative Example 2 | Through-hole plate | Two cells face each other | 16 | 10 | Plate closed | 20 | 1475 | 0 | |
| Reference example 6 | Micro through-hole film | Single | 40 | 15 | Plate closed | — | 1596 | — | Micro through-hole |
| Example 12 | Micro through-hole film | Two cells face each other | 40 | 15 | Plate closed | 0.5 | 678 | 918 | |
| Example 13 | Micro through-hole film | Two cells face each other | 40 | 15 | Plate closed | 1 | 892 | 704 | |
| Example 14 | Micro through-hole film | Two cells face each other | 40 | 15 | Plate closed | 2 | 1140 | 456 | |
| Example 15 | Micro through-hole film | Two cells face each other | 40 | 15 | Plate closed | 3 | 1426 | 170 | |
| Comparative Example 3 | Micro through-hole film | Two cells face each other | 40 | 15 | Plate closed | 20 | 1596 | 0 | |
| Reference example 6A | Micro through-hole film | Single | 16 | 30 | Plate closed | — | 2685 | — | Micro through-hole |

TABLE 1-continued

| | Sound absorbing structure | State | Frame (mm) | Thickness (mm) | Surface other than sound absorbing structure | Distance of sound absorbing structure (mm) | Absorption peak frequency (Hz) | Frequency difference from single cell (Hz) | Remarks |
|---|---|---|---|---|---|---|---|---|---|
| Example 15A | Micro through-hole film | Two cells face each other | 16 | 30 | Plate closed | 1 | 1240 | 1445 | |
| Example 15B | Micro through-hole film | Two cells face each other | 16 | 30 | Plate closed | 5 | 2005 | 680 | |
| Comparative Example 4 | Micro through-hole film | Two cells face each other | 16 | 30 | Plate closed | 20 | 2685 | 0 | |

TABLE 2

| | Sound absorbing structure | State | Frame (mm) | Thickness (mm) | Surface other than sound absorbing structure | Distance of sound absorbing structure (mm) | Absorption peak frequency (Hz) | Frequency difference from single cell (Hz) | Remarks |
|---|---|---|---|---|---|---|---|---|---|
| Example 16 | Vibration film | Two cells face each other | 16 | 10 | Plate closed | 0.5 | 1445 | 325 | Direction is different from Example 4 by 90° |
| Example 17 | Vibration film | Two cells face each other | 16 | 10 | Plate closed | 1 | 1565 | 205 | Direction is different from Example 1 by 90° |
| Example 18 | Vibration film | Two cells face each other | 16 | 10 | Plate closed | 2 | 1660 | 110 | Direction is different from Example 2 by 90° |
| Example 19 | Vibration film | Two cells face each other, connected | 16 | 10 | Plate closed | 0.5 | 1435 | 335 | Two structures of Example 4 are connected |
| Example 20 | Vibration film | Two cells face each other, connected | 16 | 10 | Plate closed | 0.5 | 1410 | 360 | Two structures of Example 16 are connected |
| Example 21 | Vibration film | Two cells face each other, connected | 16 | 10 | Plate closed | 0.5, 2 | 1445 | 325 | Different units are connected, double peak |
| Example 22 | Vibration film | Two cells face each other, connected | 16 | 10 | Plate closed | 0.5, 2 | 1650 | 120 | Different units are connected, double peak |
| Reference example 7 | Through-hole plate | Single | 16 | 10 | Double-sided sound absorbing body, opened | — | 1408 | — | |
| Example 23 | Through-hole plate | Two cells face each other | 16 | 10 | Double-sided sound absorbing body, opened | 0.5 | 1183 | 225 | Double-sided through-hole plate |
| Example 24 | Through-hole plate | Two cells face each other | 16 | 10 | Double-sided sound absorbing body, opened | 1 | 1263 | 145 | |
| Example 25 | Through-hole plate | Two cells face each other | 16 | 10 | Double-sided sound absorbing body, opened | 2 | 1331 | 77 | |
| Example 26 | Through-hole plate | Two cells face each other | 16 | 10 | Double-sided sound absorbing body, opened | 3 | 1362 | 46 | |
| Example 27 | Through-hole plate | Two cells face each other | 16 | 10 | Double-sided sound absorbing body, opened | 4 | 1375 | 33 | |
| Reference example 8 | Through-hole plate | Single | 40 | 10 | Plate closed | — | 400 | — | |
| Example 28 | Through-hole plate | Two cells face each other | 40 | 10 | Plate closed | 0.2 | 161 | 239 | Helmholtz, low frequency side |
| Example 29 | Through-hole plate | Two cells face each other | 40 | 10 | Plate closed | 0.4 | 219 | 181 | |
| Example 30 | Through-hole plate | Two cells face each other | 40 | 10 | Plate closed | 0.6 | 246 | 154 | |
| Example 31 | Through-hole plate | Two cells face each other | 40 | 10 | Plate closed | 0.8 | 271 | 129 | |
| Example 32 | Through-hole plate | Two cells face each other | 40 | 10 | Plate closed | 1 | 286 | 114 | |
| Example 33 | Through-hole plate | Two cells face each other | 40 | 10 | Plate closed | 5 | 369 | 31 | |

TABLE 2-continued

| | Sound absorbing structure | State | Frame (mm) | Thickness (mm) | Surface other than sound absorbing structure | Distance of sound absorbing structure (mm) | Absorption peak frequency (Hz) | Frequency difference from single cell (Hz) | Remarks |
|---|---|---|---|---|---|---|---|---|---|
| Example 34 | Vibration film | Two cells face each other | 16 | 10 | Plate closed | 0.5 | 1430 | 340 | Rear side wall |
| Examole 35 | Vibration film | Two cells face each other | 16 | 10 | Plate closed | 0.5 | 1295 | 475 | Clearance three-direction walls |

TABLE 3

| | Sound absorbing structure | State | Frame (mm) | Thickness (mm) | Surface other than sound absorbing structure | Distance of sound absorbing structure (mm) | Absorption peak frequency (Hz) | Angle θ1 (deg) | Frequency difference from single cell (Hz) |
|---|---|---|---|---|---|---|---|---|---|
| Example 1 (reference) | Vibration film | Two cells face each other | 16 | 10 | Plate closed | 1 | 1565 | 0 | 205 |
| Example 36 | Vibration film | Two cells face each other | 16 | 10 | Plate closed | 1 | 1502 | 10 | 268 |
| Example 37 | Vibration film | Two cells face each other | 16 | 10 | Plate closed | 1 | 1445 | 20 | 325 |
| Example 38 | Vibration film | Two cells face each other | 16 | 10 | Plate closed | 1 | 1367 | 30 | 403 |
| Example 39 | Vibration film | Two cells face each other | 16 | 10 | Plate closed | 1 | 1263 | 40 | 507 |
| Example 40 | Vibration film | Two cells face each other | 16 | 10 | Plate closed | 0.2 | 592 | 40 | 1178 |

| | Sound absorbing structure | State | Frame (mm) | Thickness (mm) | Surface other than sound absorbing structure | Distance of sound absorbing structure (mm) | Absorption peak frequency (Hz) | Position shift amount δ (mm) | Frequency difference from single cell (Hz) |
|---|---|---|---|---|---|---|---|---|---|
| Example 1 (reference) | Vibration film | Two cells face each other | 16 | 10 | Plate closed | 1 | 1565 | 0 | 205 |
| Example 41 | Vibration film | Two cells face each other | 16 | 10 | Plate closed | 1 | 1589 | 4 | 181 |
| Example 42 | Vibration film | Two cells face each other | 16 | 10 | Plate closed | 1 | 1694 | 8 | 76 |
| Example 43 | Vibration film | Two cells face each other | 16 | 10 | Plate closed | 1 | 1752 | 12 | 18 |
| Example 44 | Vibration film | Films are close to each other | 16 | 10 | Plate closed | 1 | 1767 | 16 | 3 |

| | Sound absorbing structure | State | Frame (mm) | Thickness (mm) | Surface other than sound absorbing structure | Distance of sound absorbing structure (mm) | Absorption peak frequency (Hz) | Angle θ (deg) | Frequency difference from single cell (Hz) |
|---|---|---|---|---|---|---|---|---|---|
| Example 1 (reference) | Vibration film | Films are close to each other | 16 | 10 | Plate closed | 1 | 1565 | 0 | 205 |
| Example 45 | Vibration film | Films are close to each other | 16 | 10 | Plate closed | 1 | 1564 | 2.5 | 206 |
| Example 46 | Vibration film | Films are close to each other | 16 | 10 | Plate closed | 1 | 1555 | 5 | 215 |
| Example 47 | Vibration film | Films are close to each other | 16 | 10 | Plate closed | 3 | 1700 | 0 | 70 |
| Example 48 | Vibration film | Films are close to each other | 16 | 10 | Plate closed | 3 | 1702 | 5 | 68 |
| Example 49 | Vibration film | Films are close to each other | 16 | 10 | Plate closed | 3 | 1703 | 10 | 67 |
| Example 50 | Vibration film | Films are close to each other | 16 | 10 | Plate closed | 3 | 1699 | 15 | 71 |

| | Sound absorbing structure | Hole size | State | Frame (mm) | Thickness (mm) |
|---|---|---|---|---|---|
| Reference example 9 | Through-hole plate | 2 mm | Single | 20 | 10 |
| Reference example 10 | Through-hole plate | 3 mm | Single | 20 | 10 |

TABLE 3-continued

| | | | | | |
|---|---|---|---|---|---|
| Example 51 | Through-hole plate | 2 mm and 3 mm | Two cells face each other | 20 | 10 |
| Example 52 | Through-hole plate | 2 mm and 3 mm | Two cells face each other | 20 | 10 |
| Example 53 | Through-hole plate | 2 mm and 3 mm | Two cells face each other | 20 | 10 |
| Example 54 | Through-hole plate | 2 mm and 3 mm | Two cells face each other | 20 | 10 |

| | Surface other than sound absorbing structure | Distance of sound absorbing structure (mm) | Absorption peak frequency 1 (Hz) | Absorption peak frequency 2 (Hz) | Remarks |
|---|---|---|---|---|---|
| Reference example 9 | Plate closed | — | 800 | None | Helmholtz |
| Reference example 10 | Plate closed | — | 1100 | None | |
| Example 51 | Plate closed | 0.5 | 525 | 1025 | |
| Example 52 | Plate closed | 1 | 650 | 1025 | |
| Example 53 | Plate closed | 2 | 725 | 1050 | |
| Example 54 | Plate closed | 3 | 750 | 1050 | |

TABLE 4

| | Sound absorbing structure | State | Frame (mm) | Thickness (mm) | Surface other than sound absorbing structure | Distance of sound absorbing structure (mm) | Absorption peak frequency (Hz) | Frequency difference from single cell (Hz) |
|---|---|---|---|---|---|---|---|---|
| Reference example 1 | Fiber sheet | Single | 16 | 20 | Plate closed | — | 2920 | |
| Example 55 | Fiber sheet | Two cells face each other | 16 | 20 | Plate closed | 1 | 1395 | 1525 |
| Example 56 | Fiber sheet | Two cells face each other | 16 | 20 | Plate closed | 2 | 1715 | 1205 |
| Example 57 | Fiber sheet | Two cells face each other | 16 | 20 | Plate closed | 3 | 2035 | 885 |
| Example 58 | Fiber sheet | Two cells face each other | 16 | 20 | Plate closed | 5 | 2050 | 870 |
| Comparative Example 5 | Fiber sheet | Two cells face each other | 16 | 20 | Plate closed | 20 | 3415 | −495 |

TABLE 5

| | Sound absorbing structure | State | Frame thickness | Frame (mm) | Thickness (mm) | Surface other than sound absorbing structure | Distance of sound absorbing structure (mm) | Absorption peak frequency (Hz) | Absorption peak frequency 2 (Hz) |
|---|---|---|---|---|---|---|---|---|---|
| Reference example 12 | Through-hole plate | Single | 5 mm | 16 | 20 | Plate closed | — | 1050 | — |
| Reference example 13 | Through- hole plate | Single | 2 mm | 16 | 20 | Plate closed | — | 1300 | — |
| Example 59 | Through-hole plate | Two cells face each other | 2 mm and 5 mm | 16 | 20 | Plate closed | 1 | 725 | 1300 |
| Example 60 | Through-hole plate | Two cells face each other | 2 mm and 5 mm | 16 | 20 | Plate closed | 2 | 875 | 1300 |
| Example 61 | Through-hole plate | Two cells face each other | 2 mm and 5 mm | 16 | 20 | Plate closed | 3 | 945 | 1290 |
| Example 62 | Through- hole plate | Two cells face each other | 2 mm and 5 mm | 16 | 20 | Plate closed | 5 | 1000 | 1275 |
| Example 63 | Through-hole plate | Two cells face each other | 2 mm and 5 mm | 16 | 20 | Plate closed | 10 | 1035 | 1275 |
| Comparative Example 6 | Through-hole plate | Two cells face each other | 2 mm and 5 mm | 16 | 20 | Plate closed | 20 | 1045 | 1275 |

TABLE 6

| | State | Distance of sound absorbing structure (mm) | GW thick-ness (mm) | Absorption peak frequency 1 (Hz) |
|---|---|---|---|---|
| Reference example 14 | Single | — | — | 1000 |
| Reference example 15 | Single | — | 5 | 925 |
| Reference example 16 | Single | — | 10 | 825 |
| Example 64 | Two cells face each other | 0.5 | — | 625 |
| Example 65 | Two cells face each other | 0.5 | 5 | 600 |
| Example 66 | Two cells face each other | 0.5 | 10 | 550 |
| Example 67 | Two cells face each other | 1 | — | 775 |
| Example 68 | Two cells face each other | 1 | 5 | 725 |
| Example 69 | Two cells face each other | 1 | 10 | 650 |
| Example 70 | Two cells face each other | 2 | — | 875 |
| Example 71 | Two cells face each other | 2 | 5 | 825 |
| Example 72 | Two cells face each other | 2 | 10 | 725 |
| Example 73 | Two cells face each other | 3 | — | 925 |
| Example 74 | Two cells face each other | 3 | 5 | 875 |
| Example 75 | Two cells face each other | 3 | 10 | 775 |
| Example 76 | Two cells face each other | 5 | — | 950 |
| Example 77 | Two cells face each other | 5 | 5 | 900 |
| Example 78 | Two cells face each other | 5 | 10 | 800 |
| Example 79 | Two cells face each other | 10 | — | 975 |
| Example 80 | Two cells face each other | 10 | 5 | 900 |
| Example 81 | Two cells face each other | 10 | 10 | 800 |

As is apparent from the results of the above examples, the soundproof structure according to the embodiment of the present invention has a structure in which two or more soundproof cells (soundproof units) are disposed close to each other compared with the case of a single cell of a soundproof cell (soundproof unit). Therefore, it is possible to lower the absorption peak frequency. In addition, by changing the interlayer distance between the soundproof units, it is possible to adjust the absorption peak frequency. As a result, it is possible to achieve optimum soundproofing for the noise source.

The soundproof system according to the embodiment of the present invention was checked.

The soundproof system 70 shown in FIG. 35, which caused absorption at an appropriate frequency by automatically adjusting the absorption frequency by adjusting the interlayer distance between the soundproof members of the soundproof units with respect to the noise source, was manufactured.

As shown in FIG. 35, the configuration of the mike 72, the PC 74, and the device according to the embodiment of the present invention (soundproof structure 10 shown in FIG. 1) provided on the automatic stage 76 was adopted. As a soundproof structure, the sample used in Example 1 was used. First, the film proximity soundproof structure 10 was attached to the automatic stage 76 so that the inter-film distance could be adjusted by the automatic stage 76. The distance was adjusted by the automatic stage 76, and it was confirmed that the results of Examples 1 to 4 were reproduced.

In addition, by providing a feedback mechanism in the soundproof system 70, it was possible to construct an automatic muffling system without creating the correspondence table between the absorption frequency and the inter-film distance in advance. As a result, even in a case where the device characteristics were changed, the automatic muffling mechanism could be made to function.

Next, the interlayer distance between the soundproof members of the soundproof units was checked.

A system in which a 125-μm PET film was fixed to a frame with a size of 16 mm as in Example 1 was calculated by the finite element method using COMSOL. A system of a single cell and a system, in which the interlayer distance between the two cells was changed from 0.2 mm to 1.0 mm at intervals of 0.2 mm and from 2 mm to 20 mm at intervals of 1 mm, were calculated. By calculating the absorption spectrum in each case, an absorption peak frequency was calculated. In a case where the interlayer distance was 20 mm, there was no change from the absorption peak frequency of a single cell. Therefore, the interlayer distance is preferably less than 20 mm.

A frequency obtained by subtracting the absorption peak frequency relevant to each distance from the absorption peak frequency in the case of a single cell, that is, a frequency shift amount from the absorption peak frequency of a single cell was calculated.

Similarly, also in a case where the size of the frame 14 was changed to 24 mm and 32 mm, calculation was performed to calculate the frequency shift amount.

Figure 48:
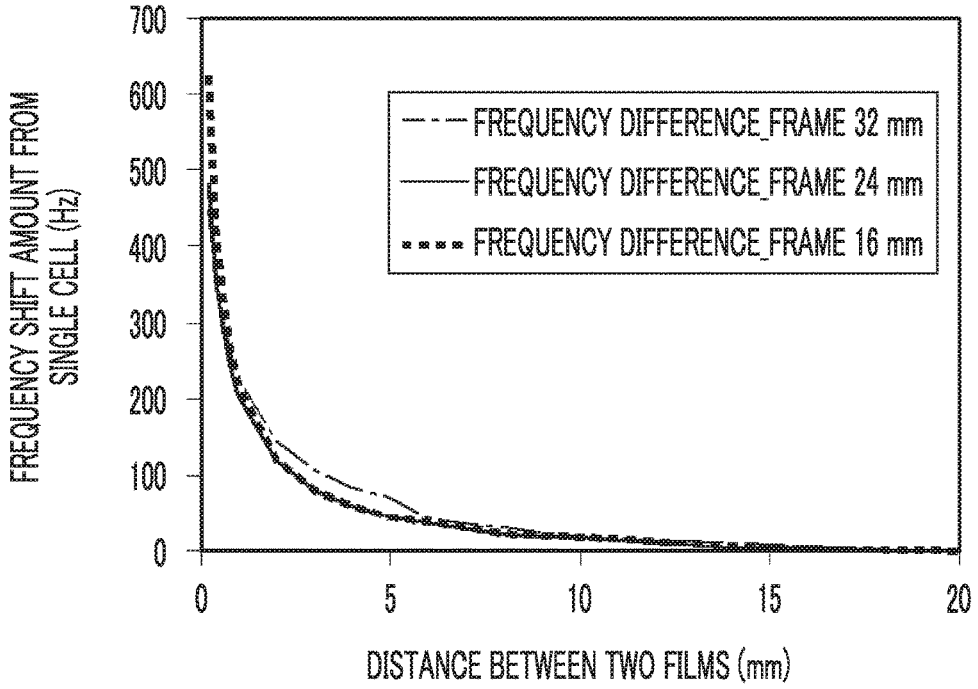
FIG. 48 is a graph showing the relationship between the frequency shift amount from a single cell of the soundproof structure and the interlayer distance.

The frequency shift amounts of three levels described above are shown in FIG. 48. It can be seen that the resonance frequencies are different since the sizes of the frames 14 are different, but the frequency shift amounts of the three levels are approximately the same.

From these pieces of data, it can be seen that shifting by 10 Hz or more occurs in a case where the average distance between the sound absorbing members is 15 mm or less, shifting by 20 Hz or more occurs in a case where the distance is 12 mm or less, and shifting by 30 Hz or more occurs in a case where the distance is 9 mm or less.

For example, in a sound absorbing structure using a vibration film, the absorption peak width is relatively narrow. For example, in Reference example 1, in a case where the frequency changes by about ±30 Hz, the absorbance changes by about 25% from the peak. The half-width tends to become narrower as the resonance is strengthened to increase the peak. Therefore, even with the frequency shift amount of about several tens of Hertz described above, it is possible to perform adjustment to change the absorbance sufficiently.

Therefore, the average distance between the sound absorbing members of the two sound absorbing structures is less than 20 mm, preferably 15 mm or less, more preferably 12 mm or less, and even more preferably 9 mm or less. In order to lower the frequency, the smaller the average distance between the sound absorbing members of the two sound absorbing structures, the larger the low frequency shift amount. However, in a case where the absorbing structures are completely in contact with each other, sound does not reach the absorbing structure. Therefore, it is necessary to make the absorbing structures spaced apart from each other. In addition, considering the difficulty in controlling the distance in practice and the fact that the sound needs to pass through a region on the slit between the absorbing structure and accordingly the acoustic transmittance of the slit itself is reduced due to friction occurring on the wall surface in a case where the slit width is too small, it can be seen that it is desirable to separate the absorbing structures from each other by the distance of about 1/1000 or more of the frame size. That is, it can be seen that, in a structure with a frame size of 20 mm, it is desirable to separate the absorbing structures from each other by about 20 μm or more.

From the above, the effect of the soundproof structure according to the embodiment of the present invention is obvious.

While the soundproof structure according to the embodiment of the present invention has been described in detail with reference to various embodiments and examples, the present invention is not limited to these embodiments and examples, and various improvements or modifications may be made without departing from the scope and spirit of the present invention.

In the examples of the soundproof units of the various soundproof structures described above, the frame and the sound absorbing member are separately manufactured, and the sound absorbing member is attached to the opening portion of the frame. However, the present invention is not limited thereto, and the frame and the sound absorbing member may be integrally configured.

That is, in the soundproof cell configuring the soundproof unit of the soundproof structure according to the embodiment of the present invention, for example, in the soundproof cell 40 shown in FIG. 21 that is a vibration film type soundproof cell, the frame 14 having the opening portion 13 and the film 42, which is attached to the opening portion 13 of the frame 14 and functions as the sound absorbing member 16, may be integrally formed of the same material. In addition to the frame 14 and the film 42, the rear plate 18 attached to the opening portion 13 of the frame 14 facing the film 42 may also be integrally formed of the same material.

In the soundproof cell 40*a* shown in FIGS. 22 and 23 that is a Helmholtz soundproof cell, the frame 14 having the opening portion 13 and the perforated plate 46, which is attached to the opening portion 13 of the frame 14, functions as the sound absorbing member 16, and comprises the through-hole (first through-hole) 48, or a perforated film may be integrally formed of the same material. In addition to the frame 14 and the perforated plate 46 or the perforated film, the rear plate 18 attached to the opening portion 13 of the frame 14 facing the perforated plate 46 or the perforated film may also be integrally formed of the same material.

As described above, the soundproof cell according to the embodiment of the present invention, which has a configuration in which the frame and the sound absorbing member (the vibration film, the perforated plate, or the perforated film) or the frame, the sound absorbing member (the vibration film, the perforated plate, or the perforated film), and the rear plate are integrated, can be manufactured by simple processing, such as compression molding, injection molding, imprinting, scraping processing, and a processing method using a three-dimensional shaping (3D) printer.

As described above, in the soundproof cell used as the soundproof unit of the soundproof structure according to the embodiment of the present invention, by integrally forming the frame and the sound absorbing member (the vibration film, the perforated plate, or the perforated film) and integrally forming the frame and the sound absorbing member (the vibration film, the perforated plate, or the perforated film) and the rear plate, resistance to environmental changes or aging is increased, and it is possible to obtain stable sound insulation. In addition, it is also possible to avoid manufacturing problems, such as uniform adhesion and bonding of the sound absorbing member (the vibration film, the perforated plate, or the perforated film) to the frame and uniform adhesion and bonding of the rear plate.

EXPLANATION OF REFERENCES

10, 10*a*, 10*b*, 10*c*, 10*e*, 10*f*, 10*g*, 10*h*, 11, 11*a*, 11*b*, 30, 30*a*, 30*b*, 30*c*, 30*d*, 30*e*, 30*f*,
30*g*, 60: soundproof structure
12, 12*a*, 12*b*, 12*c*, 12*d*, 12*e*, 12*f*, 12*g*, 12*h*: soundproof unit
13, 13*a*, 13*b*, 13*c*1, 13*c*2, 13*d*1, 13*d*2: opening portion
14, 14*a*, 14*b*, 14*c*, 14*d*: frame
16, 16*a*, 16*b*, 16*c*, 16*d*: sound absorbing member
18, 18*a*, 18*b*, 18*c*, 18*d*: rear plate
19*a*, 19*b*: facing surface
20, 20*a*, 20*b*: slit
21, 21*a*, 21*b*: mirror image plane
22, 23: plate
24, 24*a*: soundproof unit set
26: wall
28, 28*a*: soundproof wall
32: tubular member (acoustic tube)
32*a*: inner wall surface
33: hole portion
40, 40*a*, 40*b*, 40*c*: soundproof cell
42: film
44, 48: through-hole (first through-hole)
46: perforated plate
50: micro perforated plate
52 through-hole (micro through-hole, second through-hole)
54: aluminum base material
56: aluminum hydroxide coating film
62: mounting table
64: traveling nut
66: drive screw
68: screw moving mechanism
70, 70*a*: soundproof system
72, 72*a*, 72*b*: microphone (mike)
74: personal computer (PC)
76: automatic stage
78: noise source

What is claimed is:

1. A soundproof structure, comprising:

two or more soundproof units, wherein each soundproof unit has a frame having an opening portion and a sound absorbing member attached to the opening portion of the frame, two adjacent soundproof units are disposed such that at least parts of the sound absorbing members face each other, the sound absorbing members at least parts of which face each other are spaced apart from each other, and an average distance between the sound absorbing members at least parts of which face each other is less than 20 mm wherein the sound absorbing member is a film that vibrates with respect to sound, and the film covers the opening portion of the frame and is fixed to the frame.

2. The soundproof structure according to claim 1, wherein the sound absorbing member is a ventilation sheet structure.

3. The soundproof structure according to claim 2, wherein the sound absorbing member is a plate or a film in which at least one or more first through-holes are provided, the first through-hole is a through-hole having a diameter greater than 0.25 mm, and the plate or the film covers the opening portion of the frame and is fixed to the frame.

4. The soundproof structure according to claim 2, wherein the sound absorbing member is a plate-shaped member comprising a plurality of micro second through-holes each having a diameter of 0.1 μm to 250 μm.

5. The soundproof structure according to claim 2, wherein the sound absorbing member is a fiber sheet.

6. The soundproof structure according to claim 1, wherein at least one of the two or more soundproof units is closed except for a surface having the sound absorbing member.

7. The soundproof structure according to claim 1, wherein, in at least one of the two or more soundproof units, at least a part of a surface facing a surface having the sound absorbing member is opened.

8. The soundproof structure according to claim 1, wherein at least one of the two or more soundproof units has the sound absorbing member on each of two surfaces facing each other.

9. The soundproof structure according to claim 1, wherein, in at least one of the two or more soundproof units, at least parts of side surfaces of surfaces of the sound absorbing members of the two adjacent soundproof units facing each other are blocked.

10. The soundproof structure according to claim 1, wherein, in at least one of the two or more soundproof units, a porous sound absorbing body or a fibrous sound absorbing body is included in the frame.

11. The soundproof structure according to claim 1, wherein at least one of the two or more soundproof units is disposed on a wall of a structure.

12. The soundproof structure according to claim 1, wherein, with the two adjacent soundproof units as a set of soundproof units, a plurality of sets of soundproof units are combined to function as a soundproof wall.

13. The soundproof structure according to claim 1, wherein the two or more soundproof units are disposed in a cylindrical member, and a part of a hole portion inside the cylindrical member is opened.

14. The soundproof structure according to claim 13, wherein at least one of the two or more soundproof units is disposed on an inner wall of the cylindrical member.

15. The soundproof structure according to claim 1, wherein the two or more soundproof units are periodically arranged.

16. The soundproof structure according to claim 1, wherein, with the two or more soundproof units including the two adjacent soundproof units as a unit, a plurality of the units are disposed.

17. The soundproof structure according to claim 1, further comprising:

a moving mechanism that moves the sound absorbing member of one of the two adjacent soundproof units relative to the other sound absorbing member, wherein the moving mechanism changes a distance between the sound absorbing members of the two adjacent soundproof units.

18. The soundproof structure according to claim 17, wherein the moving mechanism is a rail traveling mechanism comprising a rail and a wheel on which at least one of the two adjacent soundproof units is mounted and which travels on the rail.

19. The soundproof structure according to claim 17, wherein the moving mechanism is a screw moving mechanism, which comprises a ball screw and a nut to which at least one of the two adjacent soundproof units is attached and which is screwed to the ball screw, or a rack and pinion mechanism which comprises a rack, to which at least one of the two adjacent soundproof units is attached, and a pinion engaged with the rack.

20. A soundproof system, comprising:

the soundproof structure according to claim 1;

a measurement unit that measures noise in a surrounding environment of the soundproof structure; and an analysis unit that analyzes a frequency of noise measured by the measurement unit, wherein a distance between the sound absorbing members of the two adjacent soundproof units is changed according to an analysis result of the analysis unit.

21. The soundproof system according to claim 20, wherein the soundproof mechanism is the soundproof structure according to claim 17, the moving mechanism is an automatic moving mechanism further comprising a driving source and a control unit that controls driving of the driving source, the analysis unit determines a movement amount of at least one of the two adjacent soundproof units according to the analysis result, and the control unit controls the driving of the driving source according to the determined movement amount to automatically move at least one of the two adjacent soundproof units such that a distance between the sound absorbing members of the two adjacent soundproof units is changed.

22. The soundproof system according to claim 21, further comprising:

a plurality of the measurement units, wherein the analysis unit analyzes the frequency of noise measured by each of the plurality of measurement units, and determines the movement amount of at least one of the two adjacent soundproof units according to the analysis result.

* * * * *